US005897250A

United States Patent [19]

Hirai et al.

[11] Patent Number: 5,897,250

[45] Date of Patent: Apr. 27, 1999

[54] SHEET PROCESSING APPARATUS

[75] Inventors: Katsuaki Hirai; Noriyoshi Ueda; Yoshifumi Takehara; Masaaki Sato, all of Yokohama; Katsuhito Kato, Kawasaki; Naho Saitoh, Inagi; Kenichi Hayashi, Kawasaki, all of Japan

[73] Assignee: Canon Kabushiki Kaisha, Tokyo, Japan

[21] Appl. No.: 08/847,470

[22] Filed: Apr. 25, 1997

[30] Foreign Application Priority Data

| | | | |
|---|---|---|---|
| Apr. 26, 1996 | [JP] | Japan | 8-108251 |
| May 7, 1996 | [JP] | Japan | 8-112847 |
| May 7, 1996 | [JP] | Japan | 8-112848 |
| May 7, 1996 | [JP] | Japan | 8-112849 |

[51] Int. Cl.[6] ..... G03G 15/00

[52] U.S. Cl. ..... 399/404; 156/277; 399/407

[58] Field of Search ..... 399/404, 405, 399/407; 270/58.31, 58.32; 156/277, 191

[56] References Cited

U.S. PATENT DOCUMENTS

| | | | |
|---|---|---|---|
| 4,586,975 | 5/1986 | Derby | 156/277 X |
| 5,021,837 | 6/1991 | Uto et al. . | |
| 5,084,736 | 1/1992 | Suzuki et al. . | |
| 5,096,176 | 3/1992 | Golicz et al. | 270/58.32 |
| 5,181,705 | 1/1993 | Ueda et al. . | |
| 5,203,552 | 4/1993 | Hoshi et al. . | |
| 5,316,279 | 5/1994 | Corona et al. | 270/1.01 |
| 5,390,016 | 2/1995 | Hoshi et al. . | |
| 5,465,949 | 11/1995 | Yamada et al. . | |
| 5,621,501 | 4/1997 | Matsuo et al. . | |

*Primary Examiner*—Matthew S. Smith

*Attorney, Agent, or Firm*—Fitzpatrick, Cella, Harper & Scinto

[57] ABSTRACT

A sheet processing apparatus includes a first sheet feeder for feeding a first sheet; a second sheet feeder for feeding a second sheet for discrimination; a sheet sticking device for sticking the second sheet fed from said second sheet feeder on the first sheet in the first sheet feeder such that a part of the second sheet is partly extended out of the first sheet.

39 Claims, 56 Drawing Sheets

(STEP1)

(STEP2)

(STEP3)

(STEP4)

(STEP5)

(STEP6)

SHEET PROCESSING APPARATUS

FIELD OF THE INVENTION AND RELATED ART

The present invention relates to a sheet processing apparatus, more specifically, such a sheet processing apparatus that sequentially sorts into a delivery tray, the output sheets which are discharged from an image forming apparatus such as a copying machine, a laser beam printer, or a facsimile machine after image formation.

It is general knowledge that in a conventional sheet processing apparatus, for example, a shift tray (sheet delivery tray) disposed adjacent to, or in contact with, the sheet delivery portion of an image forming apparatus, each sheet set is deposited staggered from the adjacent ones so that the boundary between two adjacent sheet sets can be easily recognizable (FIGS. 82 and 83, FIG. 83 being a side view of FIG. 82 as seen from the direction of an arrow mark A).

As for a sorting operation performed by the shift tray (sheet delivery tray), a sheet delivery tray 120 (hereinafter, tray) which stores the sheets discharged from a sheet discharging means 121 after image formation is shifted for each sheet set in the direction (arrow mark C) perpendicular to the sheet discharging direction (arrow mark B) by an unillustrated driving means, so that each sheet set can be easily separated from the adjacent ones as illustrated in FIG. 83, in which alphanumeric references P1–P4 designate a sheet set.

However, in the case of an image forming apparatus capable of functioning as an image outputting section for a facsimile machine, a copying machine, or a printer, separating each sheet set from the adjacent ones by shifting a single tray creates the following problems.

For example, let it be supposed that a plurality of users use an image forming apparatus as a printer, and each of the output sheet sets is deposited staggered from the adjacent ones in a single tray. In this situation, as one of the users removes one sheet set (sheet set P2 in FIG. 83) from among the sheet sets accumulated in the tray, the stack of the sheet sets will look like the one depicted in FIG. 85 (FIG. 85 is a side view of FIG. 84 as seen from the direction of an arrow A), making it impossible to simply recognize the boundary between the sheet sets P3 and P1. Further, when the sheet set P2 is pulled out, a portion of the sheet set above/and below the P2 may be pulled out together with the sheet set P2, further complicating the task of recognizing the boundary.

The problem described above also occurs when a plurality of user use the same tray of a facsimile machine. Further, when a single image forming apparatus is used as the outputting means for a facsimile machine, a copying machine, and a printer, the problem becomes more complicated.

SUMMARY OF THE INVENTION

The primary object of the present invention is to provide a sheet processing apparatus capable of attaching a second sheet, that is, an identification sheet, to each first sheet or first sheet set, that is, a printing output sheet or printing output sheet set when sorting the first sheets or first sheet sets, wherein an image may be printed on the second sheet so that the addresses, to which the first sheets or the first sheet sets will be distributed, or the like, can be easily recognized.

Another object of the present invention is to provide a sheet processing apparatus capable of cutting the second sheet to an optional length, based on such information as the size of the first sheet, or image formation range on the second sheet.

Another object of the present invention is to provide a sheet processing apparatus capable of informing the user of the mode in which the first sheets have been outputted: a facsimile machine mode, a copy machine mode, or a printer mode.

According to an aspect of the present invention, a sheet processing apparatus comprise; a first sheet conveying portion for conveying the first sheet; a second sheet conveying portion for conveying the second sheet; and a sheet pasting portion for pasting the first sheet conveyed by the second sheet conveying portion to the first sheet within the first sheet conveying portion.

According to another aspect of the present invention, the second sheet conveying portion comprises an image forming portion for forming an image on the second sheet.

According to another aspect of the present invention, the second sheet conveying portion comprises a continuous sheet storing portion for storing a continuous sheet as the second sheet, a cutting portion for cutting the continuous second sheet fed out of the continuous sheet storing portion, and a conveying portion for conveying the cut second sheet, wherein the image forming portion is disposed between the continuous sheet storing portion and the cutting portion.

According to another aspect of the present invention, the second sheet conveying portion comprises a cut sheet storing portion for storing cut sheets as the second sheet, a conveying portion for conveying the second sheet fed out of the cut sheet storing portion, wherein the image forming portion is disposed between the cut sheet storing portion and the conveying portion.

According to another aspect of the present invention, the second sheet pasted to the first sheet faces upward after being conveyed from the second sheet conveying portion.

According to another aspect of the present invention, a sheet processing apparatus comprises controlling means for determining a cutting position at which the second sheet is cut by the cutting portion, wherein the continuous sheet is cut at an optional position, based on the control information from the controlling means.

With the provision of the above described structures, the first sheet is conveyed by the first sheet conveying portion, and to this first sheet conveying portion, the second sheet is conveyed from the second sheet conveying portion to be pasted to the first sheet by the sheet pasting portion so that the boundaries among the first sheets can be easily recognized after they are sorted into the sheet delivery tray.

Further, an image may be formed in advance on the second sheet so that the address or the like of the first sheets to which the second sheet is pasted can be easily identified.

According to another aspect of the present invention, the cutting portion is enabled to cut the second sheet to an optional length depending on the first sheet size, the image formation range on the second sheet, the amount of the second sheet remainder, and the like. Therefore, it becomes possible to easily recognize the boundaries among the first sheets or first sheet sets even when the first sheet size changes, or to optionally choose the size of the image formation range on the label sheet. Also, it becomes possible to change the length to which the second sheet is cut, or reduce the image formation range, depending on the amount of the second sheet remainder.

According to another aspect of the present invention, the second sheet is pasted to the first sheet, on the surface which faces downward when the first sheet is in the first sheet accumulating means Therefore, the following first sheet is not caught by the second sheet pasted to the preceding first sheet, more smoothly accumulating in the first sheet accumulating means, In better alignment with the preceding first sheet.

According to another aspect of the present invention, the second sheet is pasted to a first sheet, at a position which is on the upstream side of the position at which the leading end of the following first sheet makes initial contact with the preceding first sheet in the first sheet accumulating means. Therefore, even when the second sheet is pasted to the first sheet, on the surface which faces upward when the first sheet is in the first sheet accumulating means, the following first sheet is not caught by the second sheet pasted to the preceding first sheet, more smoothly accumulating in the first sheet accumulating means, in better alignment with the preceding first sheet.

According to another aspect of the present invention, in the case of a sheet processing apparatus in which a first sheet is moved in the direction opposite to the first sheet discharging direction after the leading end of the following first sheet makes contact with the preceding first sheet in the first sheet accumulating means, the second sheet is pasted to the first sheet, at a position which is on the upstream side of the position at which the leading end of the following first sheet makes initial contact with the preceding first sheet in the first sheet accumulating means, and at the same time, on the downstream side of the position at which the trailing end of the following first sheet makes initial contact with the preceding first sheet in the first sheet accumulating means. Therefore, even when the second sheet is pasted to the first sheet, on the surface which faces upward when the first sheet is in the first sheet accumulating means, the following first sheet is not caught by the second sheet pasted to the preceding first sheet, more smoothly accumulating in the first sheet accumulating means, in better alignment with the preceding first sheet.

According to another aspect of the present invention, in the case of a sheet processing apparatus in which a first sheet is moved in the direction opposite to the first sheet discharging direction after the trailing end of the following first sheet makes contact with the preceding first sheet in the first sheet accumulating means, the second sheet is pasted to the first sheet, at a position which is on the upstream side of the position at which the trailing end of the following first sheet makes initial contact with the preceding first sheet in the first sheet accumulating means before the following sheet begins to move in the direction opposite to the first sheet conveying direction. Therefore, even when the second sheet is pasted to the first sheet, on the surface which faces upward when the first sheet is in the first sheet accumulating means, the following first sheet is not caught by the second sheet pasted to the preceding first sheet, more smoothly accumulating in the first sheet accumulating means, in better alignment with the preceding first sheet.

According to another aspect of the present invention, the second sheet is rendered removably placeable in the second sheet feeding portion. Therefore, the operational efficiency of the sheet processing apparatus is improved. Also, the Second sheet is placed in a cartridge which is removably installable in the second sheet feeding portion. Therefore, the operational efficiency of the sheet processing apparatus is further improved.

According to another aspect of the present invention, in a processing apparatus in which the first sheets are accumulated in the first sheet accumulating means after the second sheet is pasted to the first sheet, the first sheet accumulating means comprises a plurality of job identifying means which display the contents of the jobs performed by an image forming apparatus, wherein the second sheet is pasted to the first sheet, at a position which corresponds to the job identifying means which identifies the current job. Therefore, not only are the boundaries among the first sheets in the first sheet accumulating means easily recognizable, but also the job contents can be easily identified, making it easier for the user to pick out a correct first sheet.

According to another aspect of the present invention, in a processing apparatus in which the first sheets are accumulated in the first sheet accumulating means after the second sheet is pasted to the first sheet, the first sheet accumulating means comprises a plurality of addressee identifying means which identify an addressee, or owner of the first sheet, wherein the second sheet is pasted to the first sheet, at a position which corresponds to the addressee identifying means which identifies the current job. Therefore, not only are the boundaries among the first sheets in the first sheet accumulating means easily recognizable, but also the addressee can be easily identified, making it easier to accurately distribute first sheets.

These and other objects, features and advantages of the present invention will become more apparent upon a consideration of the following description of the preferred embodiments of the present invention, taken in conjunction with the accompanying drawings.

BRIEF DESCRIPTION OF THE DRAWINGS

FIG. 53 is a front view of the sheet roll mounting portion on which a sheet roll is on.

DETAILED DESCRIPTION OF THE EMBODIMENTS

Embodiment 1

Next, the first embodiment of the present invention, in which the present invention is applied to the sheet processing apparatus of an image forming apparatus, will be described.

Figure 1:
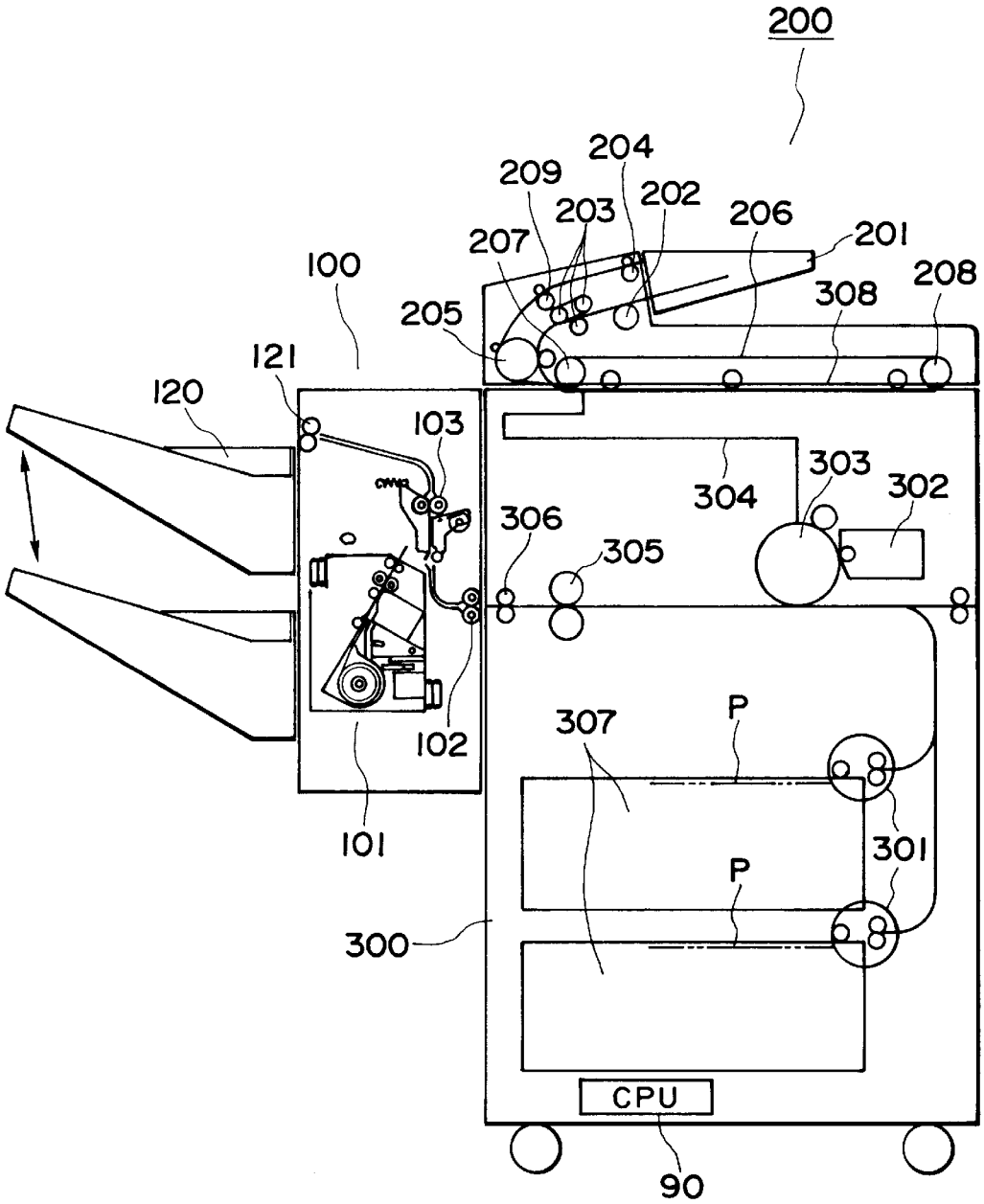
FIG. 1 is a vertical section of the front side of an image forming apparatus compatible with a sheet processing apparatus in accordance with the present invention.

FIG. 1 is a vertical section of an image forming system comprising an image forming apparatus 300, a recirculating type automatic original feeding apparatus 200, and a sheet processing apparatus 100.

First, the general structures and operations of the apparatuses will be described. The image forming apparatus 300 comprises: a cassette 307 for storing sheets (first sheet) P; a sheet feeding portion 301 for feeding out the sheets within the cassette, one sheet at a time; a transferring portion (image forming portion) 303 for transferring toner image onto a sheet P having been conveyed to the transferring portion 303; a developing portion 302 for developing a toner image on the transferring portion 303; an optical portion for reading a target image on a platen 308 and projecting to the transferring portion 303, a light beam which reflects the data of the target image; a fixing portion 305 for fixing the transferred toner image to the sheet P; a sheet discharging portion 306 for discharging the sheet P from the apparatus, after the toner image fixation; and the like.

The recirculating type automatic original feeding apparatus 200 comprises: a tray 201 in which a set of originals is placed; a sheet feeding roller 202 for conveying the originals, one at a time, starting from the bottommost sheet of the set of originals; a separating portion 203; a conveyer roller pair 205 for conveying a separated original to the platen 308; a conveyer belt 206 for conveying the original on the platen 308; belt rollers 207 and 208 for driving the conveyer belt 206; conveyer roller pairs 205 and 209 for depositing back into the tray 201, the original conveyed from the platen 308 after reading; and a discharging roller pair 204.

The originals placed in the tray 201 are fed out one by one, and are deposited again into the tray 201. This cycle of feeding one of the originals out of the tray 201 and depositing it back into the tray 201 is repeated by the same number as the desired number of copies so that an appropriate number of copies are discharged from the image forming apparatus 300 to produce the desired number of copy sets.

The sheet processing apparatus 100 comprises: a conveyer roller pair (first sheet feeding portion) 102 for receiving and conveying the sheet sent out by the discharging roller pair (discharging means) 306 of the image forming apparatus 300; a conveyer roller pair (first sheet conveying portion) 103; a sheet delivery tray (accumulating means) 120; a discharging roller pair (discharging means) 121 for discharging and accumulating the sheets into the sheet delivery tray 120, and the like. The tray 120 is vertically movable (direction of an arrow mark) by an unillustrated driving portion corresponding to the number of the sheets accumulated on the tray 120.

A reference numeral 101 designates a continuous sheet feeding portion (second sheet feeding portion or second sheet conveying portion) that characterizes the present invention. Hereinafter, this portion will be described in detail.

Figure 2:
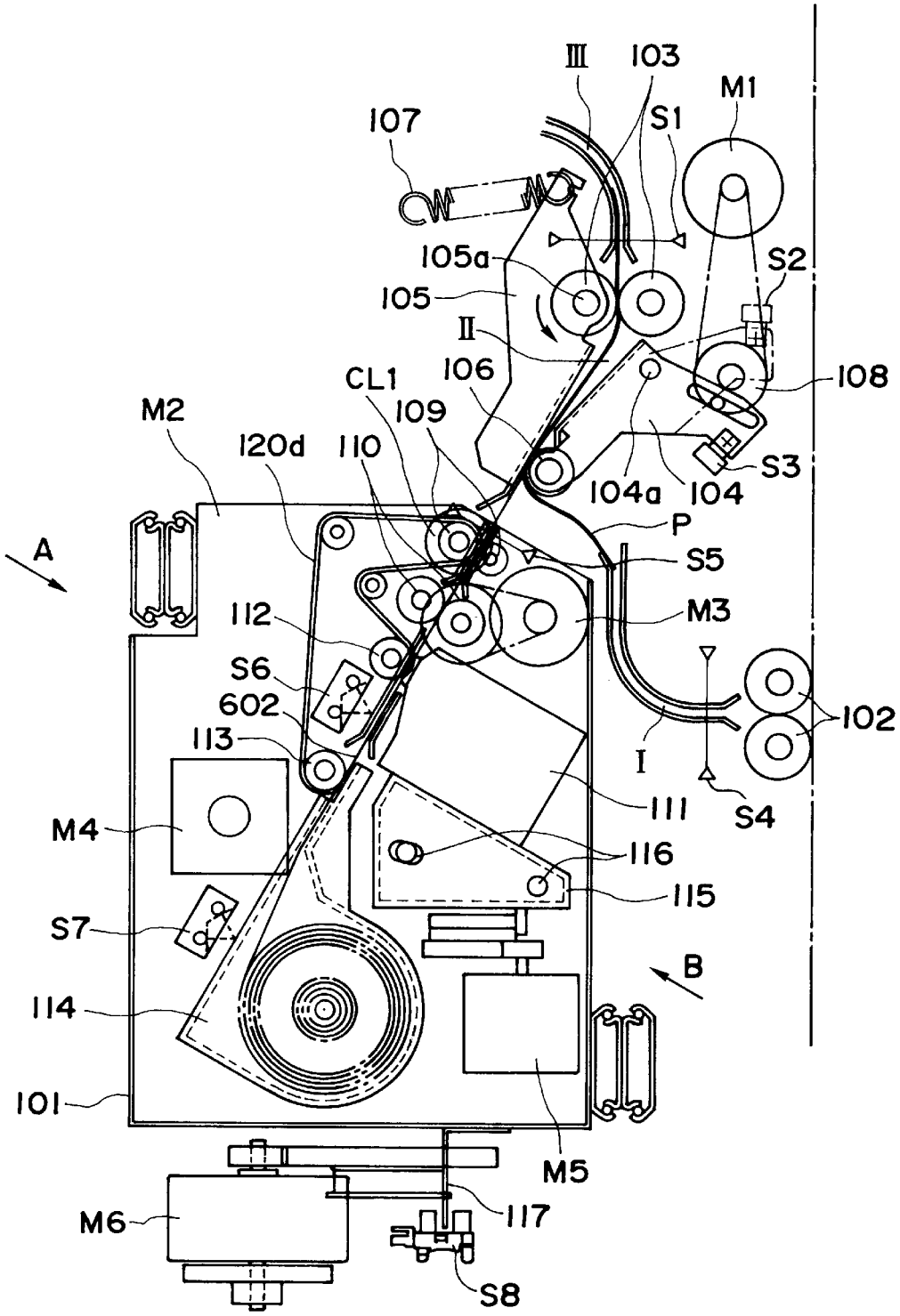
FIG. 2 is a vertical section of the front side of the sheet feeding portion (sheet conveying portion) of the sheet processing apparatus in accordance with the present invention.
Figure 3:
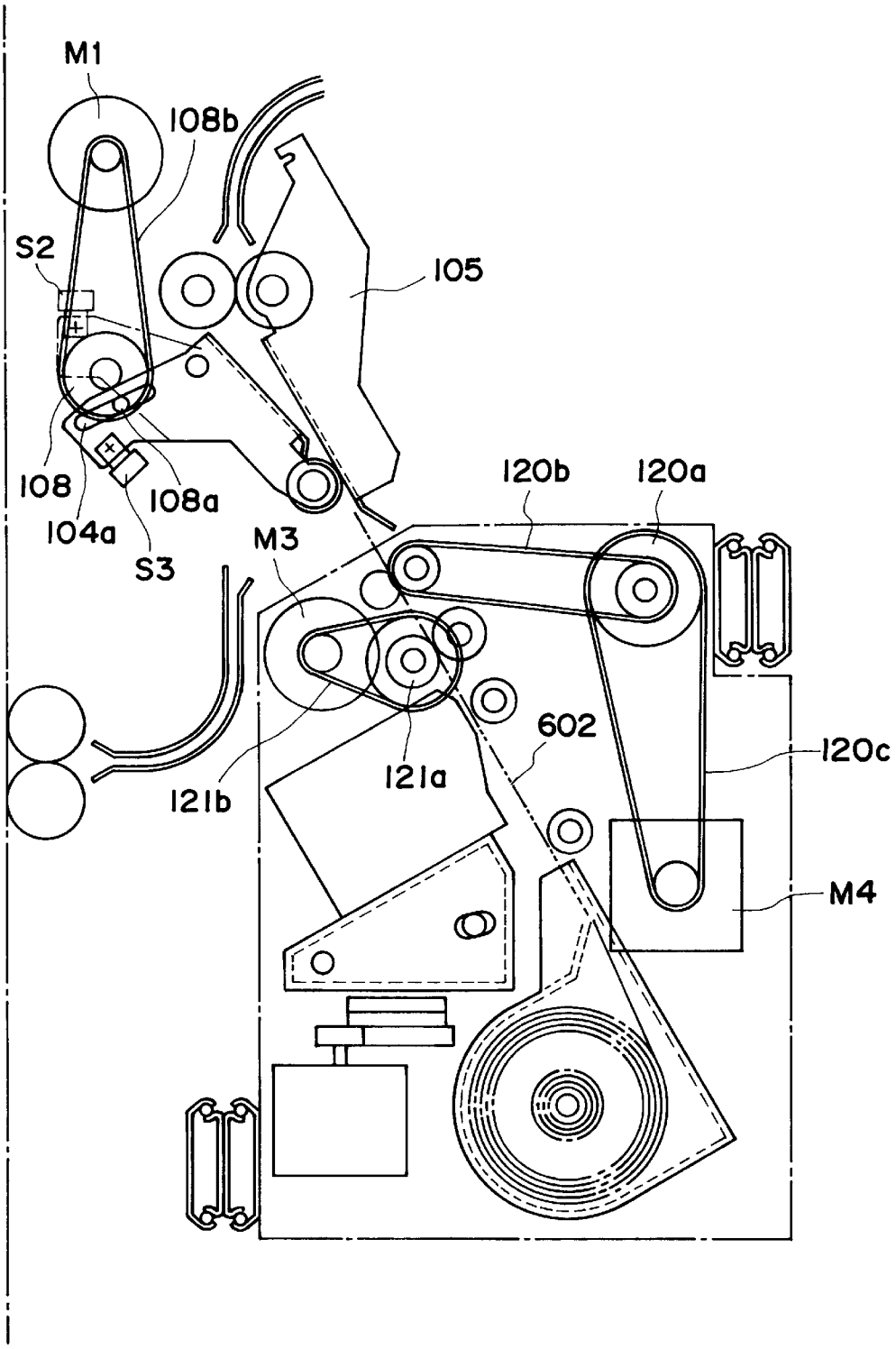
FIG. 3 is a vertical section of the back side of the sheet feeding portion (sheet conveying portion) illustrated in FIG. 2.
Figure 4:
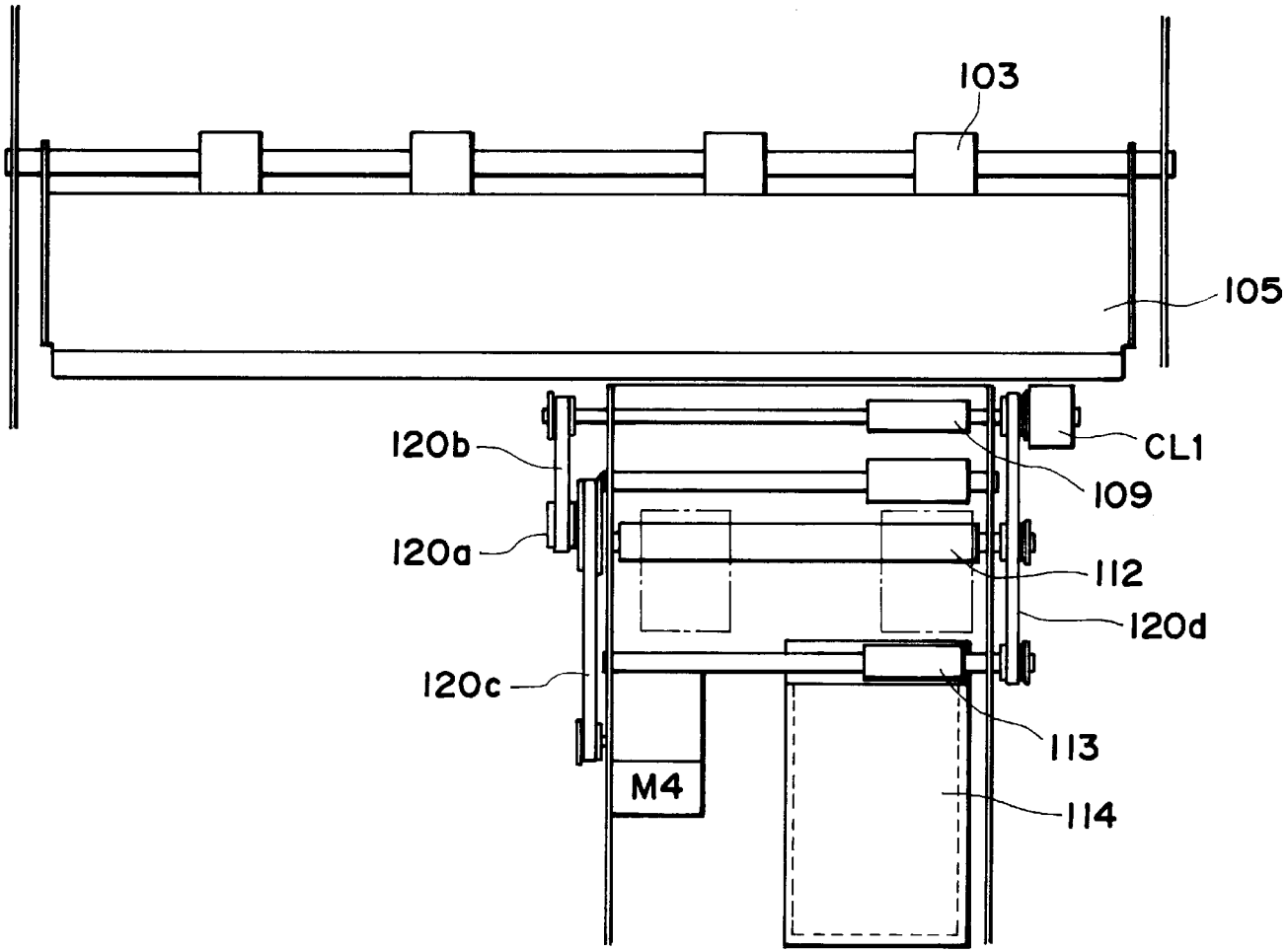
FIG. 4 is a side view of the sheet feeding portion illustrated in FIG. 2, as seen from the direction of an arrow mark A in FIG. 2.
Figure 5:
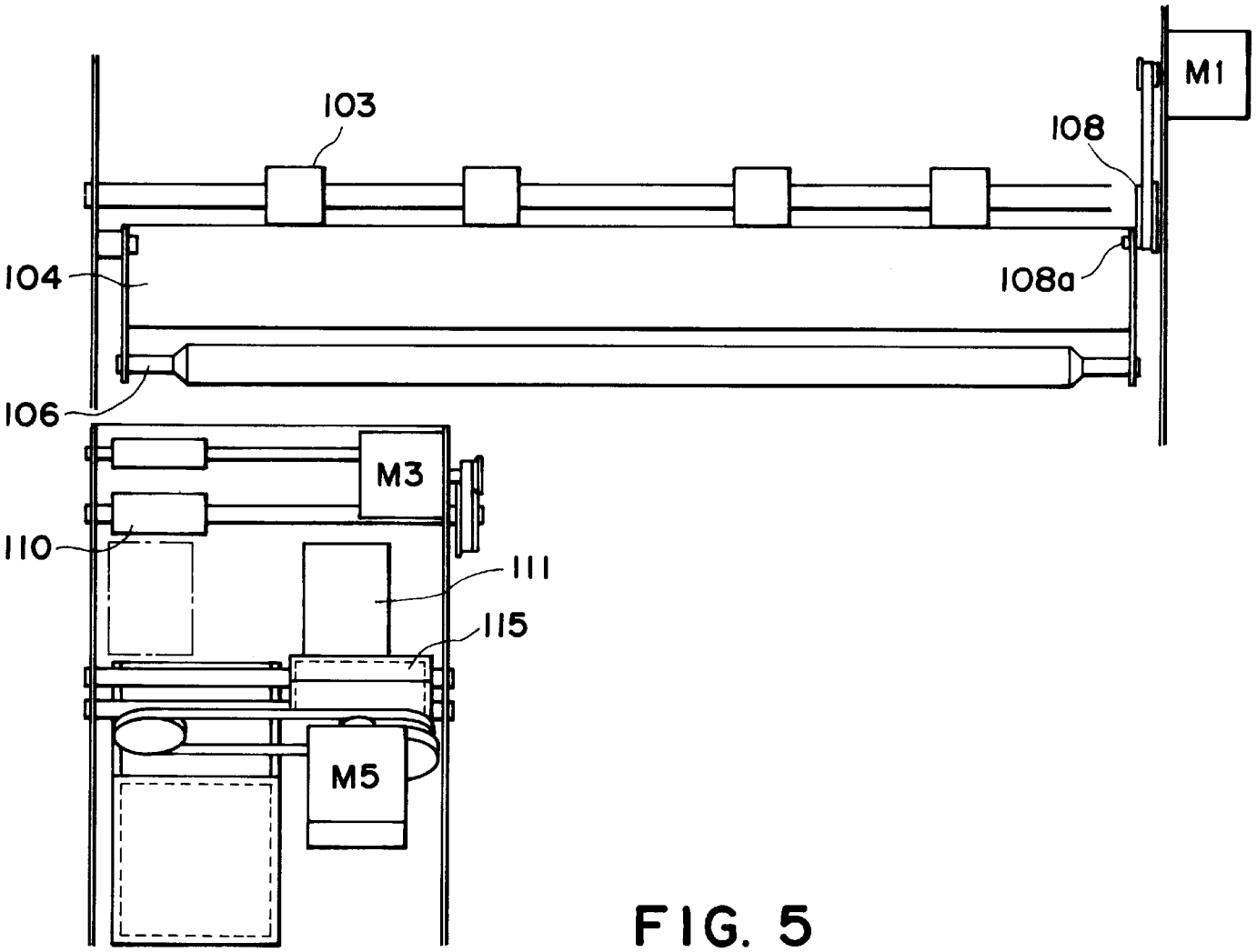
FIG. 5 is a side view of the sheet feeding portion illustrated in FIG. 2, as seen from the direction of an arrow mark B in FIG. 2.
Figure 6:
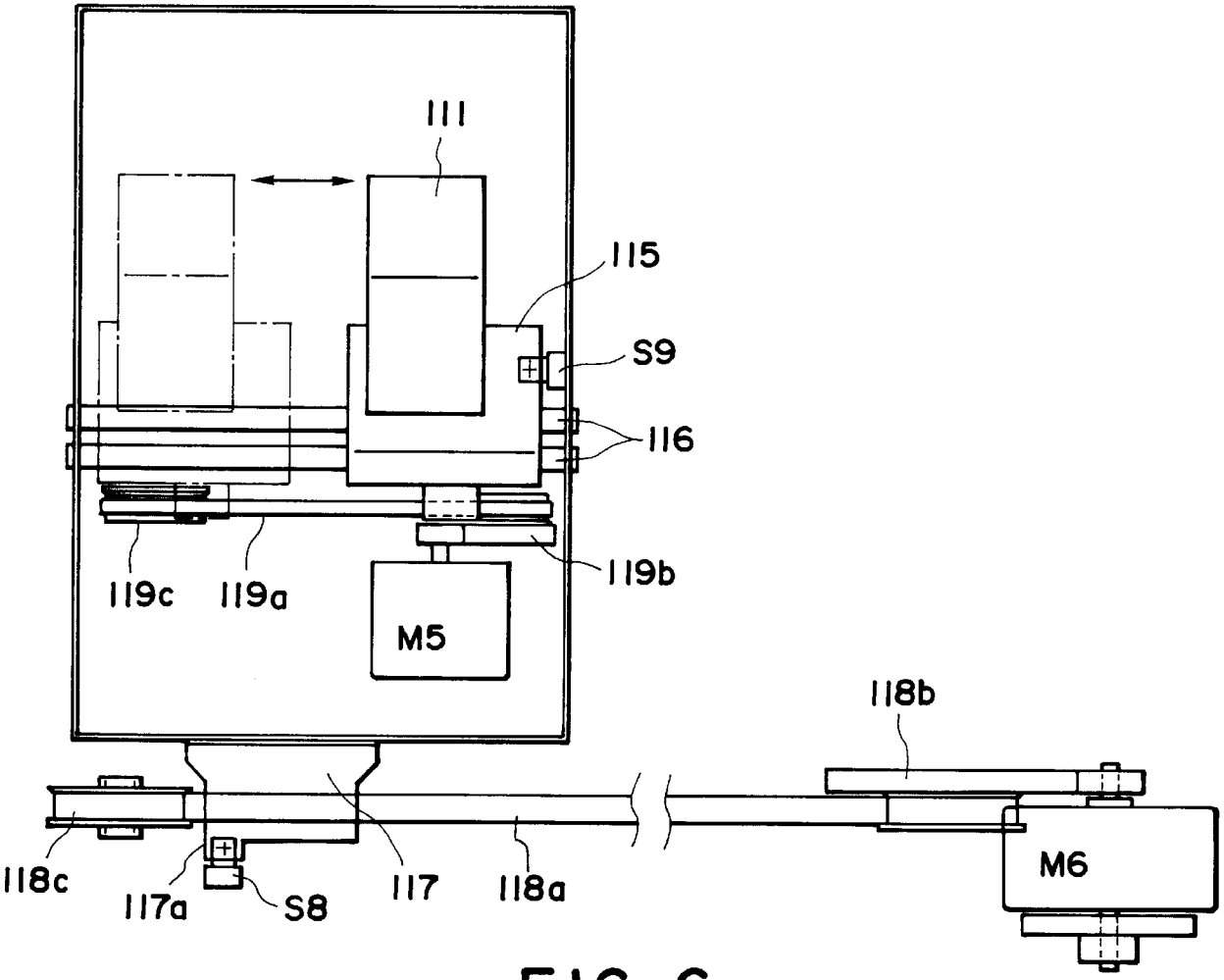
FIG. 6 is a side view of the sheet feeding portion illustrated in FIG. 2, as seen from the right-hand direction of FIG. 2.

FIG. 2 is a vertical section of the front portion of the second sheet feeding portion 101, the sectional plane being parallel to the front surface of the apparatus; FIG. 3, a vertical section of the rear portion of the second sheet feeding portion 101, depicting in detail the driving mechanism; FIG. 4, a view of the second sheet feeding portion 101 as seen from the direction of an arrow mark A in FIG. 2; FIG. 5, a view of the same, as seen from the direction of an arrow mark B: and FIG. 6 is a right side view of the same.

A continuous roll of sheet (second sheet) 602 is stored in a continuous sheet cartridge 114 which is removably installable in the second sheet feeding portion 101, so that the user can easily place the sheet 602 in the second sheet feeding portion 101 or remove it therefrom.

On the spot opposite to the cartridge 114, a cartridge set detection sensor (second sheet remainder detecting means) S7 for detecting the presence or absence of the cartridge 114 and the presence (remainder) or absence of the second sheet 602 within the cartridge 114 is disposed On the downstream side of the cartridge 114, a sheet feeding roller 113 for feeding the second sheet in coordination with the cartridge 114 is disposed. The sheet feeding roller 113 is kept pressured toward the cartridge 114 by an unillustrated elastic member or the like, so that when the cartridge 114 is in the sheet feeding portion 101, sheet conveying force is always transmitted to the sheet 602.

As the continuous sheet 602 is conveyed, its leading end is detected by the first registration sensor S6. Thereafter, it is passed along a printing apparatus 111, and a gap roller 112 for securing the gap necessary between the sheet 602 and the printing apparatus 111, and then is conveyed to a cutting portion 110.

The cutter in the cutting portion 110 is a rotary intermittent cutter wherein the cutter blade is not provided at a predetermined angular position so as not to interfere the sheet edge. The cutter is rotated to cut the continuous sheet 602, as the continuous sheet 602 is stopped after the leading end of the continuous sheet 602 is pinched and thereby conveyed a predetermined distance past the second registration sensor S5 by the conveyer roller pair 109.

The conveyance of the continuous sheet 602 is controlled according to the control information by a controlling portion 90. As for the controlling information, there is sheet size information, based on which the cutting point for the continuous sheet 602 is determined. With this setup, even when the size of the first sheet changes, the cut second sheet can be pasted at a predetermined location (for example, a location a predetermined distance from the leading edge) of the first sheet.

Also, the size of the image formation area on the continuous sheet 602 is used as the controlling information by the controlling portion 90. Namely, in the case of this information, the cutting point for the continuous sheet 602 is determined by the controlling portion 90 based on the size and location of the image to be printed on the continuous sheet 602.

The controlling information also includes the amount of the remainder of the continuous sheet 602. In this case, the amount of the remainder of the continuous sheet 602 is detected by the cartridge set detection sensor S7 as continuous sheet remainder detecting means, and according to the detected amount of the remainder of the continuous sheet, the size to which the continuous sheet is cut can be reduced, or the image to be printed on the continuous sheet can be changed to a simple mark.

Next, the printing apparatus 111 will be described in detail.

The printing apparatus in this embodiment employs the bubble jet system for which patent applications have been already submitted. Its primary scanning direction is controlled by the controlling portion 90 of the printing apparatus 111; a printing table 115 supported by a shaft 116 is moved in the direction of an arrow mark (FIG. 6) by a printing motor M5 as a driving power source, through driving force transmitting portions 119*a*, 119*b* and 119*c*.

The secondary scanning direction of the printing apparatus 111 is also controlled by the controlling means 90; a sheet feeding roller 113 and the gap roller 112 are rotated by a conveyer motor M4 as a driving power source, through driving power transmitting portions 120*a*, 120*b*, 120*c*, and 120*d*, and a clutch $C1_1$, to control the distance by which the sheet is fed.

The printing apparatus 111 does not need to be the bubble jet type apparatus. It may be a thermal printing apparatus, for which the continuous plain sheet is replaced with a continuous thermal sheet. Also, it may be an impact printing apparatus, for which the continuous plain paper is replaced with a continuous pressure sensitive sheet. Further, it may be a dot matrix printing apparatus which uses the continuous plain sheet. In other words, when used in combination with the above structure, any of the above printing apparatuses can provide the same desirable results as those provided by the printing apparatus in this embodiment, without undesirable side effects; the printing apparatus 111 itself may be of any type.

The printing apparatus 111 is disposed immediately ahead of the cutter portion 110. This is for the following reason: holding the second sheet as steady as possible is requisite for reliable printing, and also, if printing is to be done after the cutting of the sheet, it is difficult to hold the sheet steady because of the short length of the sheet after the cutting, and therefore, in order to hold the second sheet steady after the cutting, the length to which the second sheet is cut must be increased.

Figure 7:
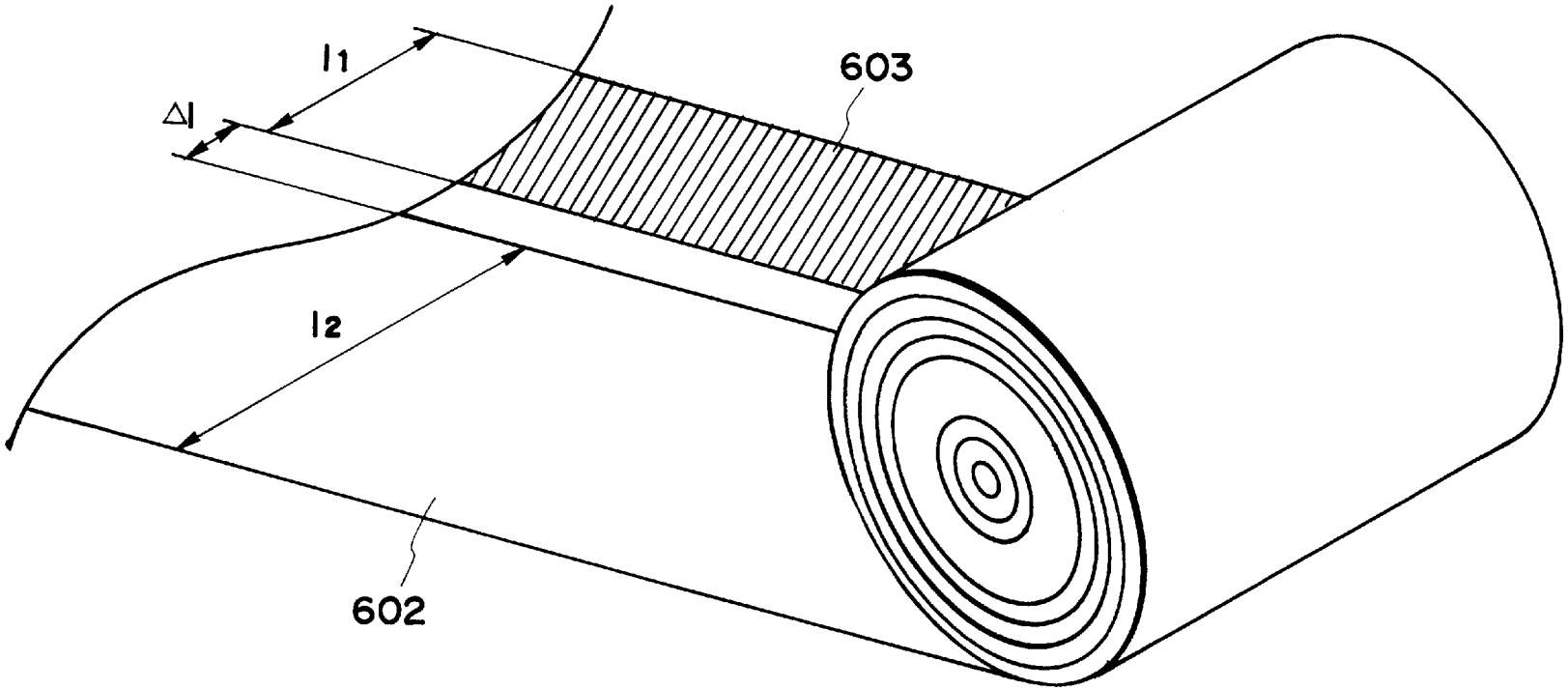
FIG. 7 is a perspective view of a continuous sheet for the sheet processing apparatus in accordance with the present invention.
Figure 8A:
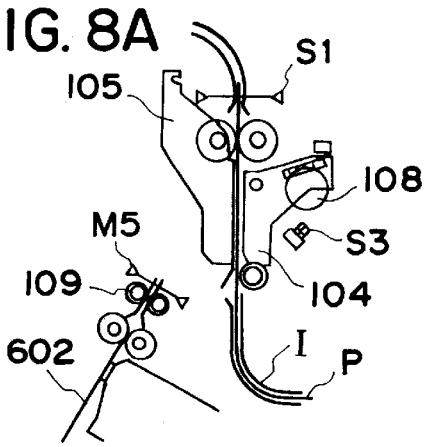
FIGS. 8A–8F illustrate the operational sequence of the pivotal guide of the sheet feeding portion illustrated in FIG. 2.
Figure 8B:
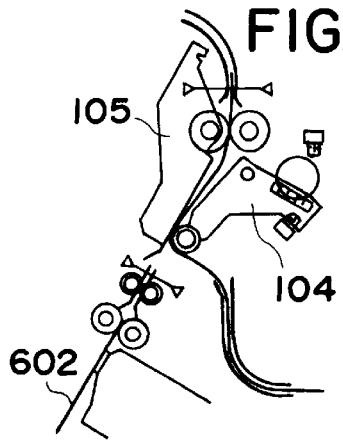
Figure 8C:
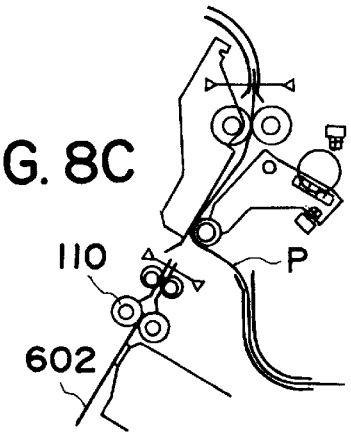
Figure 8D:
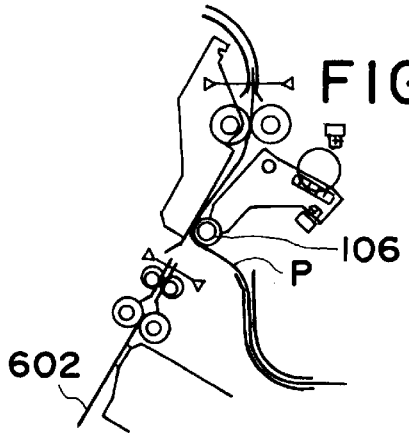
Figure 8E:
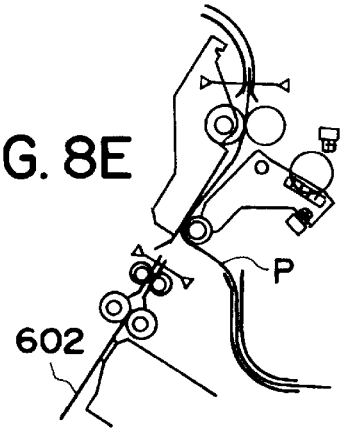
Figure 8F:
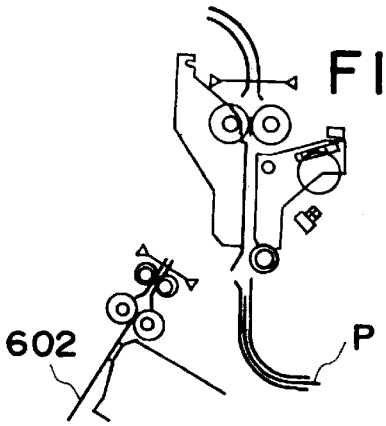

As for the orientation of the printing surface in this embodiment, for the sake of better visibility to the user, printing is done on the right side of the sheet in FIG. 1, so that when the sheet is discharged into the sheet delivery tray, the printed surface faces upward. As for the printing area in this embodiment, control is executed by the controlling means 90 so that printing is done on the area outside the area $(1_1+\Delta_1)$ which is to be covered by the sheet P as illustrated in FIG. 7, that is, on the area $1_2$, since the sheet is pasted on the back side (left surface in FIG. 1) of a transfer material (sheet P) after the cutting (detail will be described later).

Figure 11:
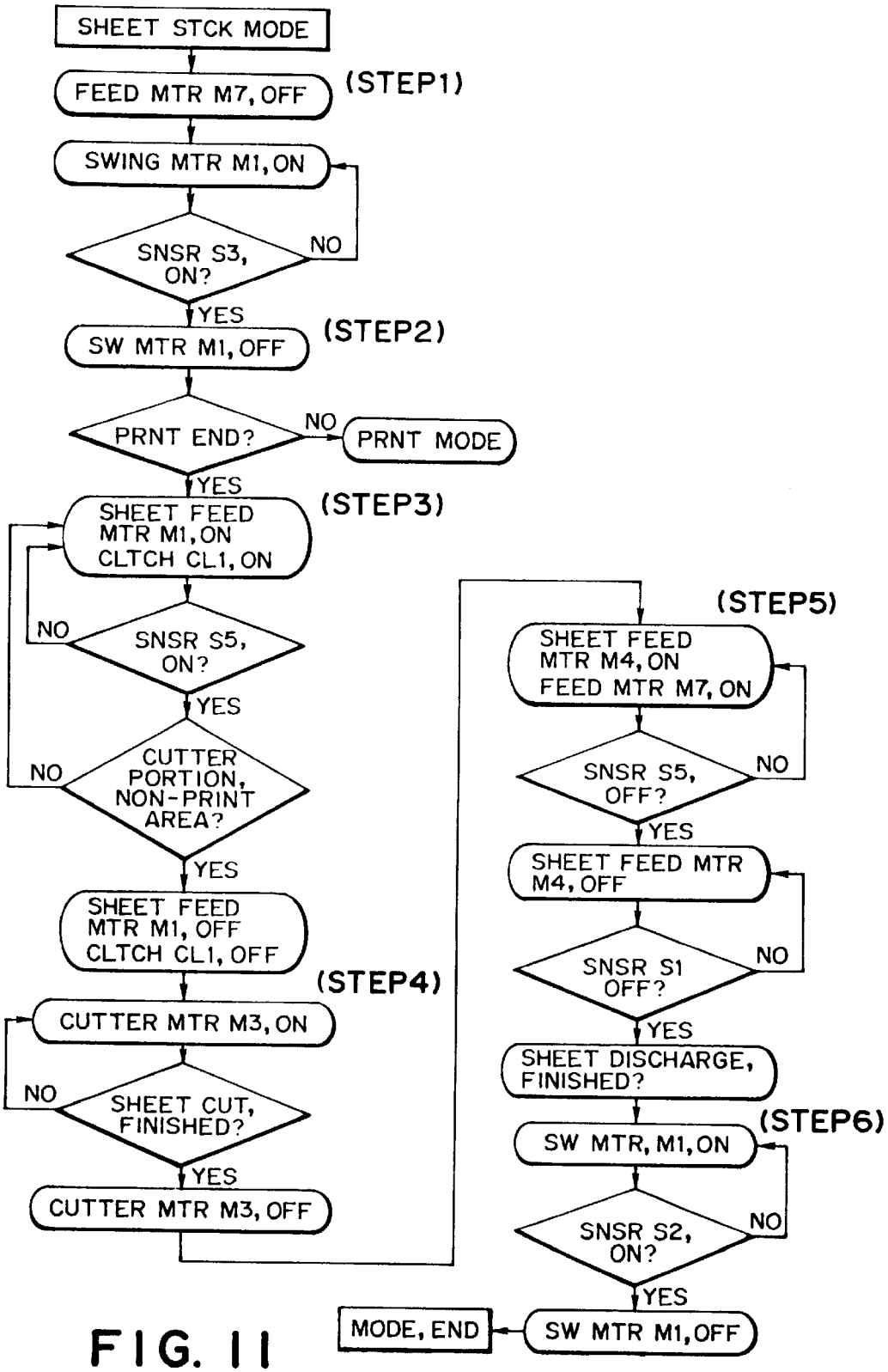
FIG. 11 is a flow chart for the sheet pasting mode for the sheet feeding portion illustrated in FIG. 2.

As for the printing range in the longitudinal direction of the continuous sheet, it can be adjusted to an optional length by controlling the distance by which the continuous sheet is conveyed in the secondary scanning direction; the distance the leading end of the continuous sheet is advanced after the sensor S5 is activated while the continuous sheet is fed for cutting is adjusted by the controlling portion (controlling means) 90 so that the cutting point does not fall within the printing range (step 3 in FIG. 11).

Supplementing the description of the continuous sheet within the cartridge, the inward facing surface of the sheet is coated with an adhesive layer having a width of $1_1$. This adhesive layer is a pressure sensitive adhesive layer which contains adhesive filled capsules, and therefore, it becomes actually sticky only after the capsules are collapsed by pressure application and the adhesive in the capsules oozes out.

Because of the above described nature of the adhesive layer, all the rollers within the continuous sheet conveying portion in this embodiment are structured not to pinch the adhesive layer.

In the case of an image forming apparatus in which the first sheet (transfer sheet) is conveyed, aligning the center line of the first sheet with the center line of the sheet path, the position of the lateral edge of the first sheet in the first sheet feeding portion 103 changes corresponding to the size of the first sheet; therefore, the label sheet feeding portion 101 is structured so that it can be shifted in the direction perpendicular to the sheet conveyance direction. More specifically, a plate 117 fixed to the frame of the second sheet feeding portion and a belt 118*a* is moved by a motor M6 as a driving power source, through driving force transmitting portions 118*a*, 118*b* and 118*c*, whereby the second sheet feeding portion 101 is moved in the direction perpendicular to the first sheet conveyance direction. The plate 117 is used for another purpose; the end surface of the flag portion of the plate 117 is detected by the sensor S8 to determine the referential position, from which the plate 117 is shifted a predetermined distance correspondent to the size of the first sheet in the first sheet conveying portion 103, so that the second sheet feeding portion 101 can accommodate the first sheets of various sizes (FIG. 6).

Next, the details of the sheet processing apparatus in this embodiment will be described.

Referring to FIGS. 2 and 3, disposed on the downstream side of the conveyer roller pair 102 are a conveyance path I formed by stationary guides, and a sensor S4 for detecting the leading end of the first sheet. To the downstream side end of the path I, a conveyance path II formed by pivotal guides 104 and 105 is connected. The pivotal guide 105 is capable of pivoting about an axis 105*a*, and remains pressured in the direction of an arrow mark by a spring 107.

The pivotal guide 104 has a guide hole in which the link pin 108*a* of a link 108 fits. As the link 108 is rotated by a pivotal guide motor M1 as a driving power source, the guide 104 is pivoted about the axis 104*a*.

Sensors S2 and S3 for detecting the positions of the pivotal guides 104 and 105 are strategically disposed so that the guides 104 and 105 can be stopped at appropriate points.

To the pivotal guide 104, a pressing roller 106 is attached, which remains pressed on the pivotal guide 105 to paste the cut second sheet 602, which will be described later, to the sheet P. The pivotal guide 105 is made just as wide as the second sheet so that it does not create load when the sheet P is bent as illustrated in FIG. 2.

The roller pair 102 is provided with a oneway clutch (unillustrated) which allows the roller pair 102 to freewheel in the direction of an arrow mark in FIG. 2 so that it does not create load when the sheet P is pulled. On the downstream side of the path II, a roller pair 103 is disposed, and further downstream, a path III which extends to the discharging roller 121, and a sensor S1, are disposed. The sensor S1 controls the pivoting timing for the pivotal guides 105 and 105. It also controls where on the sheet P the cut second sheet, which will be described later, is pasted. The roller pairs 102, 103 and 121 are driven by an unillustrated conveyer motor M7.

Next, the general operation of the second sheet feeding portion in each operational mode will be described with reference to flow charts.

Figure 9A:
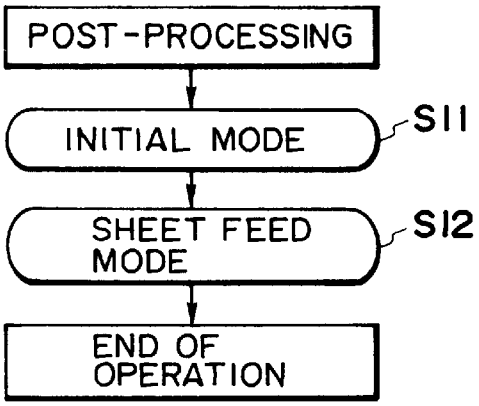
FIG. 9A is a flow chart for a sheet processing operation mode.

First, the basic operational flow will be described. The sheet conveying operation S12 is started after the initialization of each operational portion S11 (FIG. 9A).

Figure 9B:
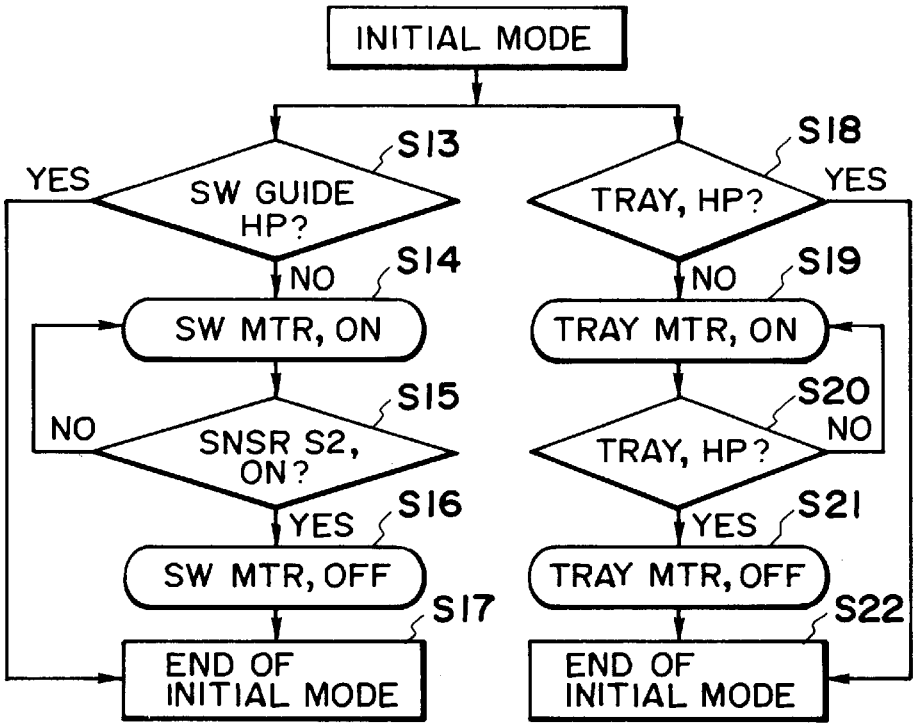
FIG. 9B, a flaw chart for an initializing mode.
Figure 9C:
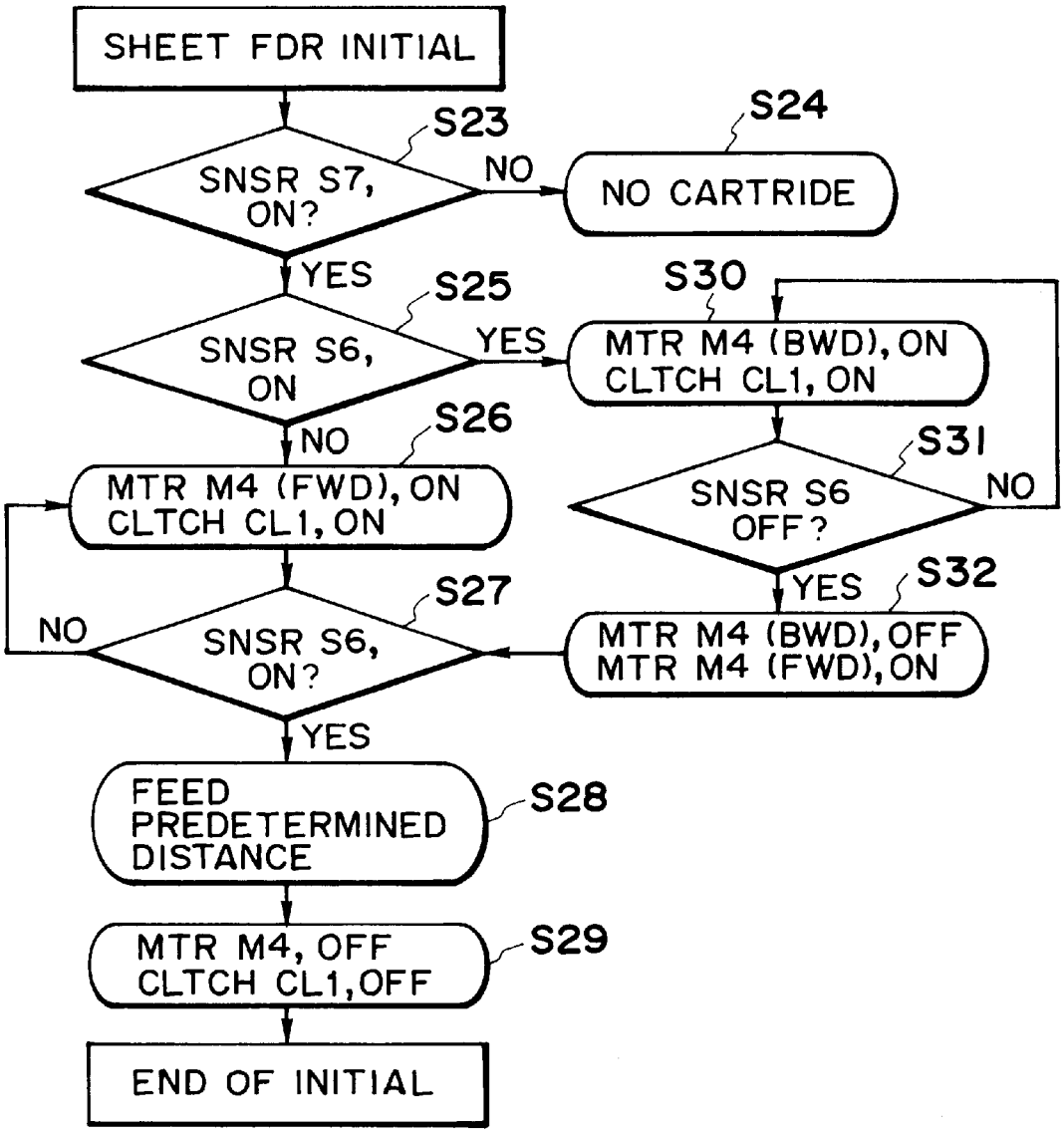
FIG. 9C is a flow chart for the initializing operation for the sheet feeding portion.

The initializing operation in this embodiment involves three portions: the pivotal guide portion, the vertically movable tray portion, and the second sheet feeding portion (FIGS. 9B and 9C).

In the initialization of the pivotal guide portion, the pivotal guides 104 and 105, which are pivotable between their home positions (hereinafter, HP) and opposite positions, are checked for their positions S13, and the motor M1 is checked S14 for its rotation by controlling it in response to the sensors S2 and S3 (S15,S16).

In the initialization of the label sheet feeding portion, the motor M4 is rotated forward and backward in response to the signals from the sensors S6 and S7, and a clutch $C1_1$ is engaged and disengaged, so that the position of the continuous second sheet is properly registered for printing and cutting (FIG. 9C) (S23–S32). The description of the initialization of the vertically movable tray portion (S18–S22) will be not be given at this time.

Figure 10A:
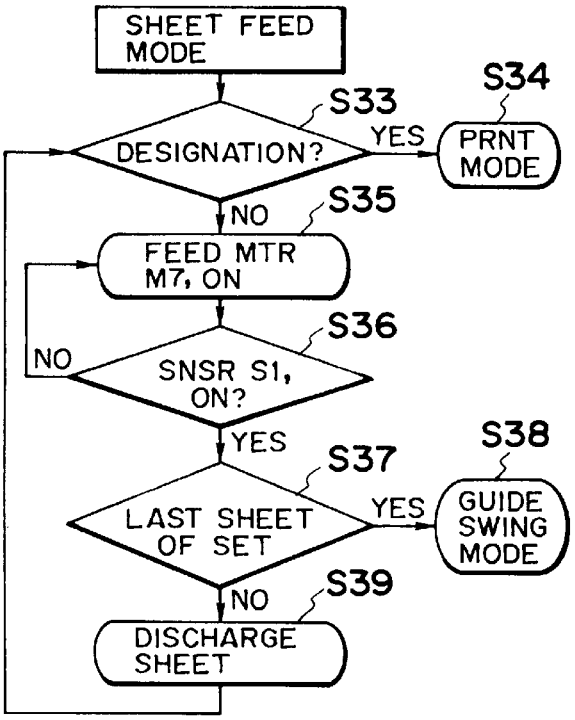
FIG. 10A is a flow chart for a sheet conveying mode.

In the second sheet conveying mode, whether a printing mode is to be executed or not is determined based on the presence or absence of a printing command, and whether a guide pivoting mode is to be executed or not is determined based on whether the sheet P being conveyed is the last sheet of the sheet set being outputted (S33–S39) (FIG. 10A).

Figure 10B:
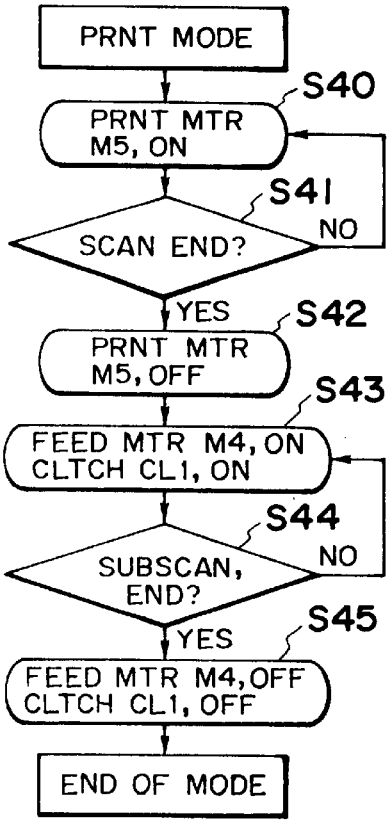
FIG. 10B, a flow chart for a printing mode.
Figure 10C:
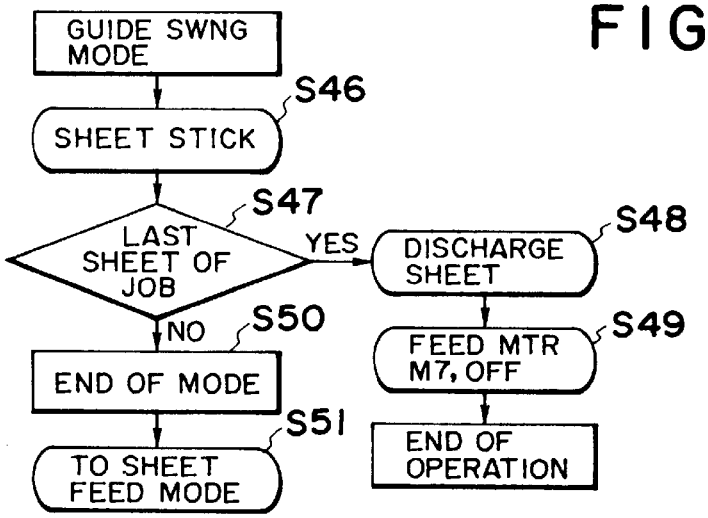
FIG. 10C is a flow chart for the guide pivoting mode.

In a printing mode, scanning in the primary or secondary direction is accomplished by controlling the printing motor, conveyer motor, and clutch (S40–S45) (FIG. 10B). In a guide pivoting mode in which information 20 is printed on the continuous second sheet, a pasting mode is executed, and whether the guide pivoting mode is ended or not is determined based on whether or not the sheet P being conveyed is the last sheet of the sheet set being outputted (S46–S57) (FIG. 10C).

Referring to FIGS. 8A–8F, which show the steps of a pasting mode, after the sheet P arrives at a sensor S1, the motor M7 is further rotated by the controlling portion 90 to convey the sheet P a predetermined distance, and then, the motor M7 is turned off.

Next, the guide pivoting motor M1 is turned on in response to the signal from the sensor S3, to rotate the link 108 so that the pivotal guides 104 and 105 are pivoted (step 2). At the same time, the continuous second sheet is advanced or stopped according to the signal from the sensor S5 and the printing information. Then, the cutter motor is turned on to cut the continuous second sheet, and turned off. Next, the Conveyer motors M7 and M4 are turned on at the same time, so that the cut second sheet is conveyed to a roller pair (nip) 106 (steps 3 and 4), in which the cut second sheet and the sheet P are pinched by the roller pair 106 to paste the cut second sheet to the back side of the sheet P (step 5).

Next, the conveyer motor M4 is turned off in response to the signal from the sensor S5. Then, the guide pivoting motor is turned on to return the pivotal guides to their home positions, and is controlled in response to the signal from the sensor S2 (step 6).

Repetition of the above described operations makes it possible to print the information pertaining to each sheet set on the continuous second sheet, cut it to a predetermined length, and paste the cut second sheet 602 to the sheet P of each sheet set as illustrated in FIG. 12(*a*), so that not only each sheet set is rendered easily separable from the adjacent sets, but also each sheet set is rendered easily identifiable.

At this time, the control of the motor M7 will be further described.

The distance the sheet P is conveyed from when the sensor S1 is activated to when the motor M7 is turned off may be optionally set through the controlling portion 90 (for example, by detecting the revolution of the motor M7, or the like means), so that the position at which the sheet P is stopped for the pasting of the cut second sheet can be varied to change where on the sheet P the cut second sheet 602 is pasted.

Figure 12A:
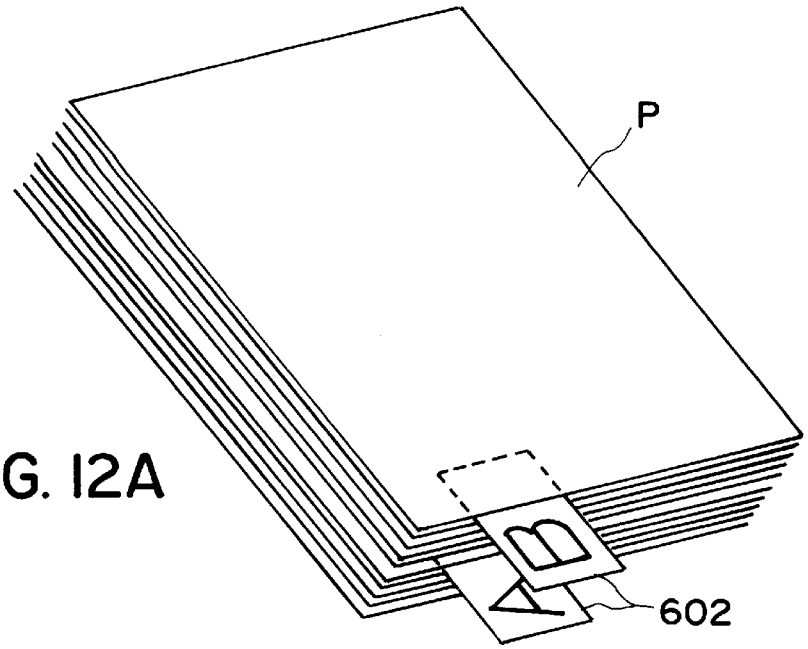
FIGS. 12A–12C are perspective views of the sheets after a cut sheet is pasted to the sheets.

FIG. 12A shows a type of the image printable on the second sheet 602 to show the sheet set content. In this embodiment, the images as shown in FIGS. 12B and 12C can also be printed.

Figure 12B:
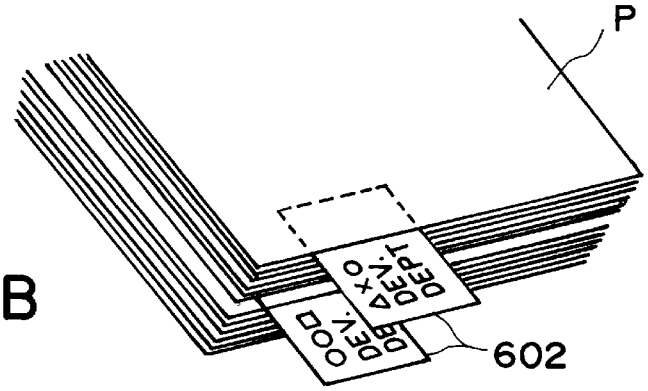
Figure 12C:
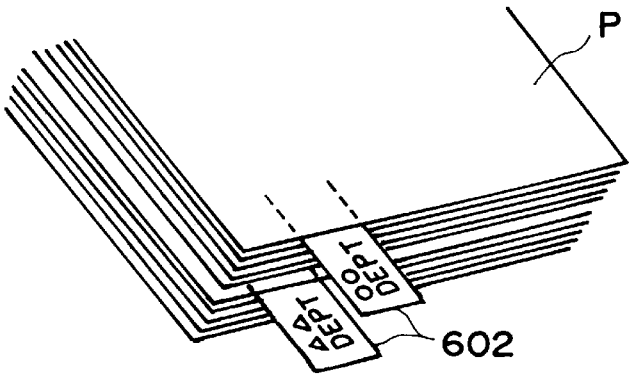

FIG. 12B shows a case in which printing is made in plural lines, and FIG. 12C shows a case in which the length to which the second sheet is cut is reduced because the image to be printed is small.

In the above described embodiment, a case in which the cut second sheet 602 is pasted to the sheet P of a first sheet set constituted of only a single first sheet, that is, the sheet P, is described. However, the present invention is also effective to paste the cut second sheet 602 to the bottommost sheet of each first sheet set constituted of a plurality of first sheets. The present invention is also applicable to a case in which bound first sheet sets are conveyed and discharged.

Figure 18B:
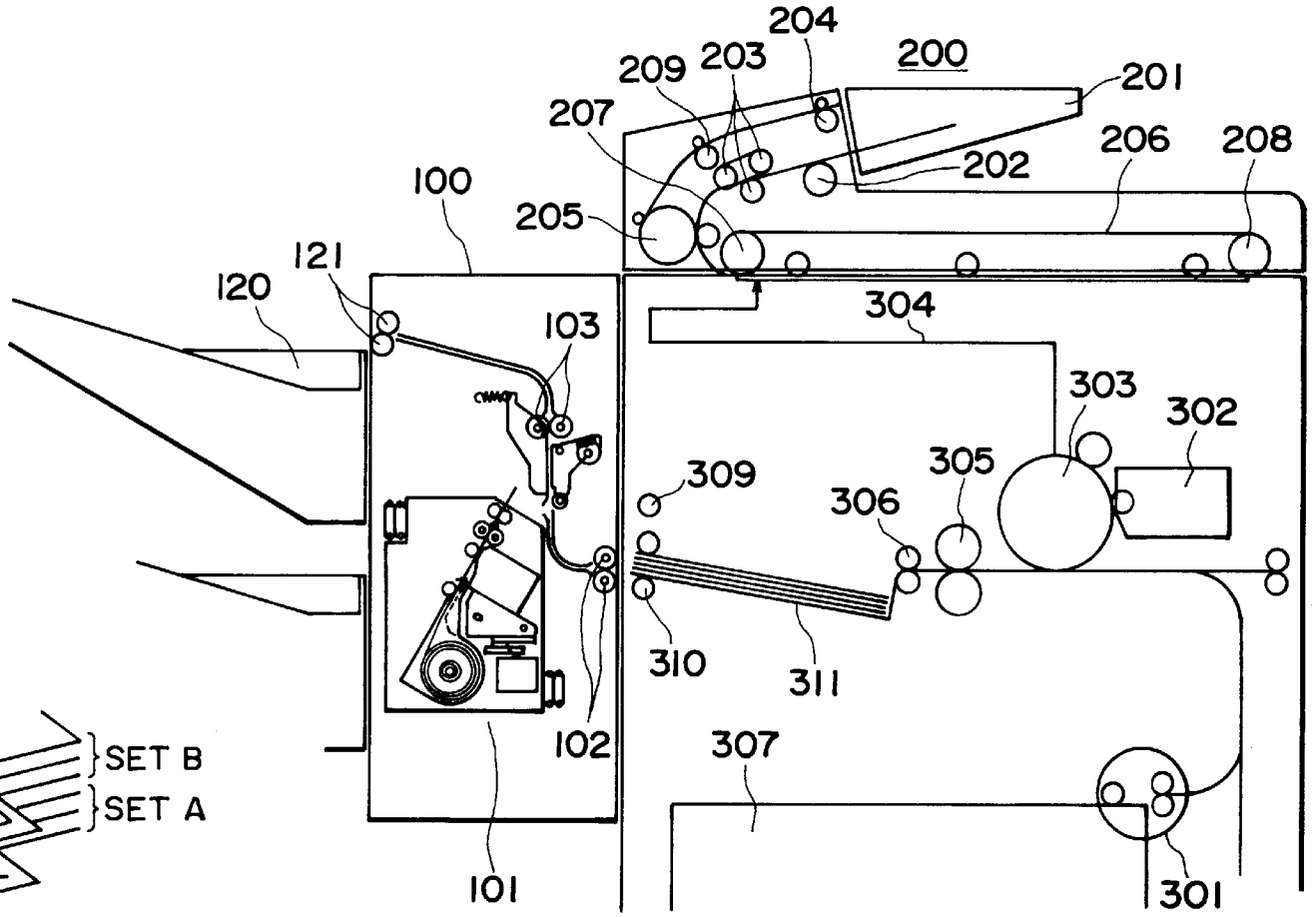
FIGS. 18A and 18B are a vertical sections of the front portion of an image forming apparatus provided with an intermediary tray portion.
Figure 18A:
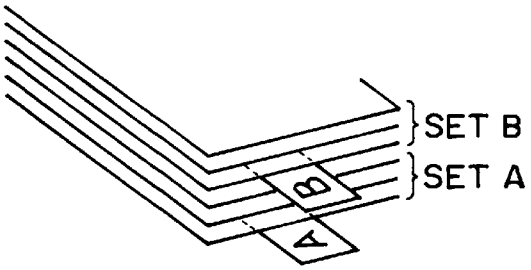

Referring to FIG. 18A the sheets discharged by a conveyer roller pair 306 are temporarily accumulated in an intermediary tray 311 until the last sheet of each sheet set is discharged, and the accumulated sheets, that is, a full set of sheets is conveyed to the roller pair 102 by a pair of rollers 309 and 310. Thereafter, a second sheet pasting operation similar to the one described above is carried out. This operation can produce the result illustrated in FIG. 18B in which the cut second sheet is pasted to the bottommost sheet of each sheet set.

Embodiment 2

Figure 13:
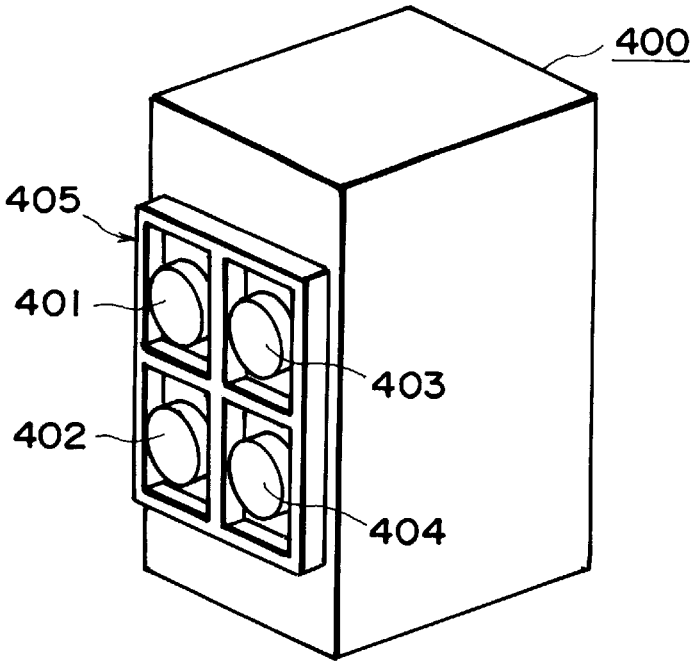
FIG. 13 is a perspective view of a stamping apparatus as an image forming portion.

In the first embodiment described above, a bubble jet system was employed as the portion for printing an image on the second sheet, whereas in this embodiment, an image forming portion as shown in FIG. 13, which is simpler than the one described in the first embodiment, is employed.

More specifically, the image forming portion is constituted of a stamping apparatus 400 comprising a stamping head 405 having stamping portions 401–404. Each of the stamping portions 401–404 can be independently controlled by an unillustrated solenoid or the like, making it possible to express information using four bits; stamping can be done in 16 different patterns.

Figure 14A:
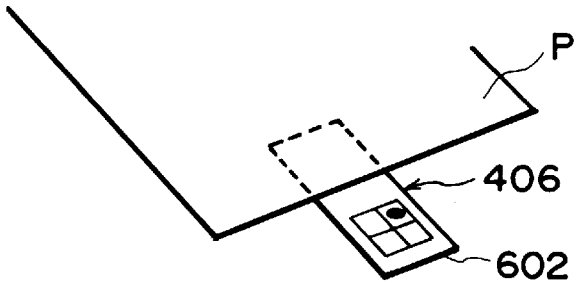
FIGS. 14A and 14B are perspective views of the cut second sheet stamped by the stamping apparatus, and the first sheet.
Figure 14B:
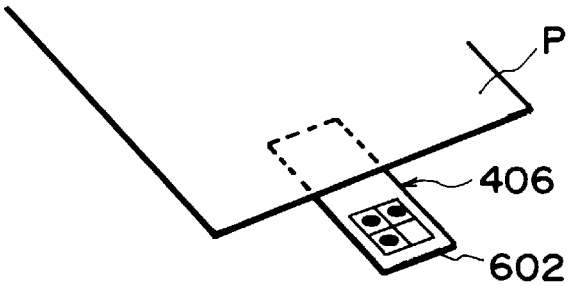

For example, a user A may be designated by a pattern illustrated in FIG. 14A; a user B, by a pattern illustrated in FIG. 14B; and so on, so that a sheet set belonging to one user can be easily separated from those belonging to the other users.

Figure 15:
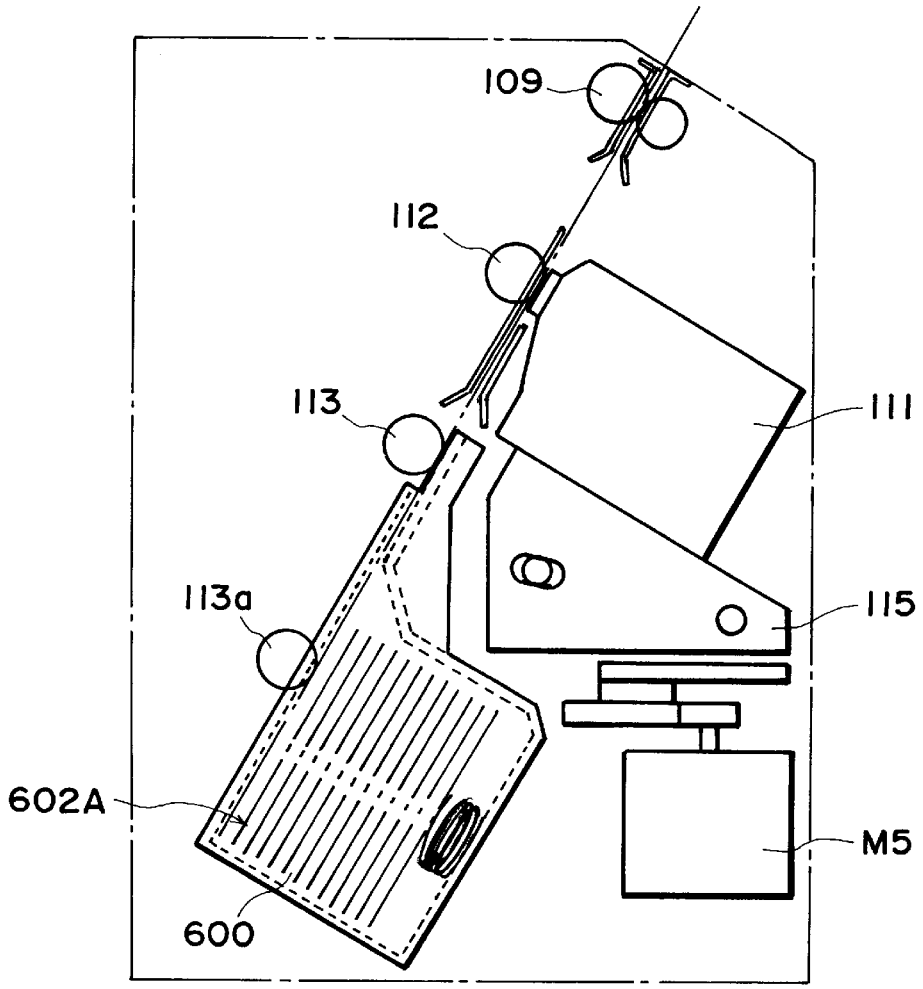
FIG. 15 is a side view of the second sheet feeding portion (second sheet conveying portion) provided with a cut sheet storing portion.
Figure 16:
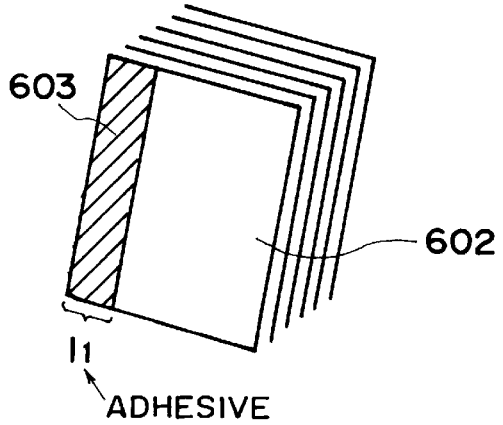
FIG. 16 is a perspective view of an example of a cut sheet.

In this embodiment, a continuous sheet is employed as the second sheet. However, the continuous sheet may be replaced with cut sheets. When a cut sheet is used as the second sheet, the second sheet feeding structure is replaced with a structure comprising a storing portion 600 for cut sheets 602A and a conveying portion 109 for the cut sheets, as shown in FIG. 15. Such an arrangement can provide the same effects as those described in this embodiment. FIG. 16 shows the details of a cut sheet, in which $1_1$ designates an adhesive coated area.

As for the type of sheet usable as the second sheet, obviously, any thin sheet, for example, plain paper or PET film, may be employed.

Embodiment 3

In the preceding embodiments, printing was done on the continuous second sheet 602 before the continuous second sheet 602 was cut to be pasted to the first sheet P. However, printing may be done on the cut second sheet after the cut second sheet is pasted. This will produce the same results.

Figure 17:
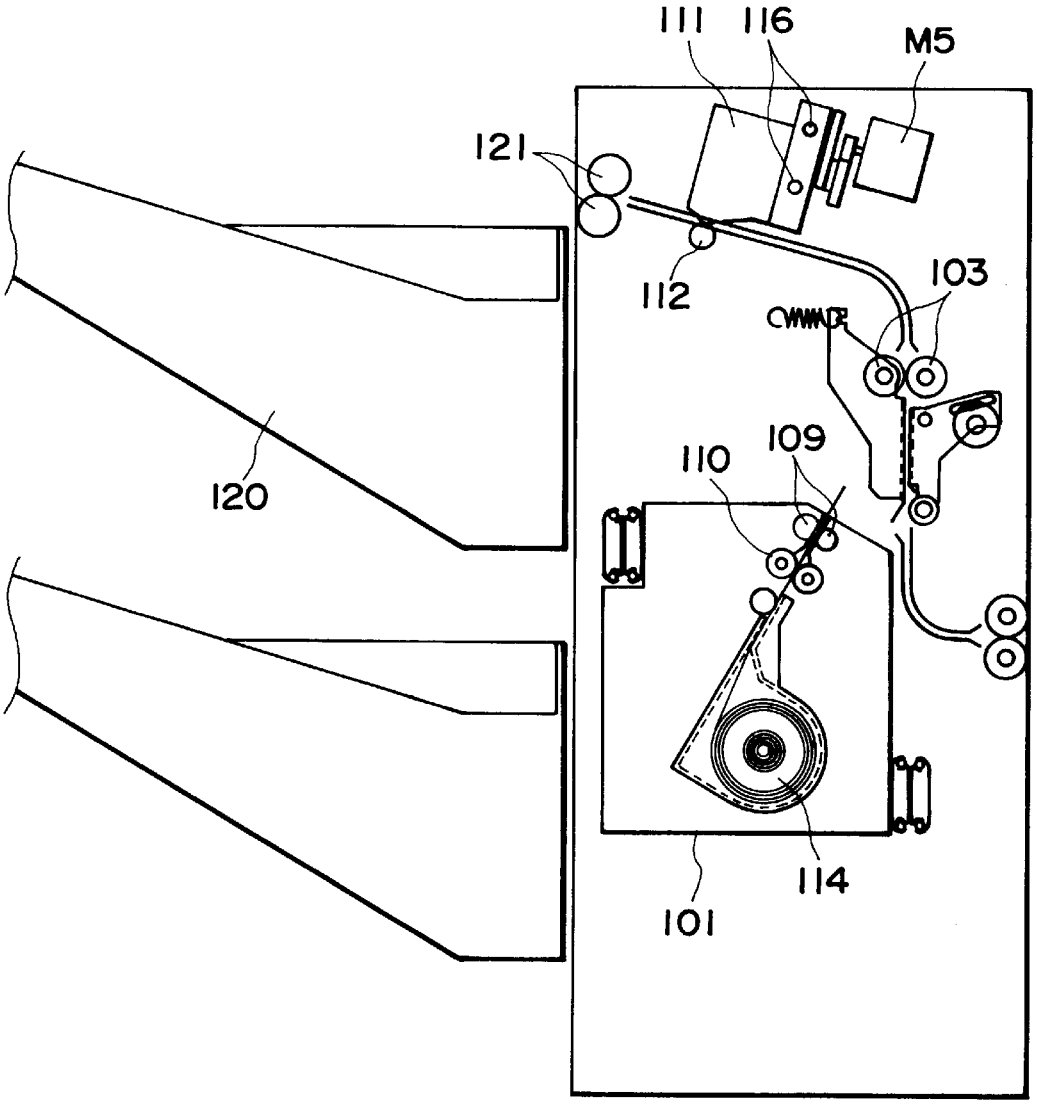
FIG. 17 is a vertical section of the front portion of the sheet processing apparatus after the positioning of a printing apparatus as an image forming portion is modified.

Referring to FIG. 17, a continuous second sheet feeding portion 101 comprises a cartridge 114, a cutter 110, and a conveyer roller pair 109. Further, between a discharge roller pair 121 and a conveyer roller pair 103, a printing portion 111 is disposed.

The continuous second sheet is cut and pasted to the first sheet P, in the same manner as in the first embodiment, and then, is conveyed further by the conveyer roller pair 103. In this case, it is obvious that printing can be done on the cut and pasted second sheet, in the following manner: the conveyer motor M7 (unillustrated) is controlled to convey the sheet P, to which the cut second sheet has been pasted, in the secondary scanning direction, and the printing motor M5 is controlled to move the printing apparatus 111 in the main scanning direction.

Embodiment 4

In this embodiment, it is made possible to change the distance the leading end of the continuous second sheet is advanced before the cutting of the continuous second sheet, so that the length of the second sheet after cutting can be optionally set in response to the signal from the sensor S7 (FIG. 2) which detects the presence or absence of the continuous second sheet. More specifically, when the signal from the sensor S7 indicates the presence of the continuous second sheet, the continuous second sheet is cut in the same manner as described in the preceding embodiment, whereas when the signal indicates no sign of the continuous second sheet, the remainder of the continuous second sheet is cut to the minimum length to continue to mark as many sheet set boundaries as possible, or the remainder of the continuous second sheet is conveyed without cutting, leaving no continuous second sheet in the second sheet feeding portion.

In the preceding embodiments, each second sheet was cut from a continuous second sheet roll, and then pasted to the back side of the first sleet P being discharged. Next, the reason for such an arrangement will be given.

Figure 19:
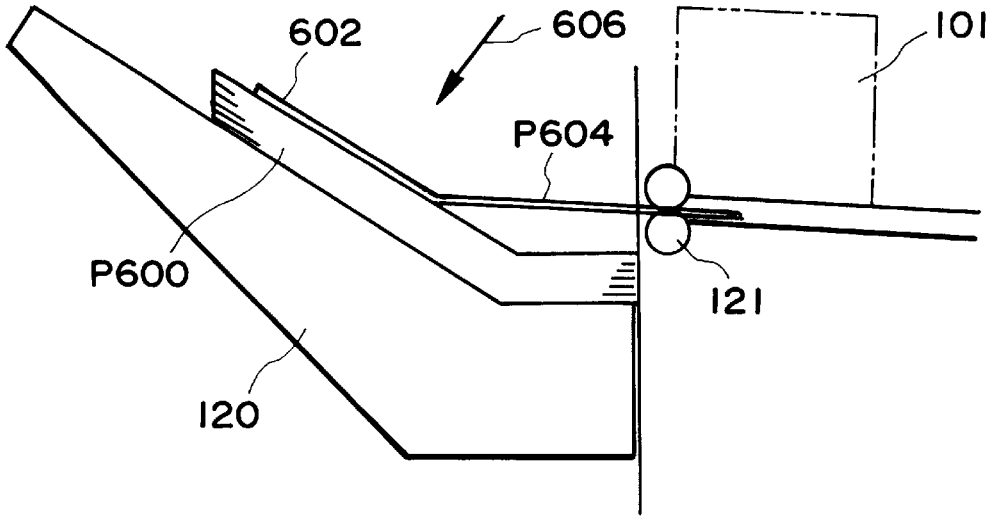
FIG. 19 is a side view of a sheet delivery tray, and the first sheets accumulated in the tray, depicting the wrong pasting location for the second sheet.
Figure 20:
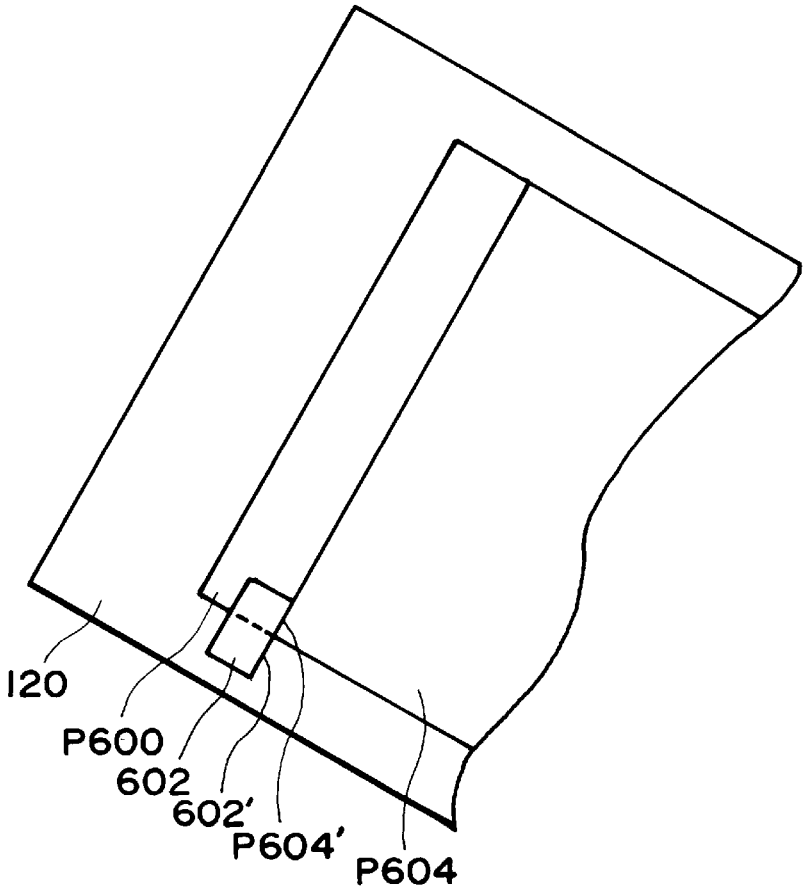
FIG. 20 is a view of the tray portion and the first sheet with the pasted second sheet, illustrated in FIG. 19, as seen from the direction of an arrow mark 606 in FIG. 19.

FIG. 19 shows the state of the sheets P accumulated in a sheet delivery tray, and FIG. 20 is a view of the same sheets P and the same tray, as seen from the direction of an arrow mark 606.

Figure 21:
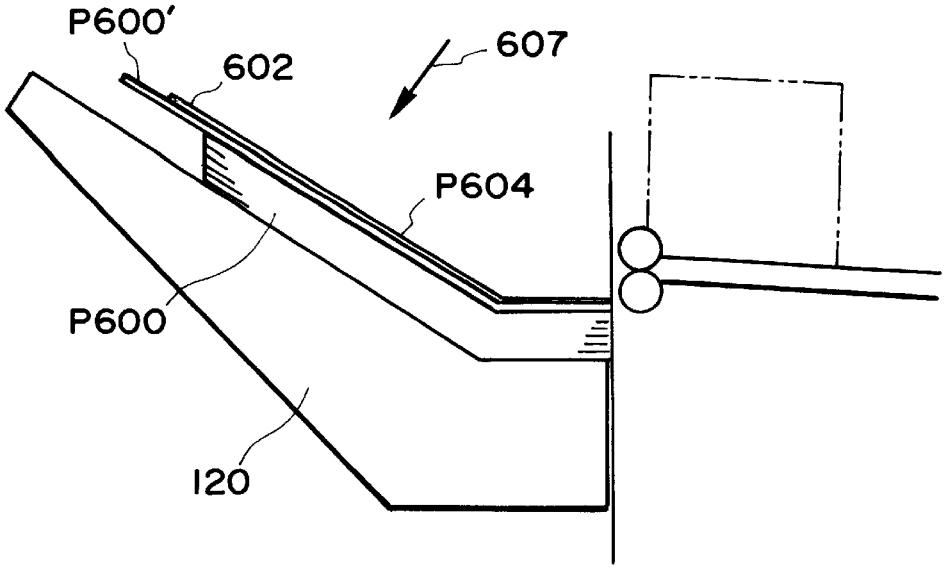
FIG. 21 is a side view of the tray portion and the first sheets illustrated in FIG. 19, depicting a sheet accumulation failure.
Figure 22:
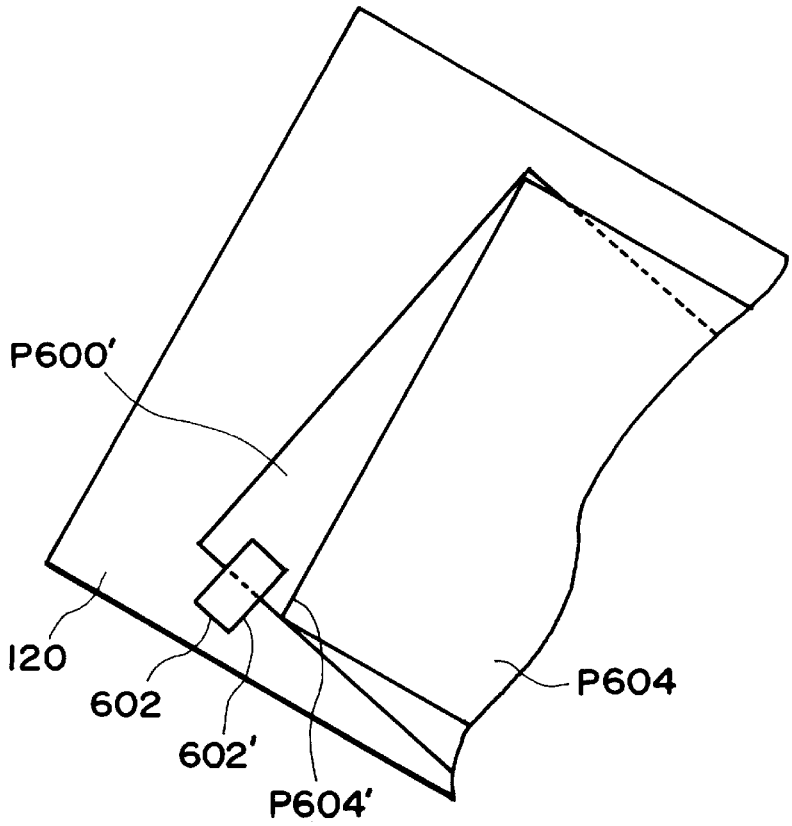
FIG. 22 is a view of the tray portion and the first sheets illustrated in FIG. 21, as seen from the direction of an arrow mark 607.

Referring to FIGS. 19 and 22, if the cut second sheet 602 is pasted to the top surface of the sheet P, near the leading end relative to the sheet conveyance direction, the leading end P604' of the following sheet P604 collides with the edge 602' of the cut second sheet 602 pasted to the preceding sheet set or sheet P600 on the tray 120, and as the sheet P604 is discharged further by the conveying means 121, the sheet 600', which is the topmost sheet of the preceding sheet set P600, and to which the cut second sheet 602 has been pasted, is pushed out as illustrated in FIGS. 21 and 22 (FIG. 22 is a view of the tray and the sheets P illustrated in FIG. 21, as seen from the direction of an arrow mark 607 in FIG. 21), which is troublesome.

Figure 23A:
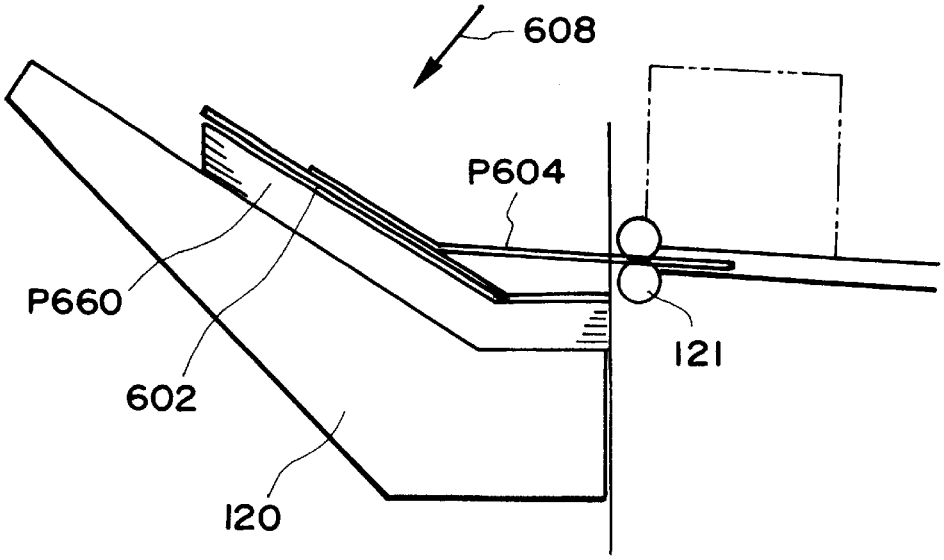
FIG. 23A is a side view of the tray portion in the first embodiment of the present invention, depicting the state of the sheet accumulation in the tray portion.
Figure 23B:
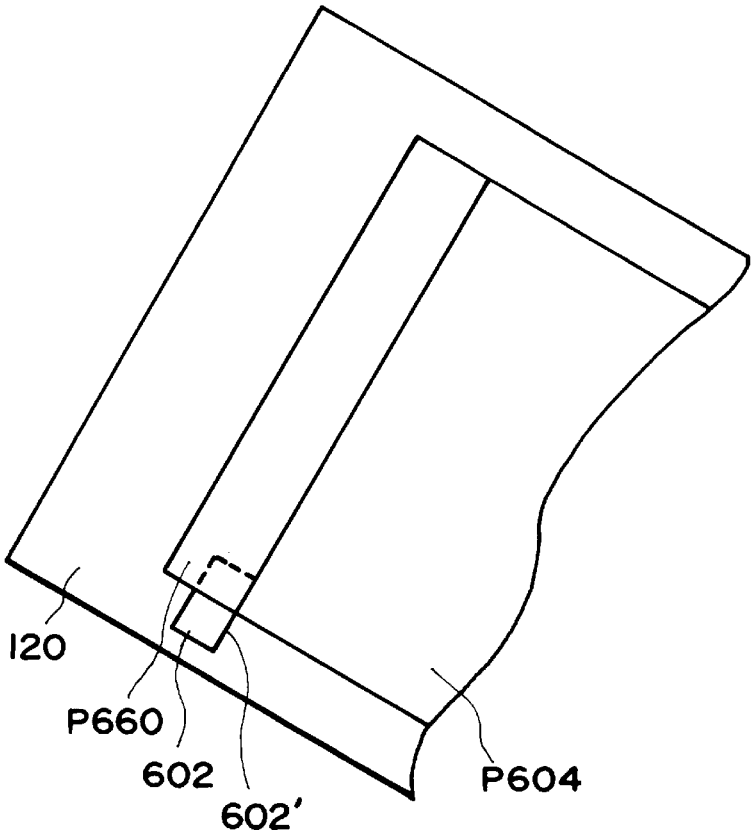
FIG. 23B is a top view.
Figure 24:
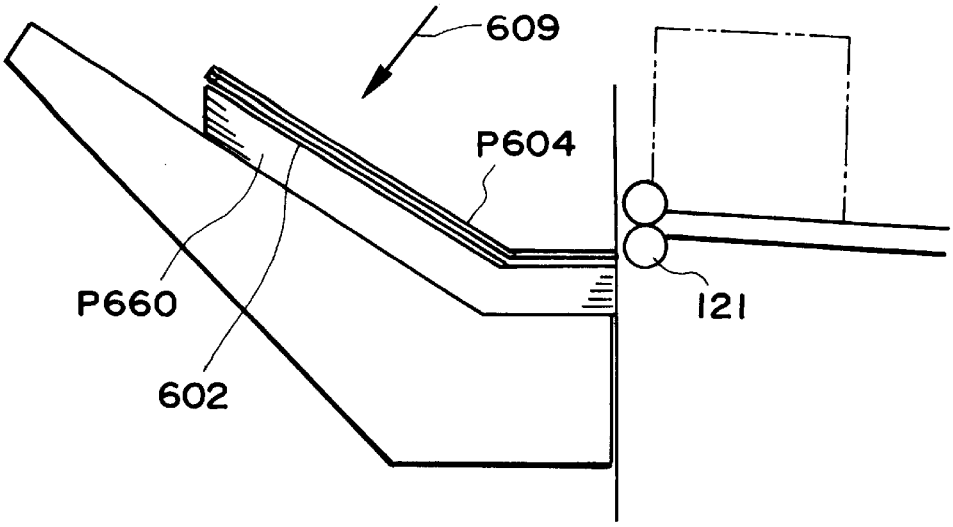
FIG. 24 is a side view of the tray portion illustrated in FIG. 23, depicting one of the operational stages of the sheet accumulating operation.
Figure 25:
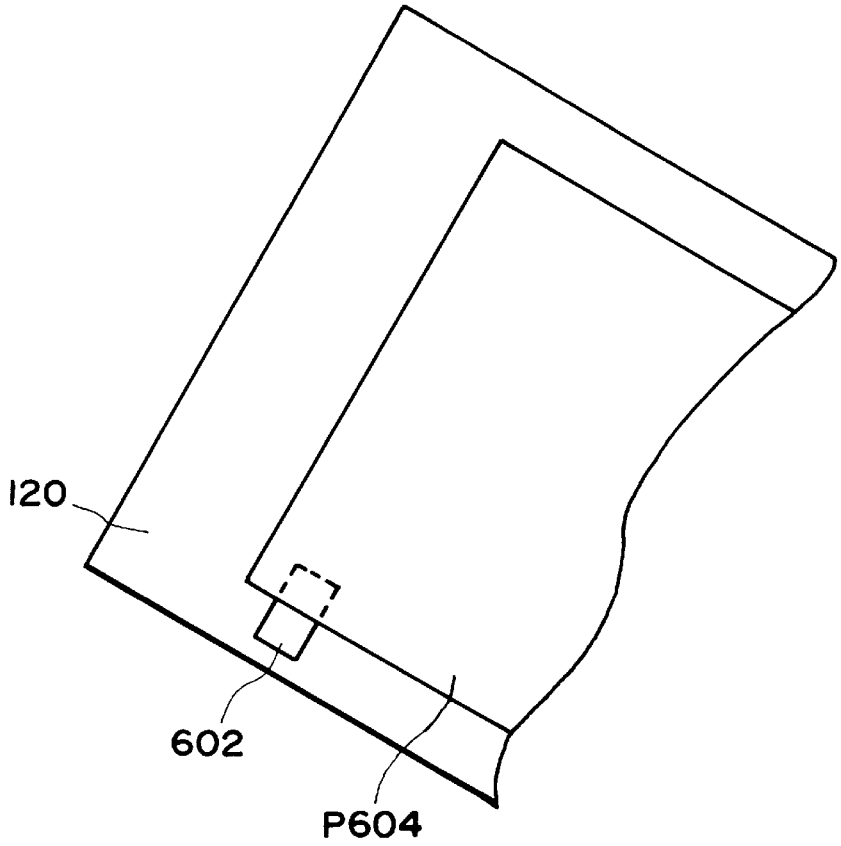
FIG. 25 is a view of the tray portion illustrated in FIG. 24, as seen from the direction of an arrow mark 609.

On the contrary, if the cut second sheet is pasted to the bottom surface of the sheet P as shown in FIGS. 23A, 23B, 24 and 25, the leading end of the following sheet P will not be caught by the cut second sheet 602, and therefore, the sheets P remain undisturbed in the tray 120 (FIGS. 23B and 25 are the views of the sheets P and trays in FIGS. 23A and 24 as seen from the directions of arrow marks 608 and 609, respectively).

Figure 26A:
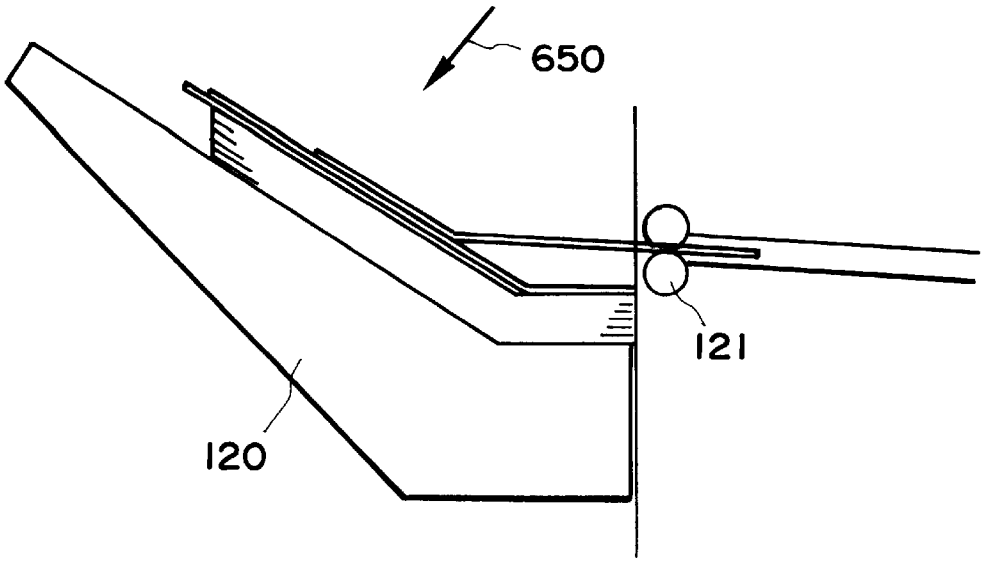
FIG. 26A is a side view of the tray portion in the second embodiment of the present invention, depicting the state of the sheet accumulation in the tray portion.
Figure 26B:
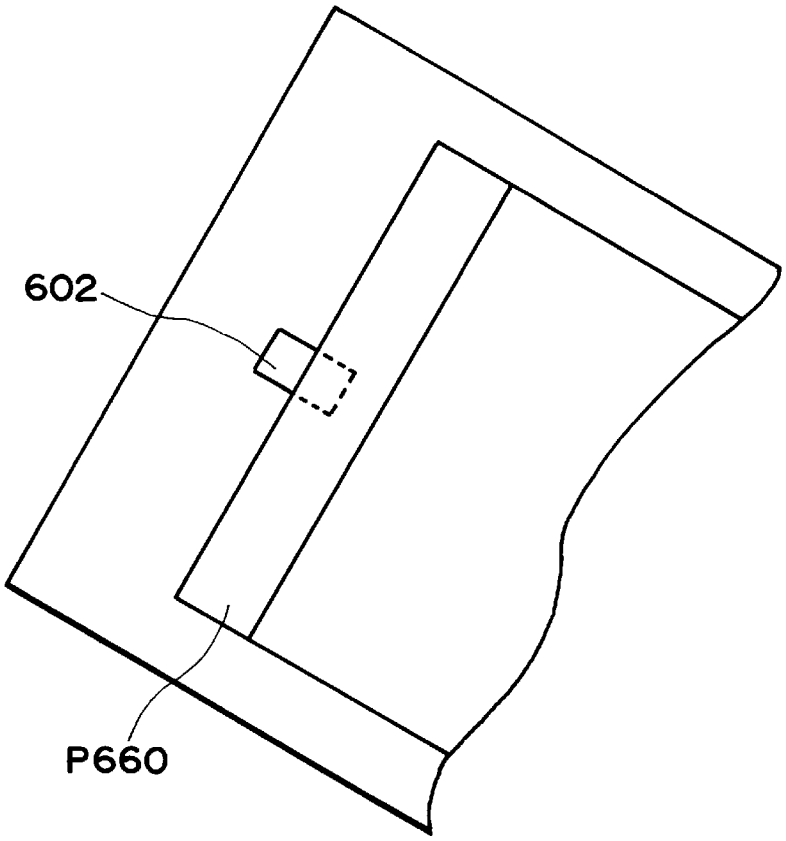
FIG. 26B is a top view.

In the preceding embodiments, the cut second sheet 602 was pasted to the sheet P, at the edge parallel to the direction in which the sheet P is discharged into the tray 120. However, the cut second sheet 602 may be pasted to the sheet P, at the edge perpendicular to the sheet conveyance direction as shown in FIGS. 26A and 26B. It is needless to say that such an arrangement can produce the same effects as those described in the preceding embodiments.

In the preceding embodiments, the descriptions were given as to the case in which the cut second sheet was pasted to the sheet P, on the surface which becomes the top surface when the sheet P is discharged into the tray 120, to prevent the leading end of the following sheet P from being caught by the cut second sheet pasted on the preceding sheet P in the tray 120. However, the provision of the following structure makes it possible to keep undisturbed the first sheets in the tray 120, even if the cut second sheet is pasted to the sheet P, on the surface which becomes the top surface when the sheet P is discharged into the tray 120. Next, such a structure will be described.

Figure 27:
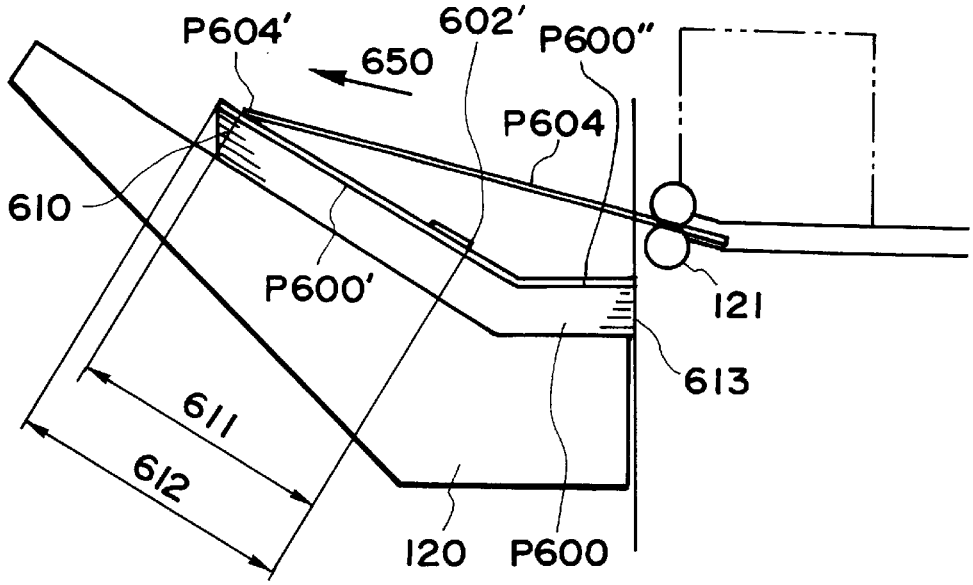
FIG. 27 is a side view of the tray portion in accordance with the present invention, depicting the positional relation between the leading end of the first sheet and the edges of the second sheet.
Figure 28:
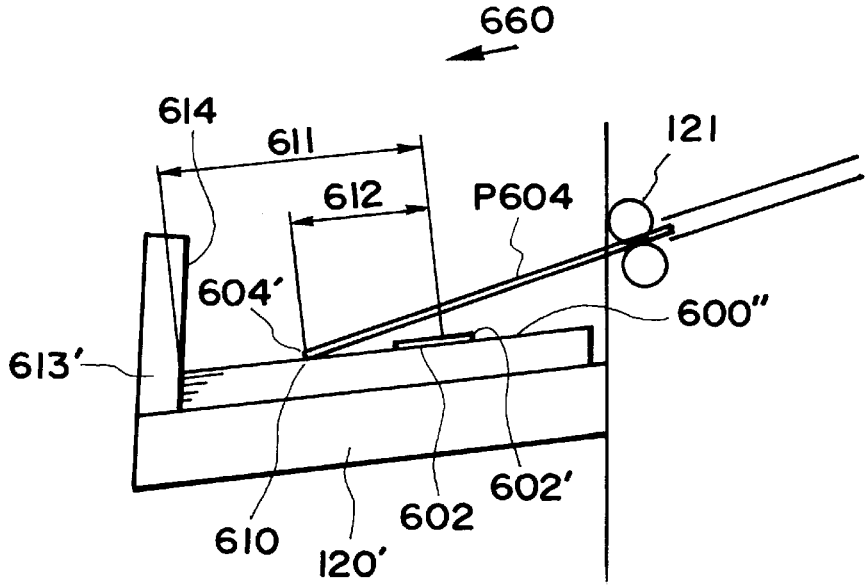
FIG. 28 is a side view of the tray portion in the third embodiment of the present invention.

Referring back to FIGS. 19 and 22, if a cut second sheet is pasted on the upstream side of the top surface of an output sheet P, the leading end of an output sheet P which is discharged next is caught by the cut second sheet pasted on the preceding output sheet P. Referring to FIG. 27, in order to eliminate this problem, the edge 602' of the cut second sheet 602 on the preceding sheet P has only to be on the upstream side of a point 610 at which the leading end P604' of the following sheet P604 being discharged in the direction of an arrow mark 650 makes initial contact with the top surface 600' of the preceding output sheet set (or sheet).

As described above, the position at which the cut second sheet is pasted on the sheet P can be easily changed by controlling where the sheet P is stopped. Therefore, in order to eliminate the above described problem, a distance 612, which is the distance between the leading edge of the sheet P600' and the edge 602' of the cut second sheet 602, has only to be set as illustrated in FIG. 27.

Heretofore, the descriptions were given as to an apparatus of a type in which as the output sheets are discharged into the sheet delivery tray 120, they move diagonally downward in the upstream direction due to their own weight, on the tray surface or the preceding output sheet in the tray. However, the sheet delivery tray 120 may be replaced with a sheet delivery tray 120' which is substantially horizontally disposed, or is tilted in the downstream direction, and has a sheet stopper 613' on the downstream side. In this case, the discharged output sheets are accumulated in the tray 120' with their leading ends being in contact with the surface 614 of the stopper 613'. Also in this case, as long as the point 612 on an output sheet, onto which the cut second sheet 602 has been pasted, is set up as it was described in the preceding embodiment in which the point 612 is on the upstream side (distance 611 is larger than zero) of the point 610 on the top surface of the preceding output sheet, at which the leading end P604' of the following output sheet P604 makes initial contact with the top surface of the preceding output sheet set (or sheet). It is needless to say that this setup also produces the same effects as those described in the preceding embodiments.

Figure 29:
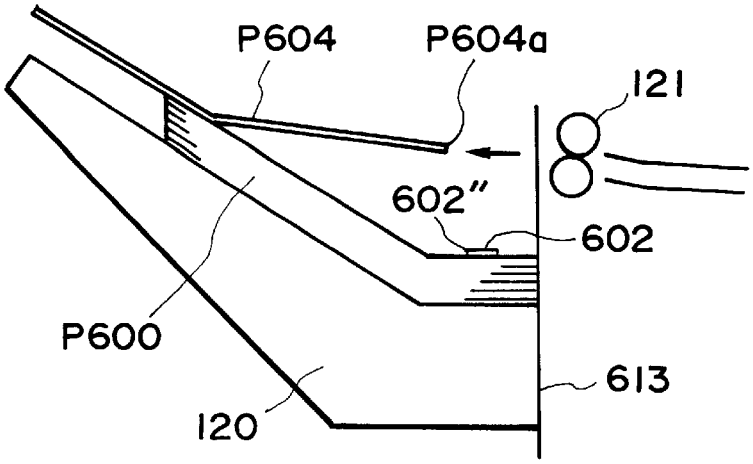
FIG. 29 is a side view of a tray portion, depicting a sheet accumulation failure.
Figure 31:
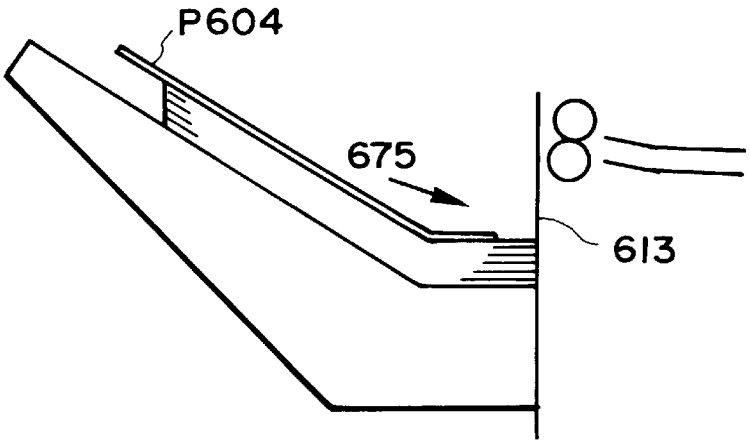
FIG. 31 is a side view of the tray portion illustrated in FIG. 29, depicting one of the operational stages of the sheet accumulating operation.

Referring back to FIG. 25, in the case of an apparatus of the type in which after being discharged into the sheet delivery tray 120, the output sheets switch their moving directions, that is, move diagonally downward in the upstream direction, due to their own weight, and accumulated in contact with the sheet stopper 613, if the cut second sheet 602 is pasted to the top surface of the output sheet, adjacent to the trailing end, the following problem occurs, which will be described with reference to FIGS. 29 and 31.

Figure 30:
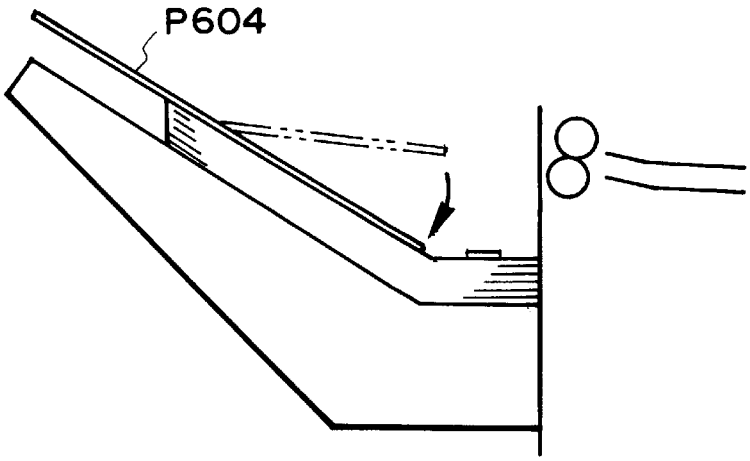
FIG. 30 is a side view of the tray portion illustrated in FIG. 29, depicting one of the operational stages of the sheet accumulating operation.

After the pasting of a cut second sheet 602, the first output sheet set or output sheet P600, is deposited into the tray 120 without any problem, whereas the second output sheet P604 creates a problem. That is, as the second output sheet P604 is discharged by the conveying means 121 as shown in FIG. 29, the trailing end of the second output sheet P604 lands on the already accumulated first output sheet P600 (FIG. 30), on the top surface of which a cut second sheet 602 has been pasted. Then, as it moves due to its own weight in the direction of an arrow mark 675 in FIG. 31, that is, in the direction to come in contact with the sheet stopper 613, it collides with the edge 602' of the cut second sheet 602, being prevented from becoming aligned with the rest of the output sheets in the tray 120, as shown in FIG. 31.

Figure 33:
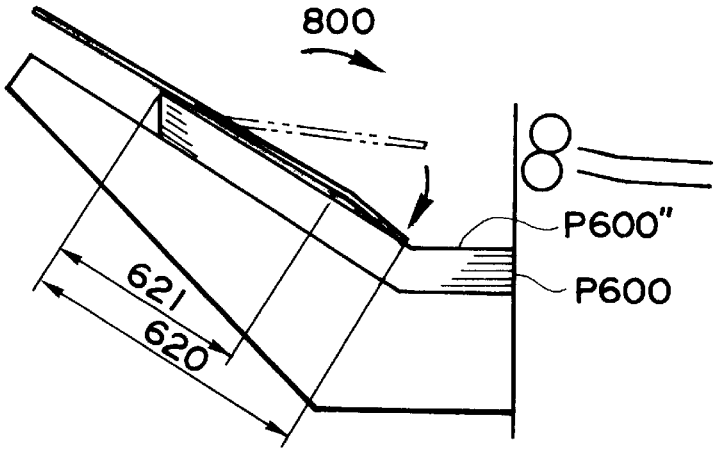
FIG. 33 is a side view of the tray portion in the fourth embodiment of the present invention, depicting one of the operational stages of the sheet accumulation in the tray portion.

In order to eliminate the above described problem, the cut second sheet 602 has only to be pasted so that the distance 621 between the edge 602" of the cut second sheet 602 on the already accumulated preceding output sheet P600, and the leading edge of the sate output sheet P600, becomes less than the distance 620 between where the trailing end P604 of the following output sheet lands on the top surface 600" of the already accumulated preceding output sheet set (or sheet) P600, and the leading edge of the already accumulated preceding output sheet set (or sheet) P600, as shown in FIG. 33.

Figure 34:
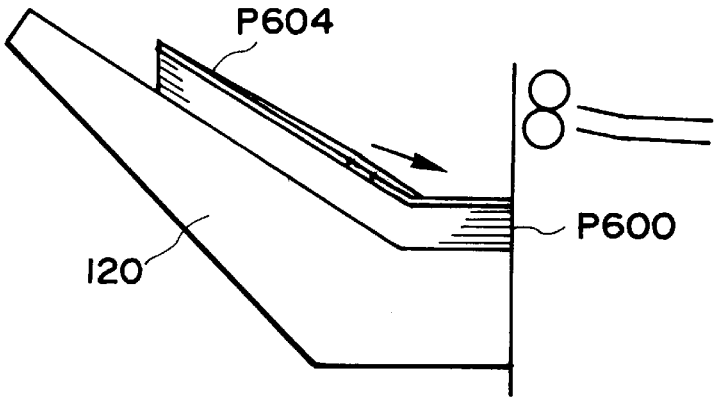
FIG. 34 is a side view of the tray portion in the fourth embodiment of the present invention, depicting one of the operational stages of the sheet accumulation in the tray portion.

When the cut second sheet 602 is pasted to the preceding output sheet P600 as described above, the following output sheet P604 can be accumulated on the preceding output sheet P600, in desirable alignment with the preceding output sheet P600 as shown in FIG. 34.

Figure 32:
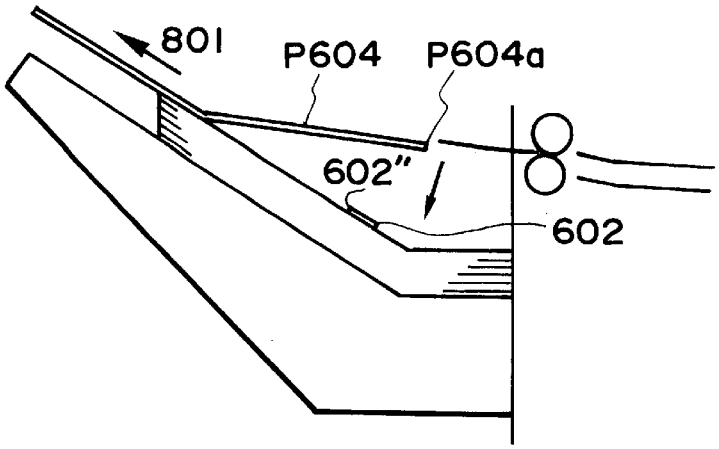
FIG. 32 is a side view of the tray portion in the fourth embodiment of the present invention, depicting the state of the sheet accumulation in the tray portion.

The pasting of a cut second sheet 602 in the above described manner can produce the same effects even in the case of a delivery tray 120 which has a stopper on the downstream side relative to the sheet conveyance direction. In the case of such a delivery tray 120, as an output sheet P604 is discharged, it is prevented from moving in the direction of an arrow mark 801 in FIG. 32 since its leading edge P604*a* comes in contact with the stopper, and then, after its trailing edge P604 lands on the preceding output sheet, it moves in the direction of an arrow mark 800.

Figure 38:
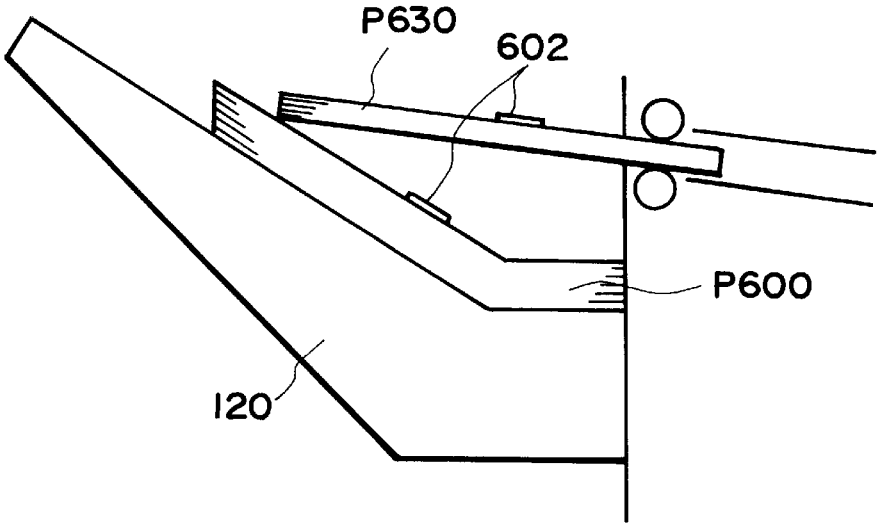
FIG. 38 is a side view of the tray portion in the fifth embodiment of the present invention, depicting the state of the sheet accumulation in the tray portion.

Hereinbefore, a method for preventing an output sheet from being caught by a cut second sheet pasted to the immediately preceding output sheet was described with reference to a case in which output sheets were discharged one at a time into a sheet delivery tray. Needless to say, the above method is also applicable to a case in which a predetermined number of output sheets are put together as a sheet set P630 and then are discharged together as illustrated in FIG. 38.

As for the pasting of a cut second sheet 602 to the sheet set P630 described above, the cut second sheet 602 may be pasted to the sheet set P630 while the sheet set P630 is conveyed, or may be pasted before the output sheet, to which the cut second sheet 602 is to be pasted, is put together with the rest of the output sheets which belong to the sheet set P630. In the latter case, the output sheet to which the cut second sheet 602 has been pasted is temporarily accumulated, together with the other output sheets of the sheet set P630, in an intermediary tray other than a sheet delivery tray 120, and then, is discharged into the sheet delivery tray 120, as a part of the sheet set P630.

Also, hereinberfore, the description of the present invention was given with reference to the structure in which the conveying means 121 for discharging an output Sheet into the sheet delivery tray 120 is constituted of a roller pair. However, the conveying means 121 may be constituted of a gripper 701 which conveys a sheet or a sheet set as illustrated in FIGS. 39 and 40. The same effects can be produced by the employment of the gripper 701.

Next, a typical operation in which an output sheet or an output sheet set is moved by the gripper 701 will be described.

Figure 39A:
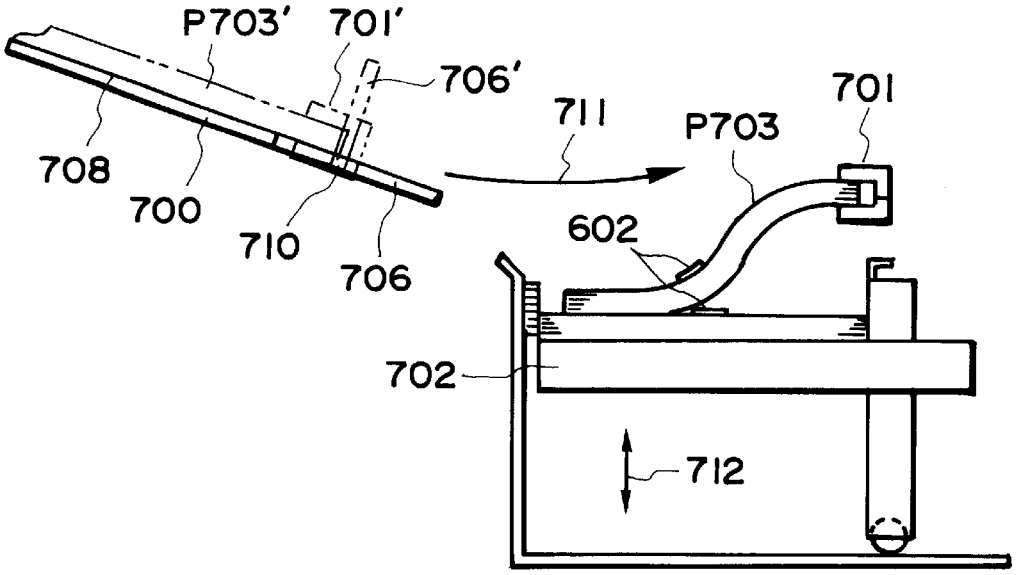
FIGS. 39A and 39B are drawings depicting the state of the sheet accumulation in the tray portion in the sixth embodiment of the present invention, FIG. 39(*a*) being side view of the tray portion, and FIG. 39(*b*) being a plan view of the same.
Figure 39B:
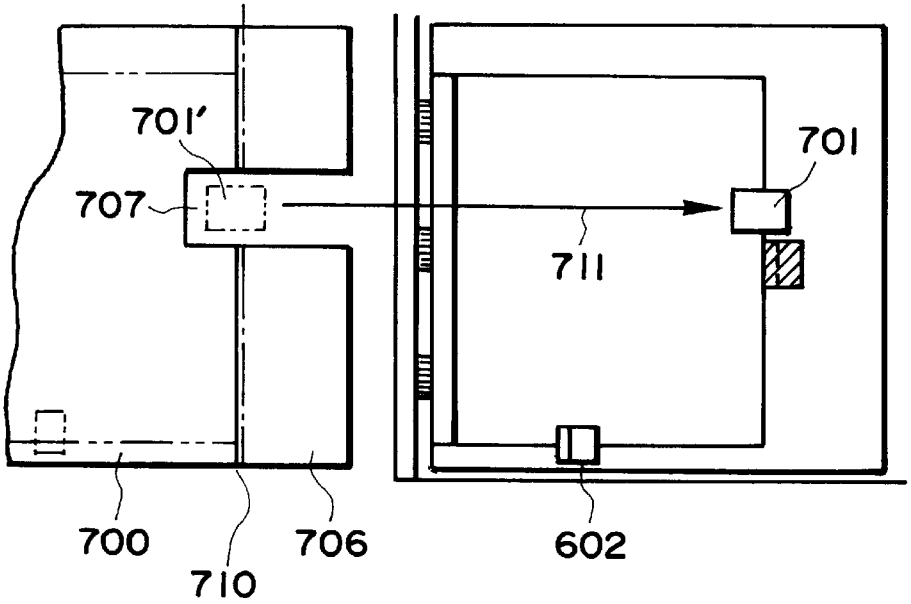

FIG. 39B is a plan view of the structure illustrated in FIG. 39A.

Referring to FIGS. 39A and 39B, a reference numeral 700 designates the first tray, and 706 designates a sheet stopper. When output sheets are put together as a sheet set P703' on the tray 700, the sheet stopper 706 is placed at a position 706', and the output sheets belonging to the sheet set P703' (P703' represents the position of the sheet set P703 before the sheet set P703 is moved from the first tray 700 to a sheet delivery tray 702) are accumulated in the first tray 700.

As the accumulation of the output sheets belonging to the sheet set P703' ends, the gripper 701 is moved by an unillustrated driving means to a position 701' where the gripper 701 faces the sheet set P703' in the first tray 700. Then, the gripper 701 is caused to grip the sheet set P703', by the unillustrated driving means (during these movements of the gripper 701, the tray 700 and sheet stopper 706 do not interfere with the gripper 701 since they are provided with a notch 707).

Then, the stopper 706 is rotated to a position 706 about a rotational axis 710 by an unillustrated driving means.

Next, the gripper 701 is moved in the direction of an arrow mark 711, dragging the sheet set P703' from the first tray 700 into the second tray (sheet delivery tray) 702, as illustrated in FIGS. 39A and 39B (P703'–P703).

As for the pasting of a cut second sheet 602, it may be done during any of the following periods: before the accumulation of the output sheets in the first tray 700; while the sheet set P703 is transferred out of the first tray 700; or while the sheet set P703 is resting in the first tray 700.

Next, referring to FIGS. 40A–40F, a method for moving the sheet set P703, and the position to which the cut second sheet 602 is pasted, will be described.

The second tray 702 and the sheet end stopper 713, are movable in the directions of arrow marks 712 and 713A by unillustrated driving means, respectively. In the drawings, they are at predetermined positions correspondent to the number of the output sheets on the tray 702 and the sheet size, respectively.

Figures 40A, 40B, 40C, 40D, 40E, 40F:
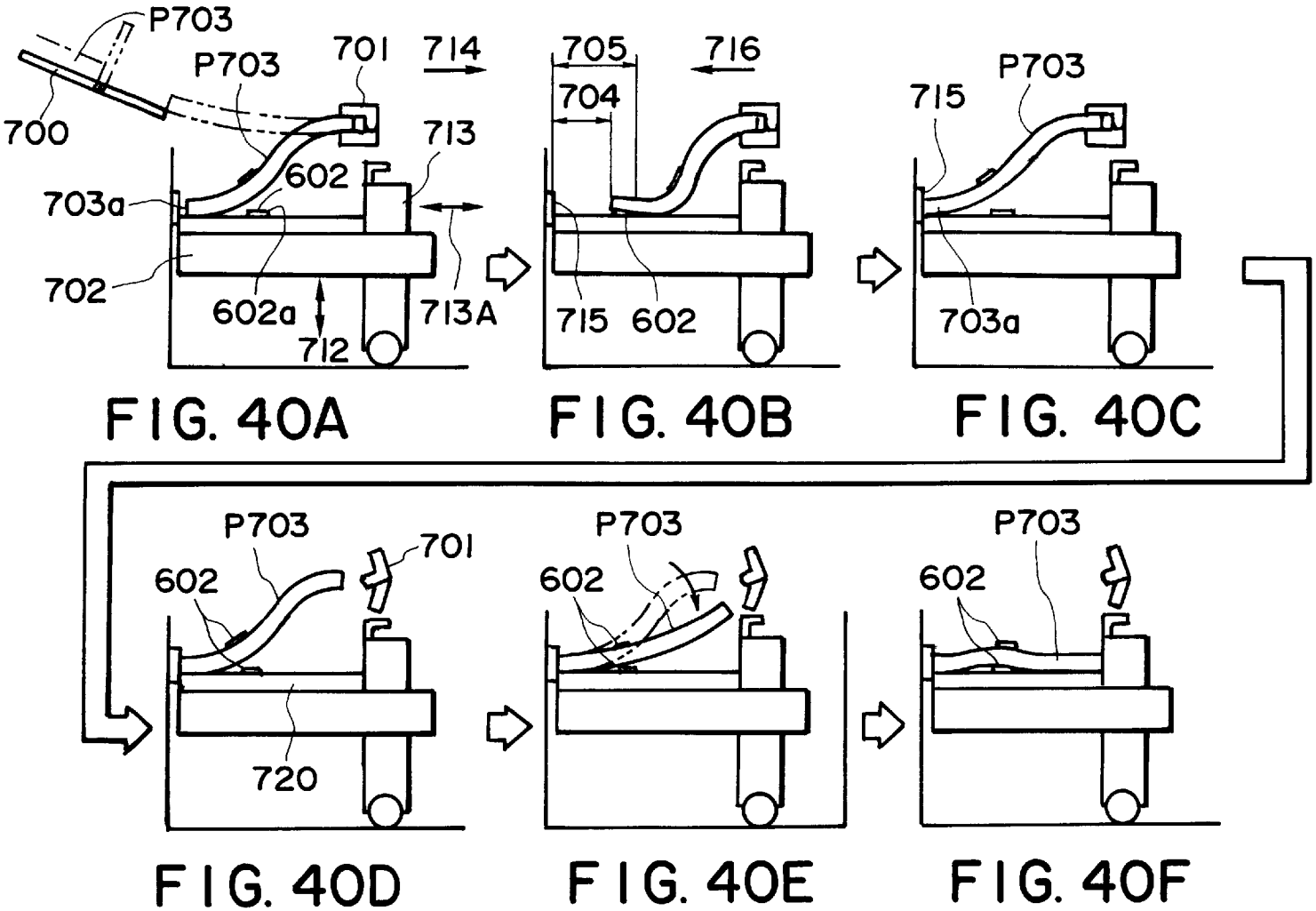
FIGS. 40A–40F illustrate the operational sequence of the apparatus illustrated in FIG. 39.

As the edge 703*a* of the sheet set P703 lands on the tray 702 (FIG. 40A), the gripper 701 is moved first in the direction of an arrow mark 714 (FIG. 40B), and then, is moved in the direction of an arrow mark 716 until the edge 703*a* comes in contact with the sheet end stopper 713 disposed at a predetermined position (FIG. 40C).

Then, the gripper 701 is opened as shown in FIG. 40(*d*), and the sheet set P703 settles directly on the tray 702 or on the sheet set P720 on the tray 702, between the leading end stopper 713 and the stopper 715 (FIG. 40E) and FIG. 40F).

In this case, as long as the position to which a cut second sheet 602 is pasted on an output sheet is selected so that the distance 705 between the edge 602A of the pasted cut second sheet 602 and the stopper 715 becomes larger than the distance 704 between the point from which the trailing edge 703*a* begins to be moved in the direction of an arrow mark 716 and the stopper 715, the aforementioned output sheet alignment failure caused by the catching of the incoming output sheet by the pasted cut second sheet 602 does not occur.

In the above description of this embodiment, the present invention was described with reference to a case in which the gripper 701 was moved after it was first moved in the direction of the arrow mark 714. However, needless to say, as long as the point from which the trailing edge 703*a* begins to be moved in the direction of the arrow mark 715 is set up to satisfy the relationship between the aforementioned distances 704 and 705, the same effects can be produced.

Also in the above structure, when a cut second sheet 602 is pasted on the top surface of an output sheet on the sheet delivery tray, the cut second sheet 602 was pasted to the edge parallel to the output sheet conveyance direction. However, the cut second sheet 602 may be pasted to the edge perpendicular to the output sheet conveyance direction as long as the following structure is implemented.

Figure 41:
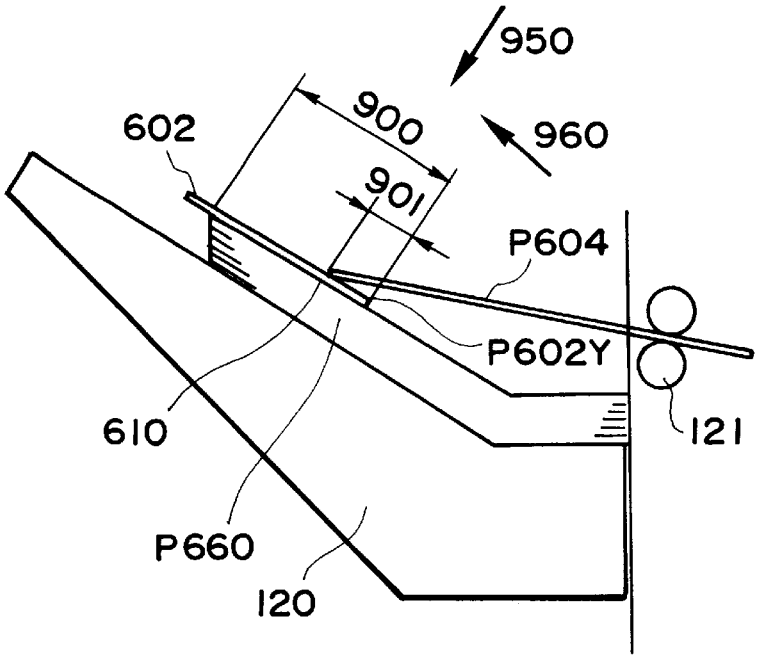
FIG. 41 is a side view of the tray portion in the seventh embodiment of the present invention, depicting the state of the sheet accumulation in the tray portion.
Figure 42:
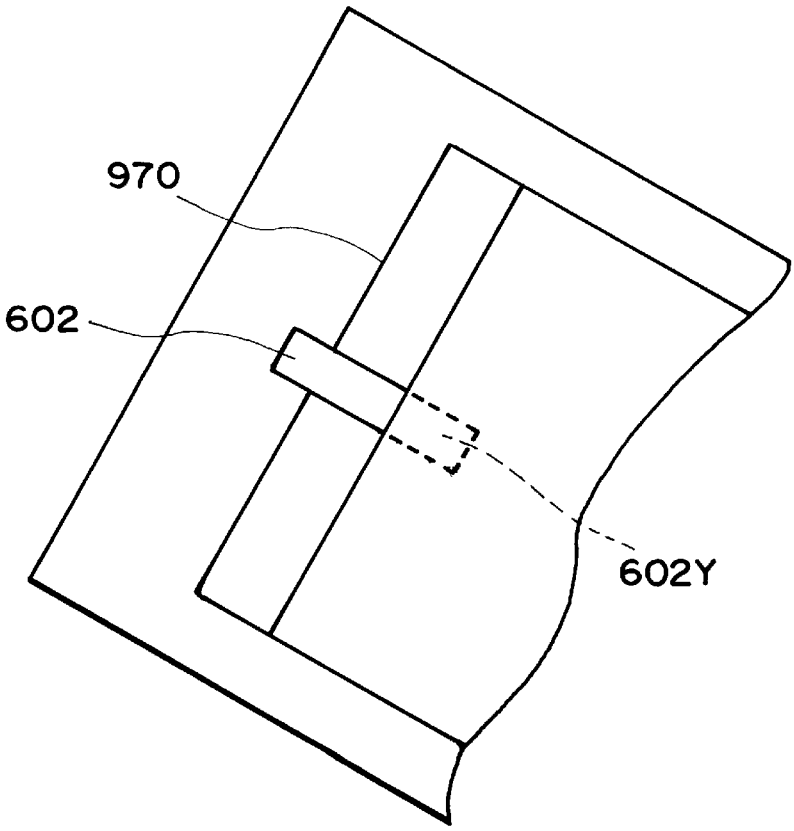
FIG. 42 is a view of the tray portion illustrated in FIG. 41, as seen from the direction of an arrow mark 960 in FIG. 41.

FIG. 42 is a view of the tray and the output sheet with the pasted cut second sheet 602 illustrated in FIG. 41, as seen from the direction of an arrow mark 905 in FIG. 41.

In this modified embodiment in which a cut second sheet 602 is pasted to an output sheet P660, at the edge perpendicular to the direction in which the output sheet P660 is conveyed, in order to prevent the leading edge of the incoming output sheet P604 from being caught by the cut second sheet pasted on the preceding output sheet, the pasting position 900 for the cut second sheet 602 is set up so that the distance between the edge 602Y of the pasted cut second sheet 602 and the point 610 at which the leading edge of the incoming output sheet lands becomes no less than zero.

Figure 43:
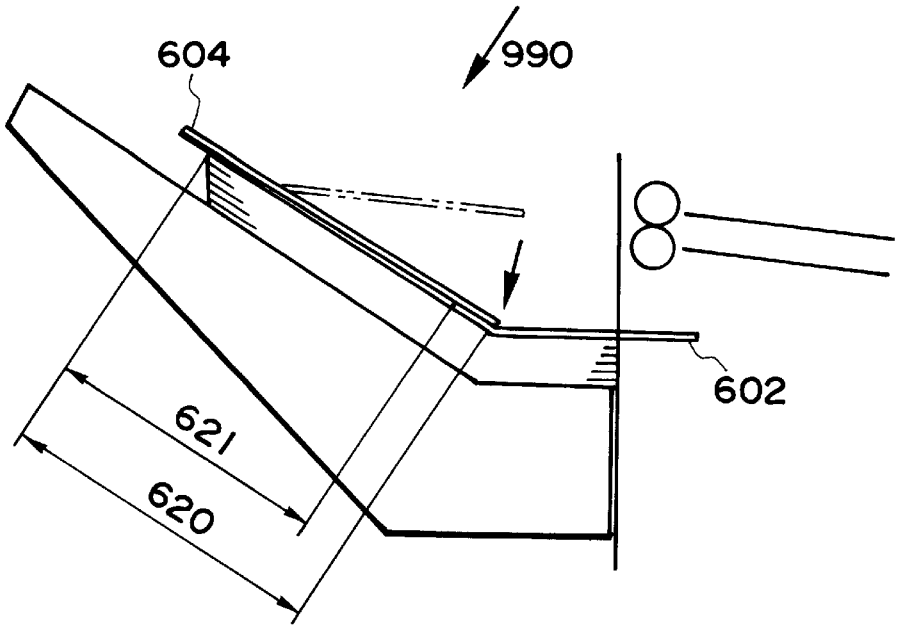
FIG. 43 is a side view of the tray portion in the seventh embodiment of the present invention, depicting one of the operational stages of the sheet accumulation in the tray portion.
Figure 44:
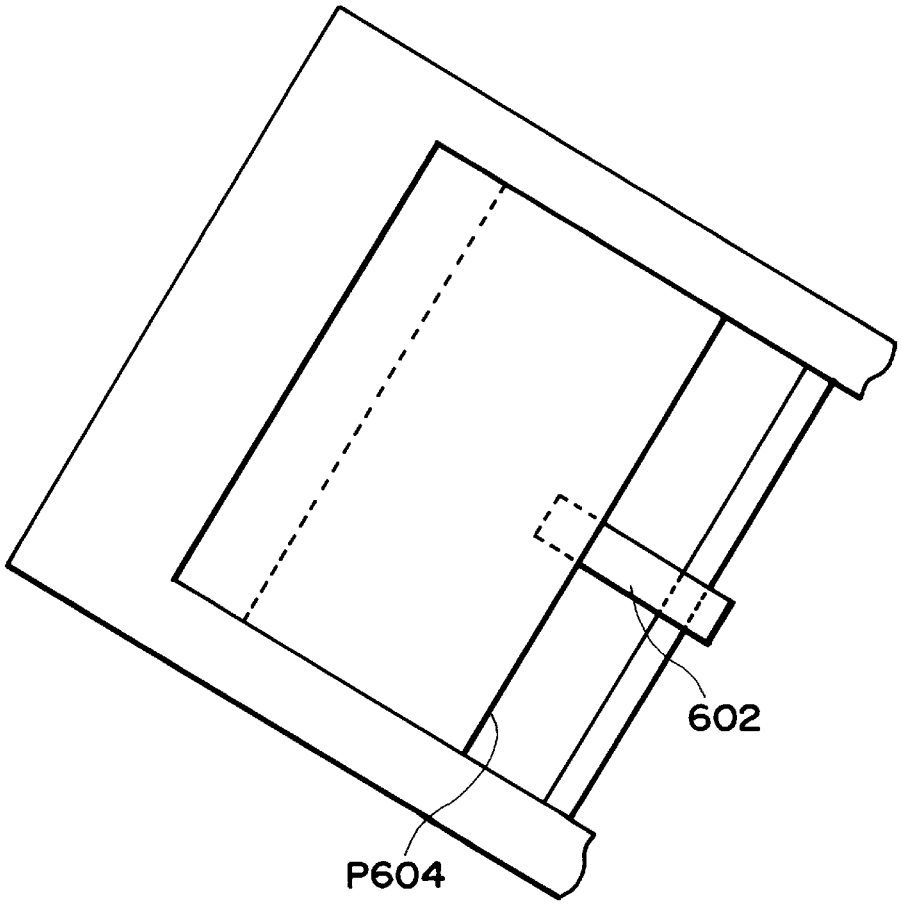
FIG. 44 is a view of the tray portion illustrated in FIG. 43, as seen from the direction of an arrow mark 990 in FIG. 43.

With the provision of the above arrangement, the same effects as those described in the preceding embodiments can be produced. Further, referring to FIGS. 43 and 44 (FIG. 44 is a view of the tray and the output sheet with the pasted cut second sheet 602 illustrated in FIG. 43, as seen from the direction of an arrow mark 990 in FIG. 43), as long as a distance 621 is rendered shorter than a length 620, the catching of the trailing edge of an output sheet P604 by a pasted cut second sheet 602, which was described in the fourth embodiment, can be also eliminated as effectively as it was in the preceding embodiment, even when the edge of an output sheet, to which a cut second sheet 602 is pasted, is perpendicular to the output sheet conveyance direction.

Further, even when a cut second sheet is pasted to the bottom surface of an output sheet, it is desirable that the pasting position for a cut second sheet is set in the same manner as it is set when a cut second sheet is pasted to the top surface.

Figure 35:
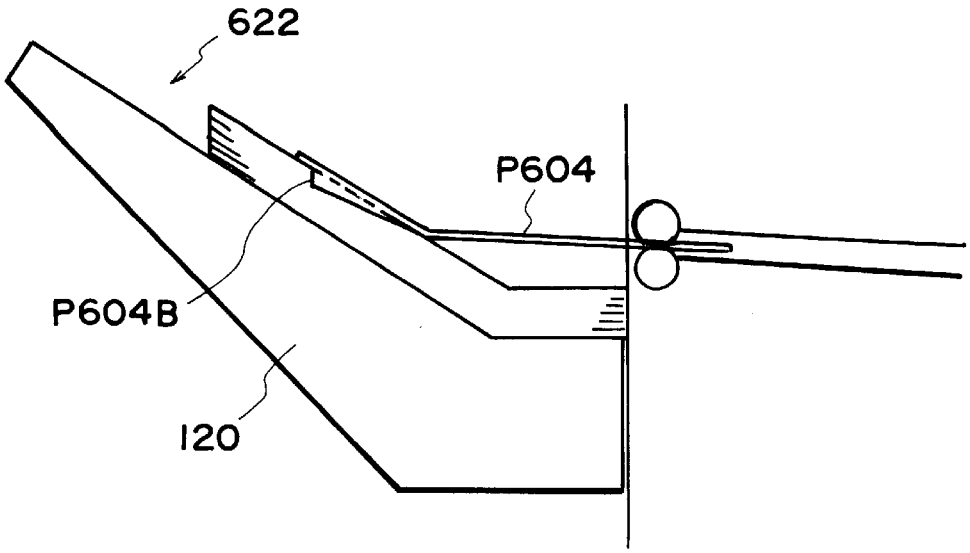
FIG. 35 is a side view of the tray portion in the eighth embodiment of the present invention, depicting the state of the sheet accumulation in the tray portion.
Figure 36:
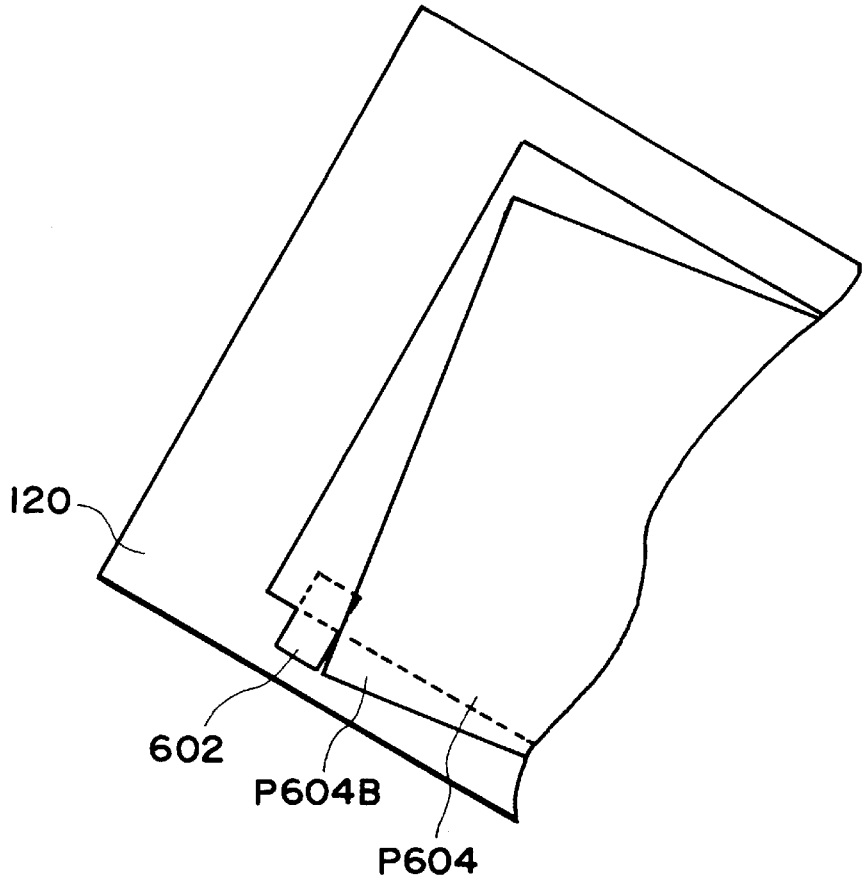
FIG. 36 is a view of the tray portion illustrated in FIG. 35, as seen from the direction of an arrow mark 622.
Figure 37:
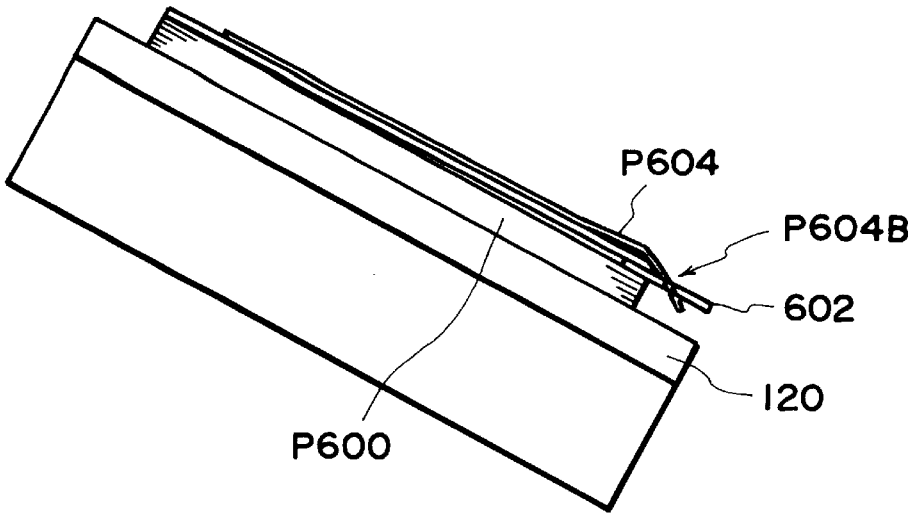
FIG. 37 is a view of the tray portion illustrated in FIG. 35, as seen diagonally from the left side.

This arrangement will be described with reference to FIGS. 35, 36 and 37 (FIGS. 36 and 37 are views of the tray and the output sheets illustrated in FIG. 35, as seen from the directions of arrow marks 622 and 623, respectively).

Even when a cut second sheet 602 is pasted to the ban side of an output sheet as described above, if an incoming sheet P604 is discharged askew for some reason, and in addition, the leading edge corner of the sheet P604, on the side to which a cut second sheet is pasted, is bent toward the tray surface as illustrated in FIG. 37, the sheet P604 is liable to be caught by the cut second sheet 602.

Therefore, even when a cut second sheet 602 is pasted to the bottom surface of an output sheet, it is desirable to paste a second sheet 602 in a manner to satisfy the above described positional relationship, so that the effectiveness of the present invention is assured.

Next, a second sheet roll 114 will be described.

Embodiment 1 of Second Sheet

Figure 45:
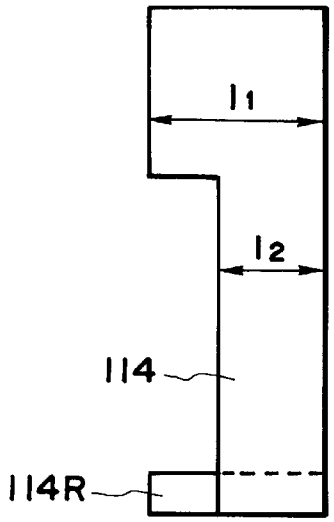
FIG. 45 is a front view of the second sheet and its core portion.
Figure 46:
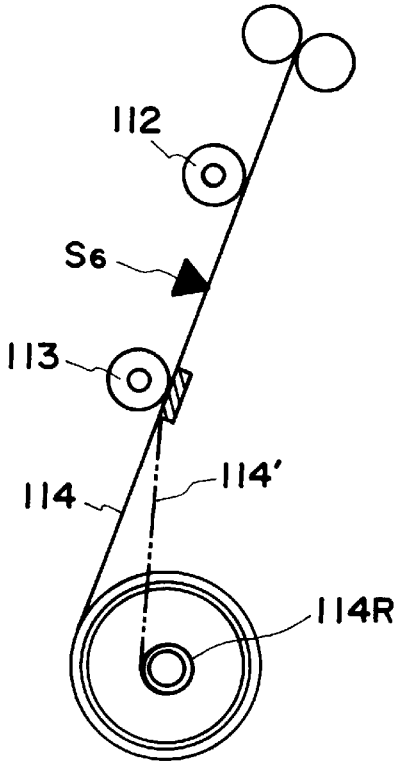
FIG. 46 is a side view of the sheet illustrated in FIG. 45.

Referring to FIGS. 45 and 46, the second sheet roll 114 is constituted of a second sheet portion 114 and a core portion 114R. The width of the second sheet portion 114 is $1_1$ except for the last portion having a width of $1_2$ which is narrower than $1_1$.

Figure 47:
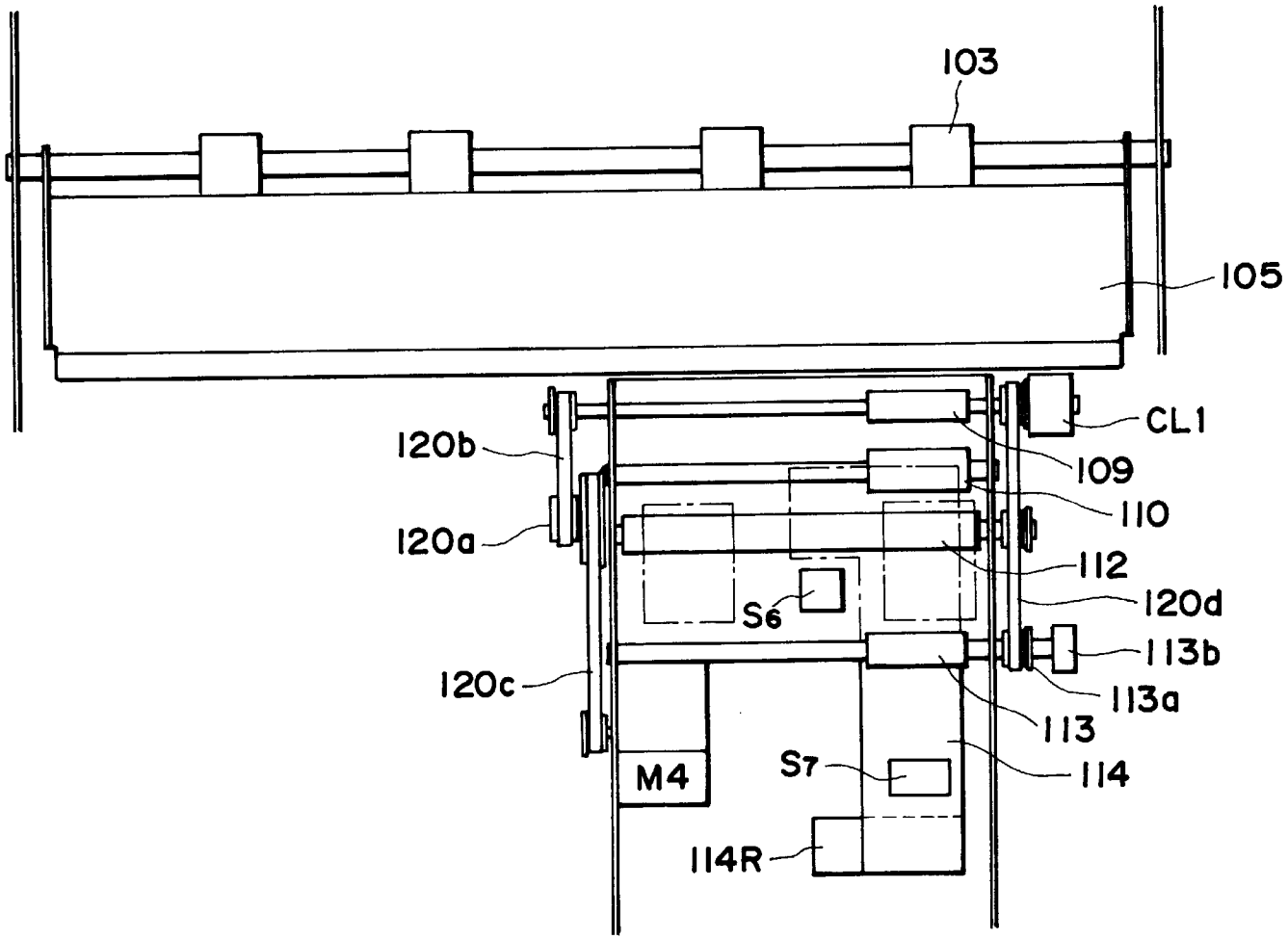
FIG. 47 is a view of the second sheet and a cartridge set detecting sensor portion, in the second sheet feeding portion, as seen from the direction of the arrow mark A in FIG. 2.

As the second sheet roll 114 comes to the end as designated by a referential numeral 114' in FIG. 46, it is determined by the first registration sensor S6 that there is no second sheet 114, as illustrated in FIG. 47, and a message, "Please refill a second sheet roll," is displayed on the control panel screen (unillustrated) of the main assembly of an image forming apparatus.

Figure 48:
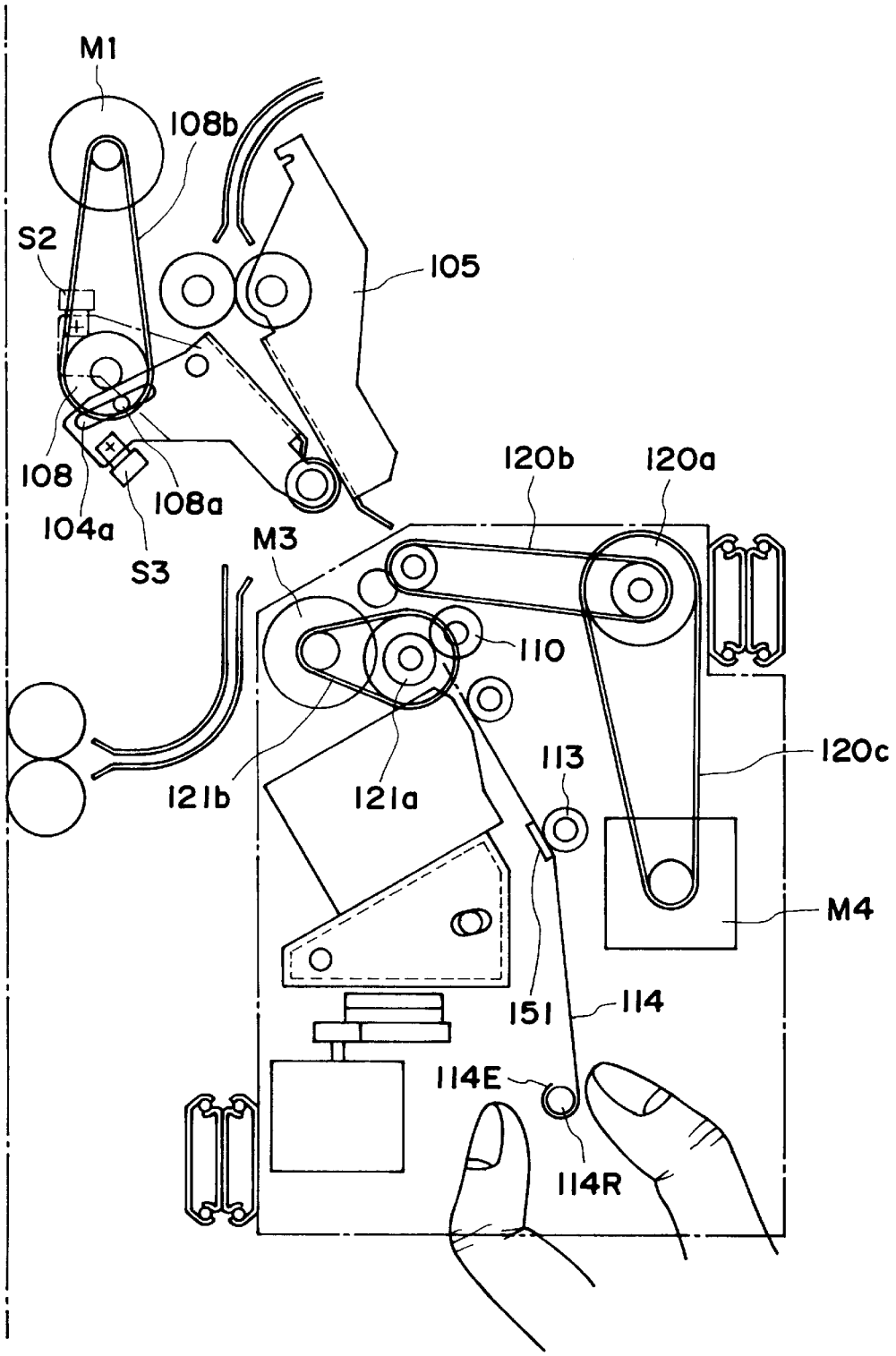
FIG. 48 is a rear view of the second sheet feeding portion, depicting one of the operational stages for removing the core portion of the second sheet.

Thereafter, the continuous second sheet feeding portion 101 holds its operation until it is refilled with a second sheet roll. The leading end of the second sheet roll 114 is controlled by the controlling means 90 so that it stops at the cutting portion 110 as illustrated in FIGS. 47 and 48.

The end portion 114E of the continuous second sheet 114 is firmly attached to the core portion 114R. Referring to FIG. 48, the core portion 114R is supported from both lateral sides by a supporting member 152, which is elastically supported by an elastic member 153 so that the supporting member 152 springs back into a position at which it becomes parallel to the core portion 114R.

Figure 49:
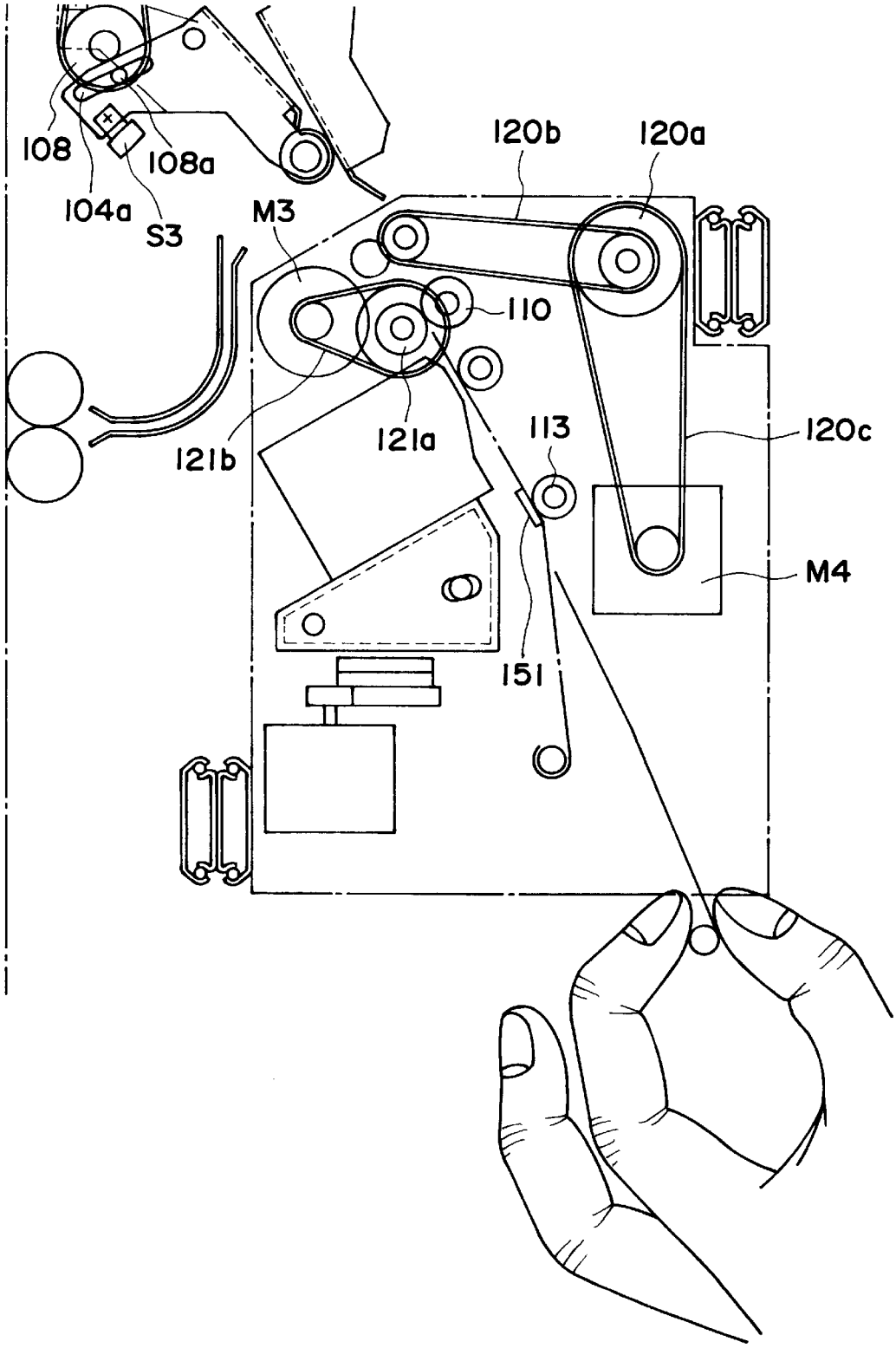
FIG. 49 is a rear view of the second sheet feeding portion, depicting one of the operational stages for removing the core portion of the second sheet.
Figure 50A:
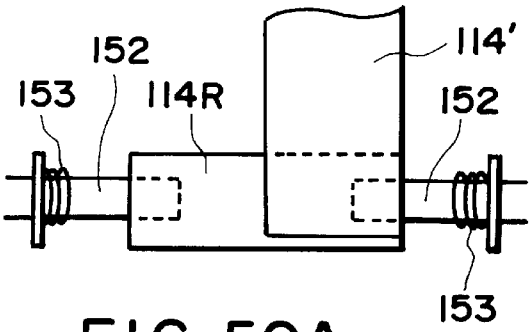
FIG. 50 is a view of a sheet roll mounting portion, FIG. 50A depicting the state in which a sheet roll is on a supporting member, and FIG. 50B depicting the state in which a sheet roller is being removed.
Figure 50B:
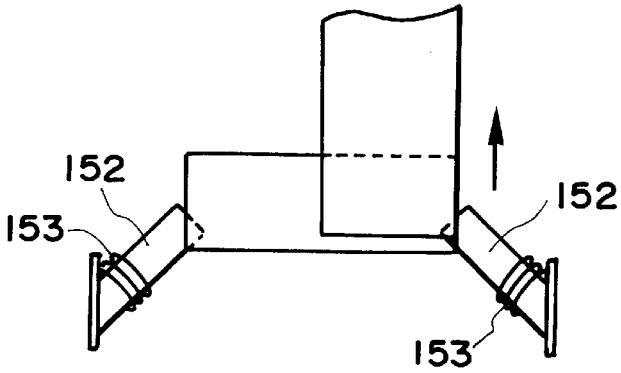

The user is to open the door (unillustrated) of the sheet processing apparatus, and pull out a rail 171. Then, the user pulls out the core portion 114R as illustrated in FIGS. 48 and 49. The supporting member 152 rotates as illustrated in FIG. 50A to allow the core portion 114R to be removed.

Figure 51:
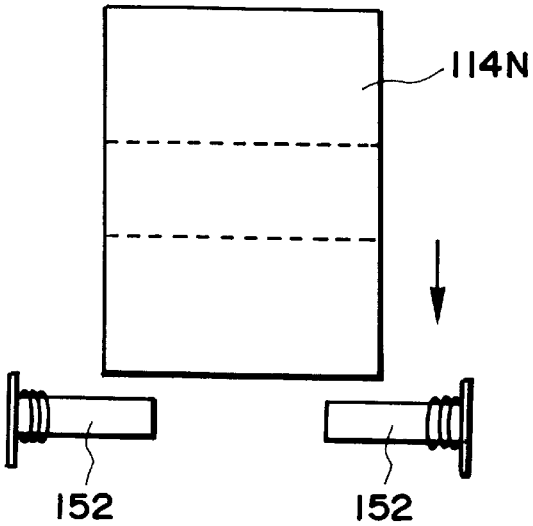
FIG. 51 is a front view of the sheet roll mounting portion, depicting one of the operational stages for mounting a sheet roll.
Figure 52:
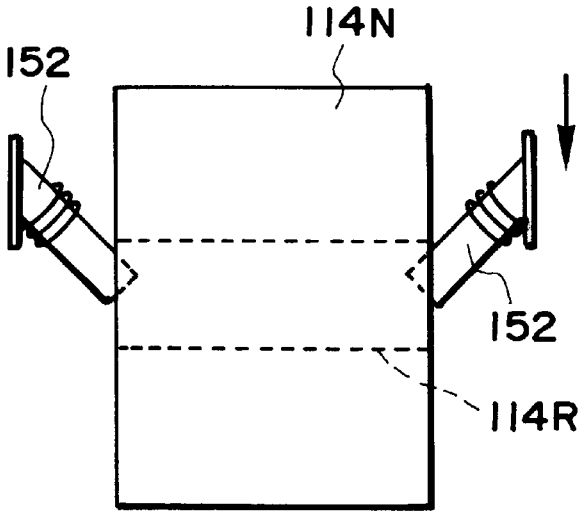
FIG. 52 is a front view of the sheet roll mounting portion, depicting one of the operational stages for mounting a sheet roll.
Figure 53:
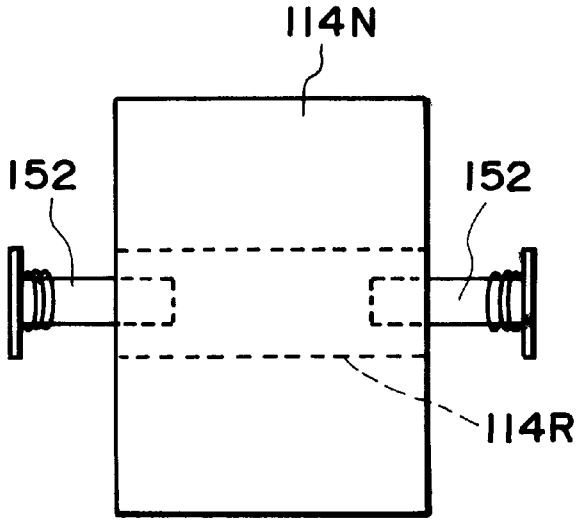
Figure 54:
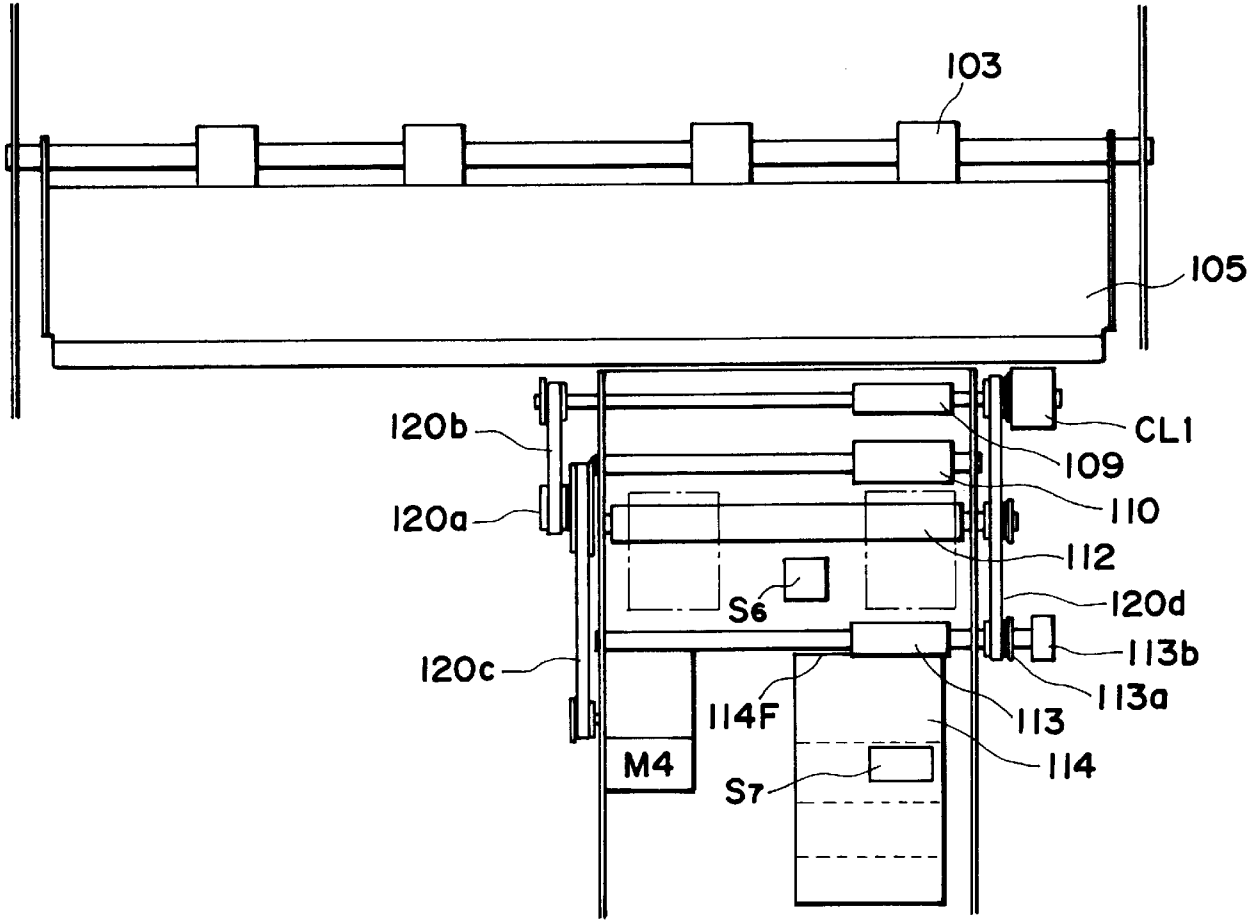
FIG. 54 is a view of the second sheet feeding portion in which a sheet roll has been mounted, as seen from the direction of the arrow mark A in FIG. 2.
Figure 55:
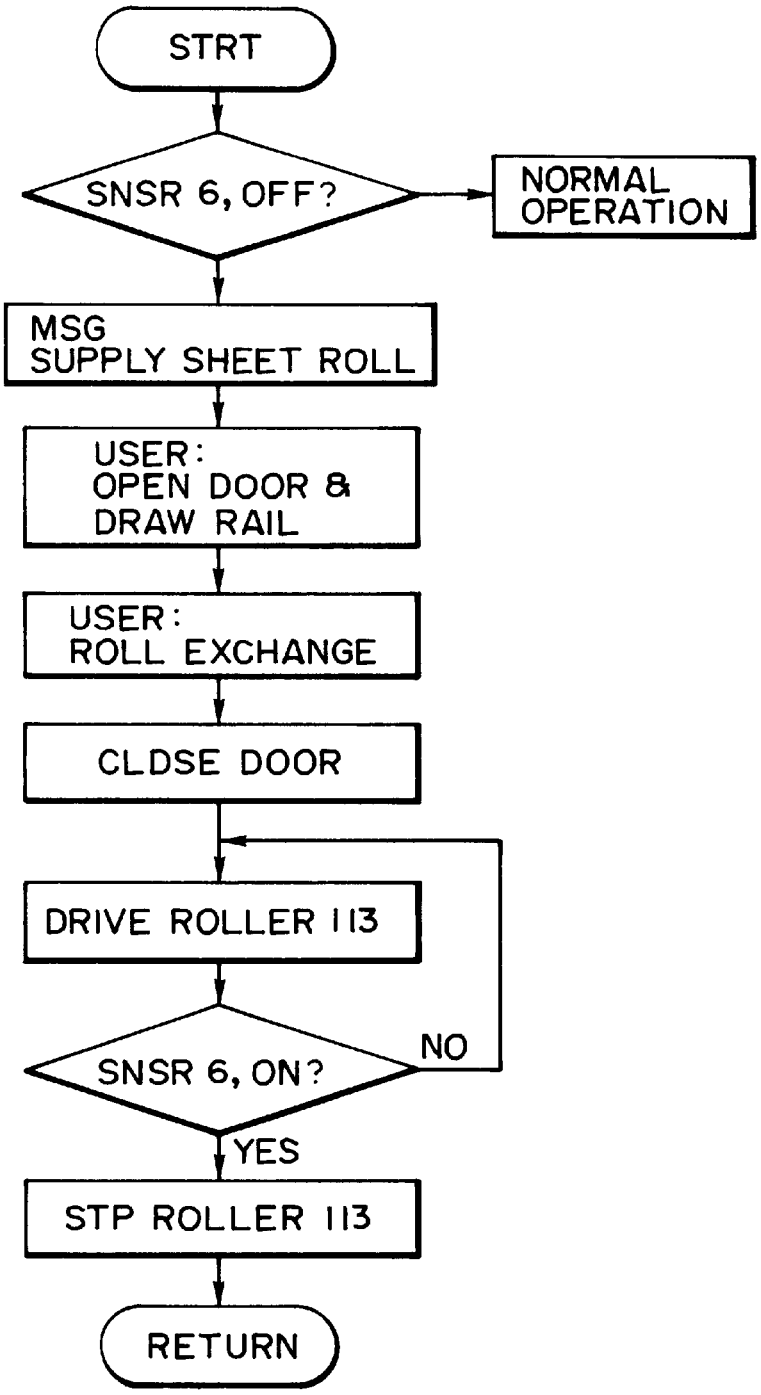
FIG. 55 is a flow chart for installing a fresh sheet roll.

Next, the user pushes a new second sheet roll 114N between the opposing supporting members 152 as illustrated in FIGS. 51 and 52. Then, the supporting members 152 rotates to fit into the core portion 114R (FIG. 53). Next, the user places the leading end 114F of the new second sheet 114N against a feeding roller 113 illustrated in FIG. 48, and turns the knob of the feeding roller 113 so that the leading end 114F of the second sheet roll 114N is nipped between the feeding roller 113 and pad 151. In this state, the user puts back the rail 171, and closes the door (unillustrated) of the sheet processing apparatus. In the continuous second sheet feeding portion 101, the feeding roller 113 is rotated, and is stopped as soon as the leading end 114F of the new second sheet roll 114N reaches the sensor S6. Then, the continuous label feeding portion 101 remains on standby until the next second sheet pasting signal is sent in.

Embodiment 2 of Second Sheet

Figure 56:
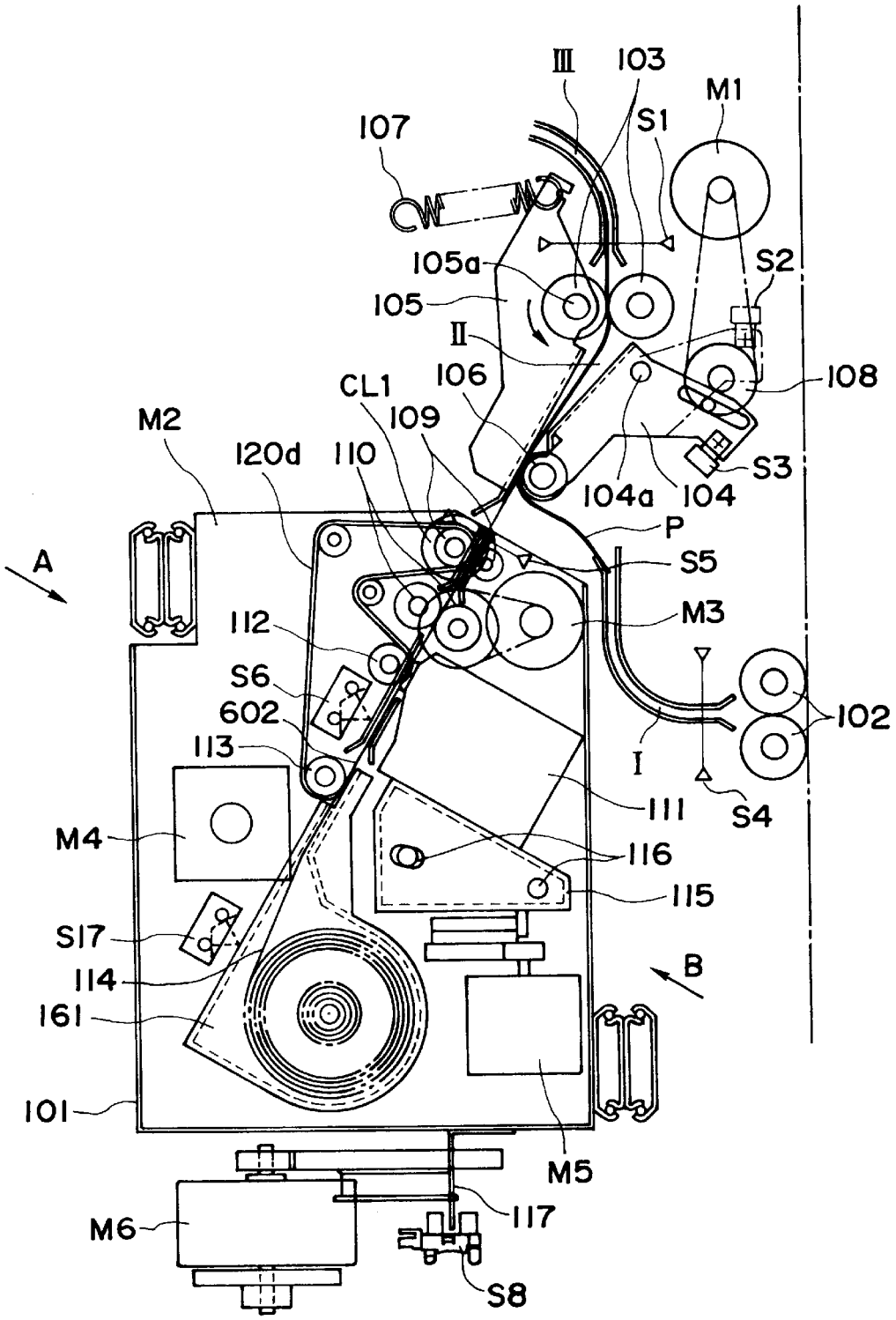
FIG. 56 is a front view of the second sheet feeding portion in the second embodiment of the present invention.

Referring to FIG. 56, the second sheet 114 may be placed in a cartridge 162, which is removably installable in the second sheet feeding portion 101 so that the cartridge 161 can be easily refilled with a new second sheet roll 114 after the removal of the core portion of the old second sheet roll from the second sheet feeding portion 101.

Figure 57:
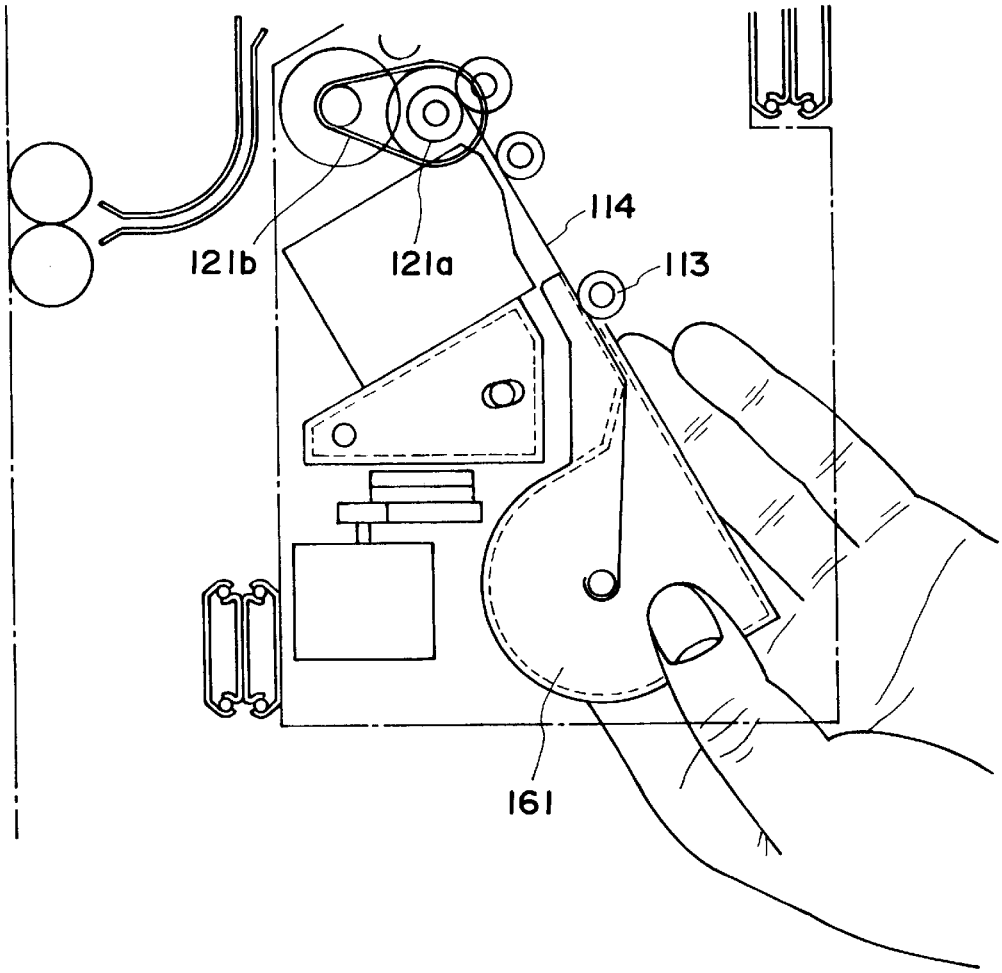
FIG. 57 is a rear view of the second sheet feeding portion, depicting one of the operational stages in cartridge installation.
Figure 58:
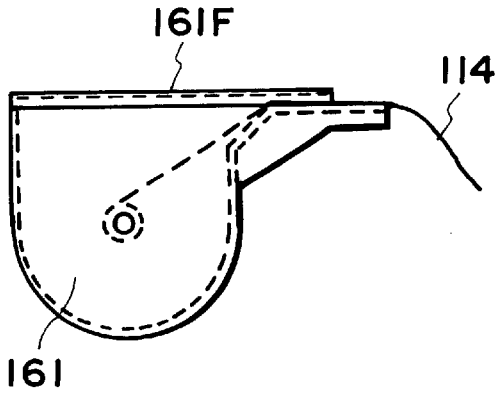
FIG. 58 is a side view of a cartridge.
Figure 59:
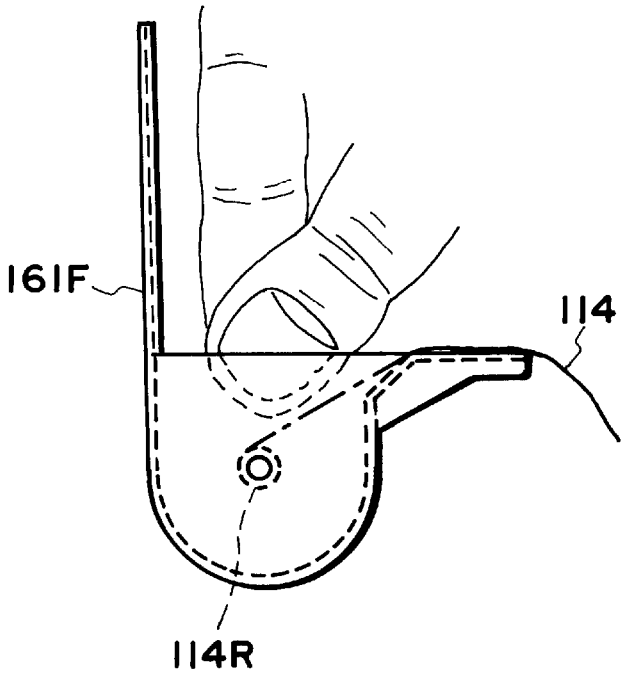
FIG. 59 is a side view of a cartridge, depicting one of the operational stages in removing the core portion of a sheet roll.

The user pulls out the cartridge 161 as illustrated in FIG. 57. FIG. 58 depicts the cartridge 161 immediately after it is pulled out. The user opens the cartridge lid 161F as illustrated in FIG. 59, and removes the finished second sheet roll 114 as illustrated in FIG. 60.

Figure 60:
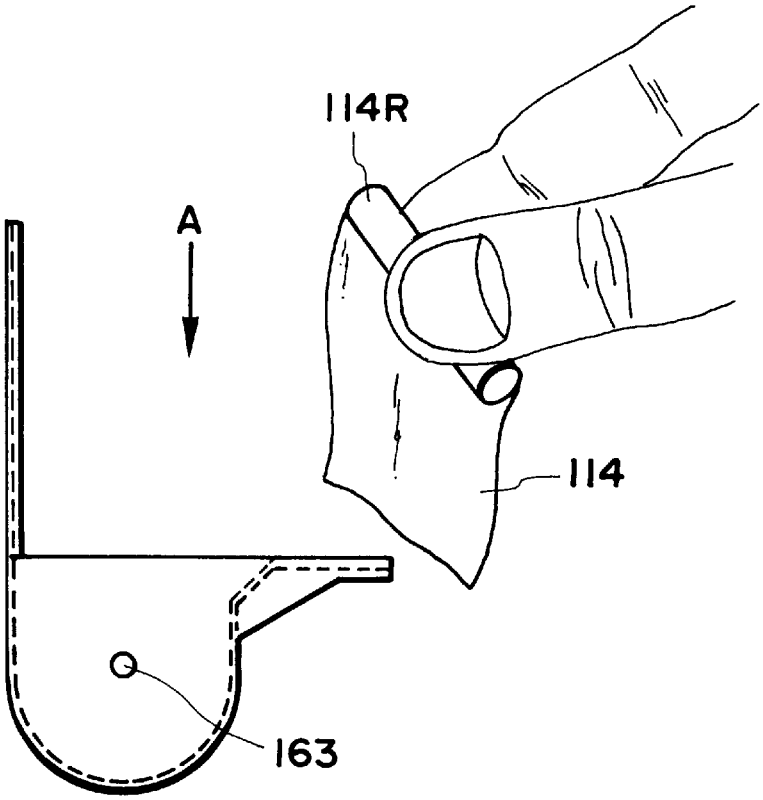
FIG. 60 is a side view of a cartridge, depicting one of the operational stages in removing the core portion of a sheet roll.
Figure 61:
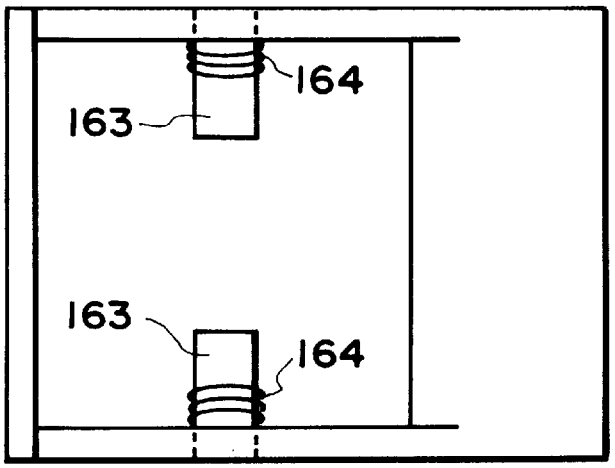
FIG. 61 is a plan view of a cartridge.
Figure 62:
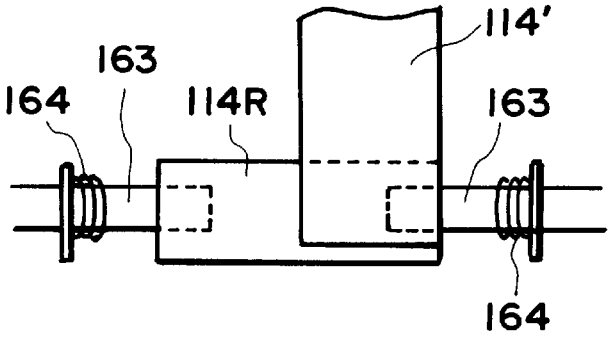
FIG. 62 is a front view of a cartridge, depicting how the core portion of a sheet roll is supported.
Figure 63:
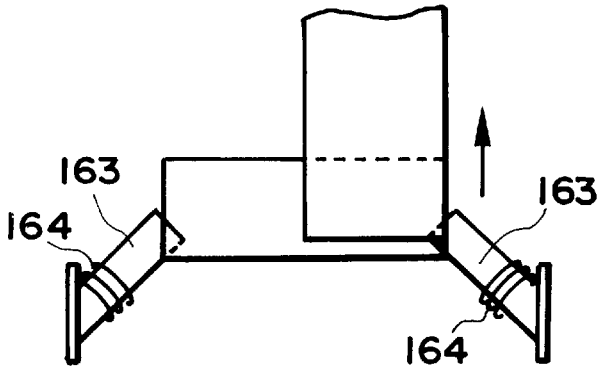
FIG. 63 is a front view of a cartridge, depicting how the core portion of a sheet roll is removed.
Figure 64:
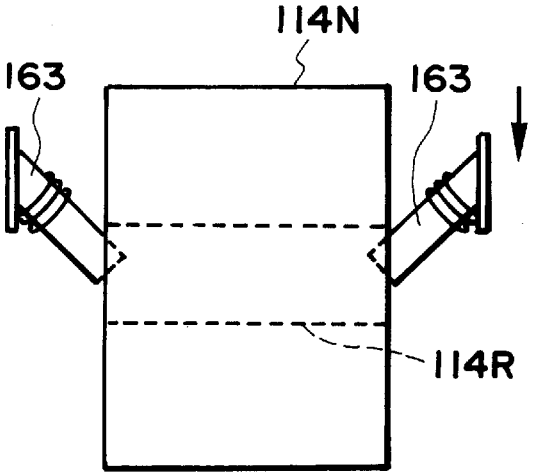
FIG. 64 is a front view of a cartridge, depicting how a sheet roll is mounted in the cartridge.
Figure 65:
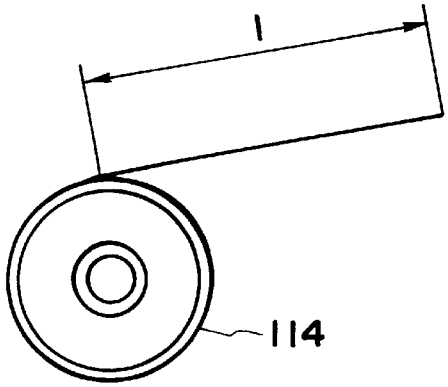
FIG. 65 a side view of a sheet roll

FIG. 61 is a view of the cartridge 161 illustrated in FIG. 60, as seen from the direction of an arrow mark A (FIG. 60). Referring to FIG. 62, a second sheet roll supporting member 163 supports the core portion 114R of the second sheet roll 114, which in turn is elastically supported by a spring 164 so that the second sheet roll supporting member 163 it springs back to a position at which the second sheet roll supporting member 163 becomes parallel to the core portion 114R. As the user pulls the second sheet roll 114, the supporting member 163 rotates as illustrated in FIG. 63, to allow the core portion 114 to be released. The user inserts a new second sheet roll 114N in a manner illustrated in FIG. 64. Referring to FIG. 65, the leader portion of a fresh second sheet roll 114 is lightly glued to the inner layer, at a spot which is a predetermined length L from the very end of the leader portion.

Figure 66:
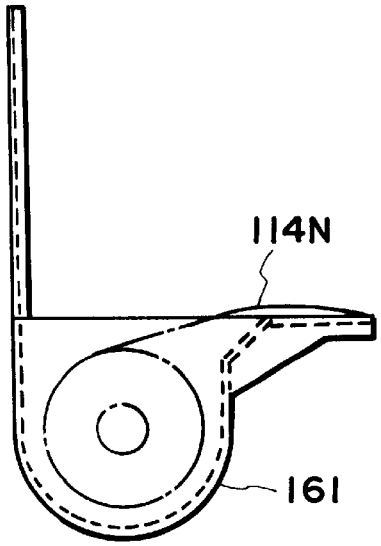
FIG. 66 is a side view of a cartridge, depicting one of the operational stages in placing a sheet roll in the cartridge.
Figure 67:
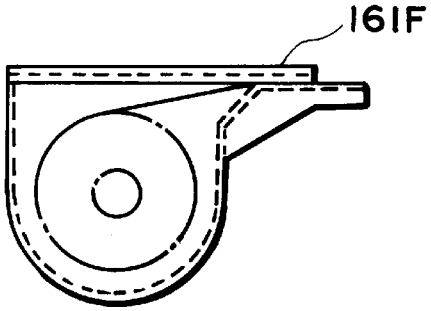
FIG. 67 is a side view of a cartridge, depicting one of the operational stages in placing a sheet roll in the cartridge.
Figure 68:
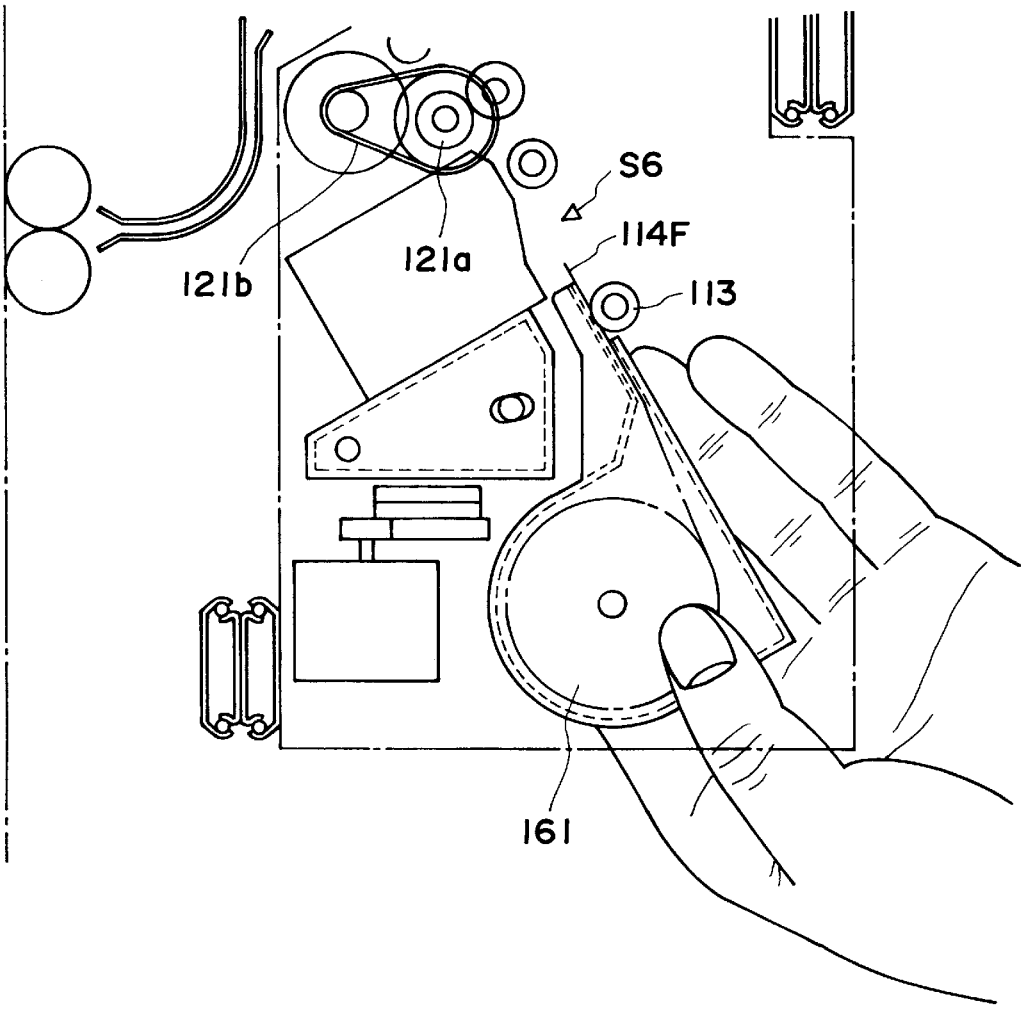
FIG. 68 is a rear view of the second sheet feeding portion, depicting how a cartridge is installed.

FIG. 66 depicts the cartridge 161 and a new second sheet roll 114N just placed in the cartridge 161. The user closes the cartridge lid 161F in a manner illustrated in FIG. 67, inserts the cartridge 161 in a manner illustrated in FIG. 68, and closes the door (unillustrated) of the sheet processing apparatus. The continuous second sheet feeding portion 101 rotates the feeding roller 113, stops it as the leading end 114F of the second sheet roll 114 reaches the sensor 56, and then, remains on standby until the next label pasting signal is issued.

Embodiment 3 of Second Sheet

Figure 70:
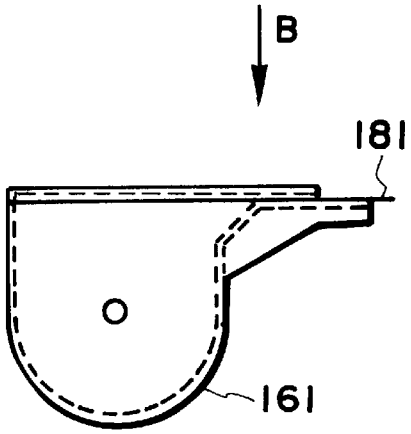
FIG. 70 is a side view of a cartridge with a cutter.
Figure 71:
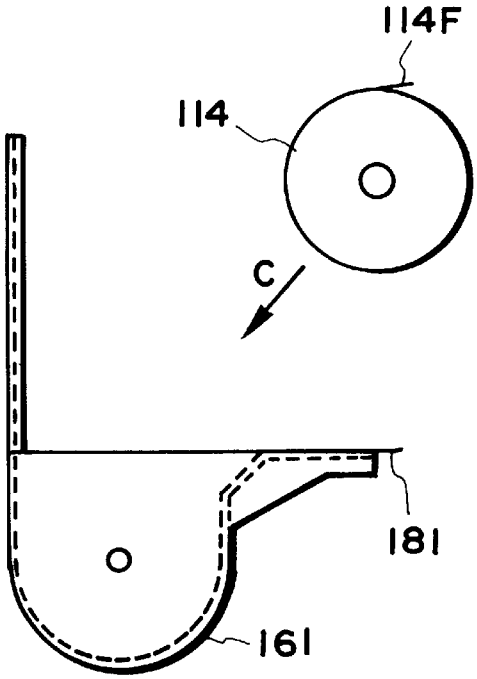
FIG. 71 is a side view of a cartridge, depicting one of the operational stages in placing a sheet roll in the cartridge.

This second sheet is of the same cartridge type as the one described in the second embodiment of the second sheet except that a cutter 181 is attached to the feeding end of the cartridge 161 as illustrated in FIGS. 70 and 71.

Figure 69:
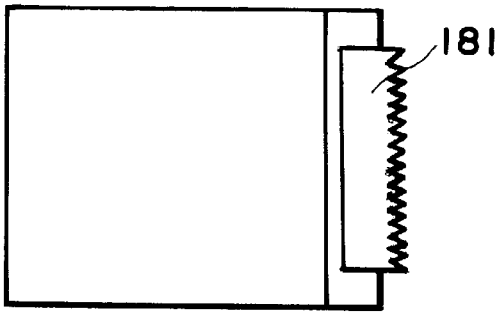
FIG. 69 is a plan view of a cartridge with a cutter.
Figure 72:
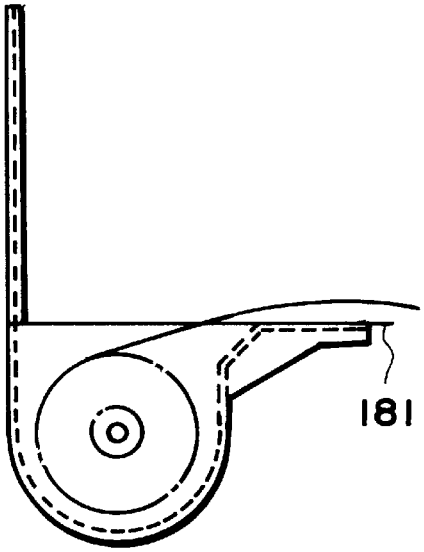
FIG. 72 is a side view of a cartridge, depicting one of the operational stages in placing a sheet roll in the cartridge.
Figure 73:
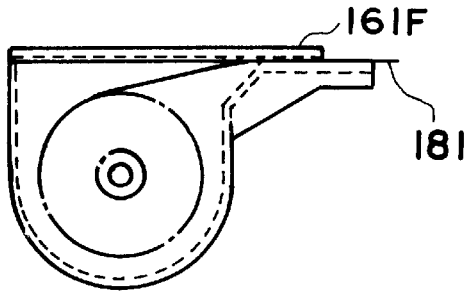
FIG. 73 is a side view of a cartridge, depicting one of the operational stages in placing a sheet roll in the cartridge.

FIG. 69 is a view of the cartridge 161 illustrated in FIG. 70, as seen from the direction of an arrow mark B in FIG. 70. The user inserts a second sheet roll 114 into the cartridge 161 in the direction of an arrow mark C as illustrated in FIG. 71, pulls out the leading end 114F of the second sheet roll 114 (FIG. 72), closes the cartridge lid 161F as illustrated in FIG. 73, cuts the leader portion of the second sheet roll 114 with the cutter 181 to give the leader portion an exact length. Thereafter, the user inserts the cartridge into the second sheet feeding portion 101 in the same manner as it was described in the second embodiment.

Embodiment 4 of Second Sheet

Figure 74:
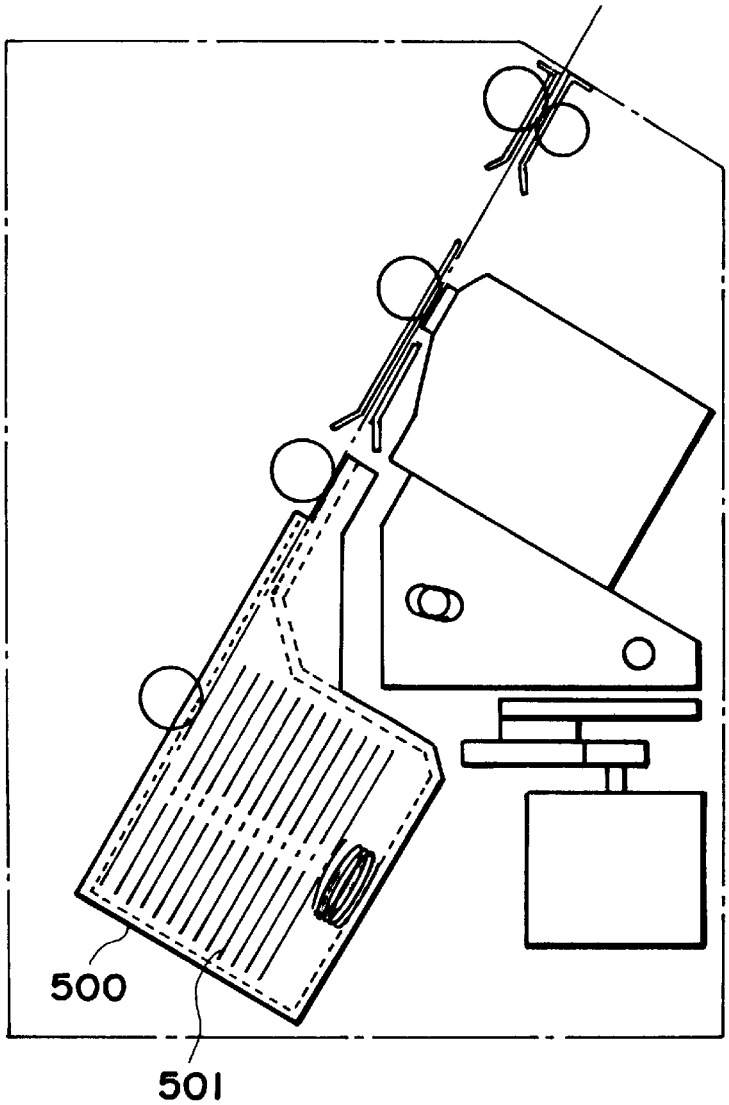
FIG. 74 is a front view of the second sheet feeding portion in which cut second sheets have been stored.
Figure 75:
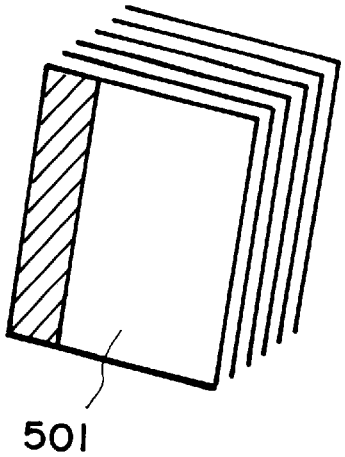
FIG. 75 is a perspective view of a stack of aligned cut second sheets.
Figure 76:
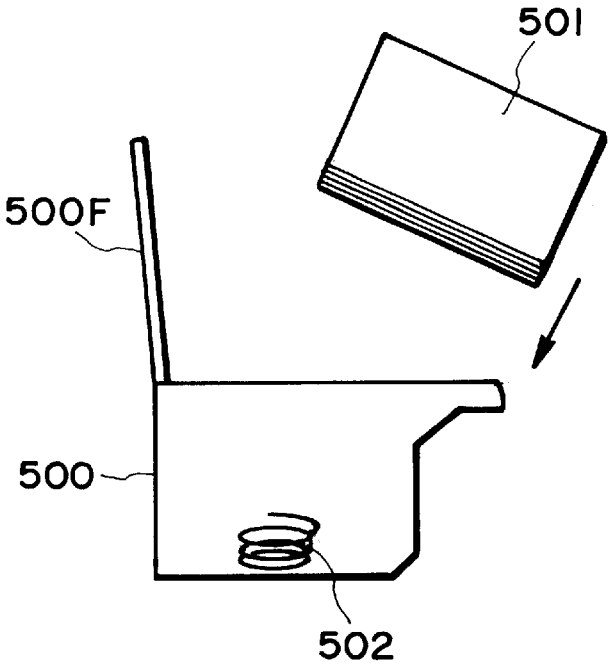
FIG. 76 is a side view of a cartridge, depicting one of the operational stages in placing cut second sheets in the cartridge.

Referring to FIG. 74, the second sheet may be in the form of a cut sheet 501. In this case, a plurality of cut second sheets 501 are filled in a cartridge 500 which is removably installable in the second sheet feeding portion 101 as it was described in the second embodiment. The details of the cut sheet 501 are given in FIG. 75. Referring to FIG. 76, the user removes the lid 500F of the removed cartridge 500, and places the cut second sheets 501. In the cartridge 500, the cut second sheets 501 remain pressured toward the lid 500F by a spring 502. Then, the user closes the lid 500F, and loads the cartridge 500 into the second sheet feeding portion 101.

Next, another embodiment of the present invention will be described. In this embodiment, the output sheets from a facsimile machine, a copy machine, and a printer can be discharged into a single delivery tray in such a manner that the boundaries between the adjacent two sets of output sheets from the jobs assigned to different image forming apparatuses can be easily recognizable; a sheet set belonging to each job can be easily separable from the sheet sets belonging to the other jobs.

Figure 77:
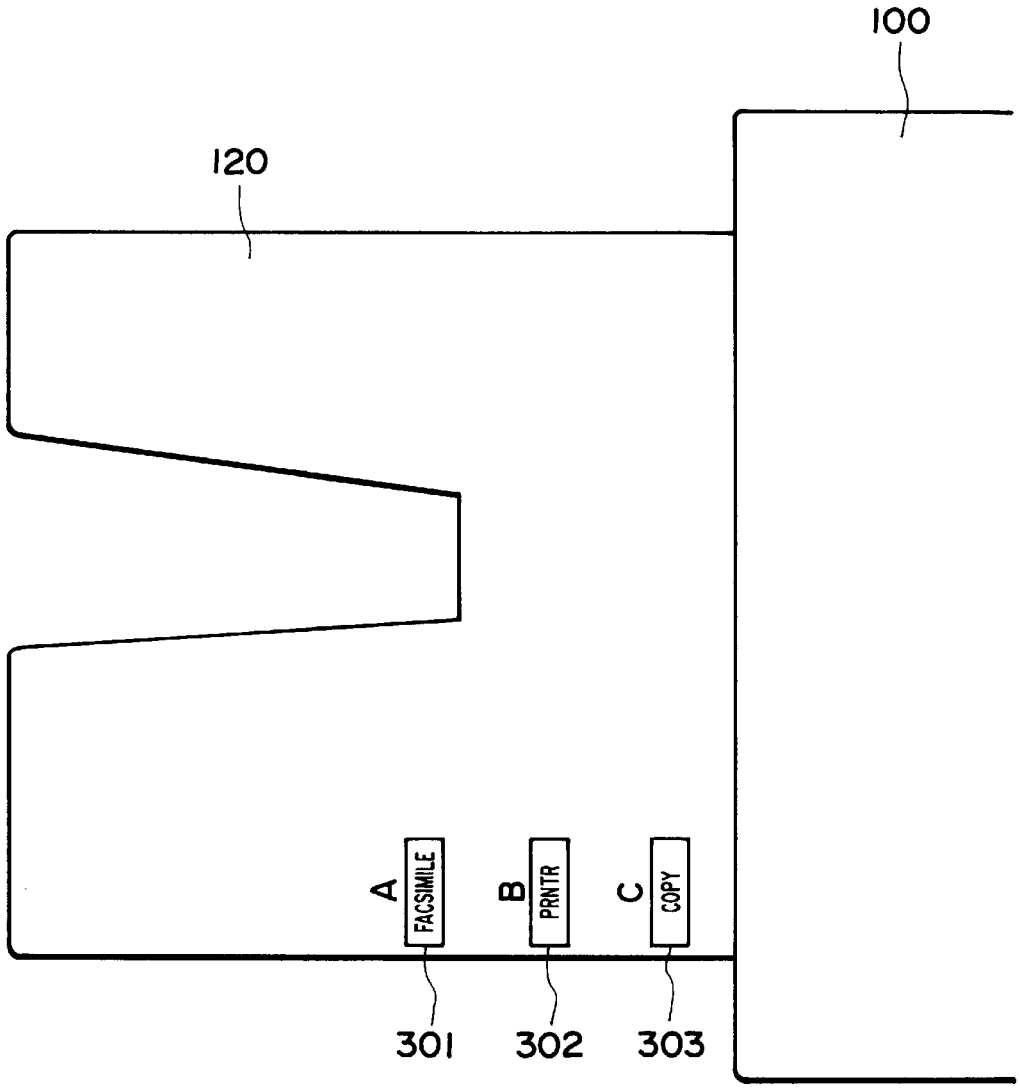
FIG. 77 is a plan view of a sheet delivery tray with job identification seals.
Figure 78:
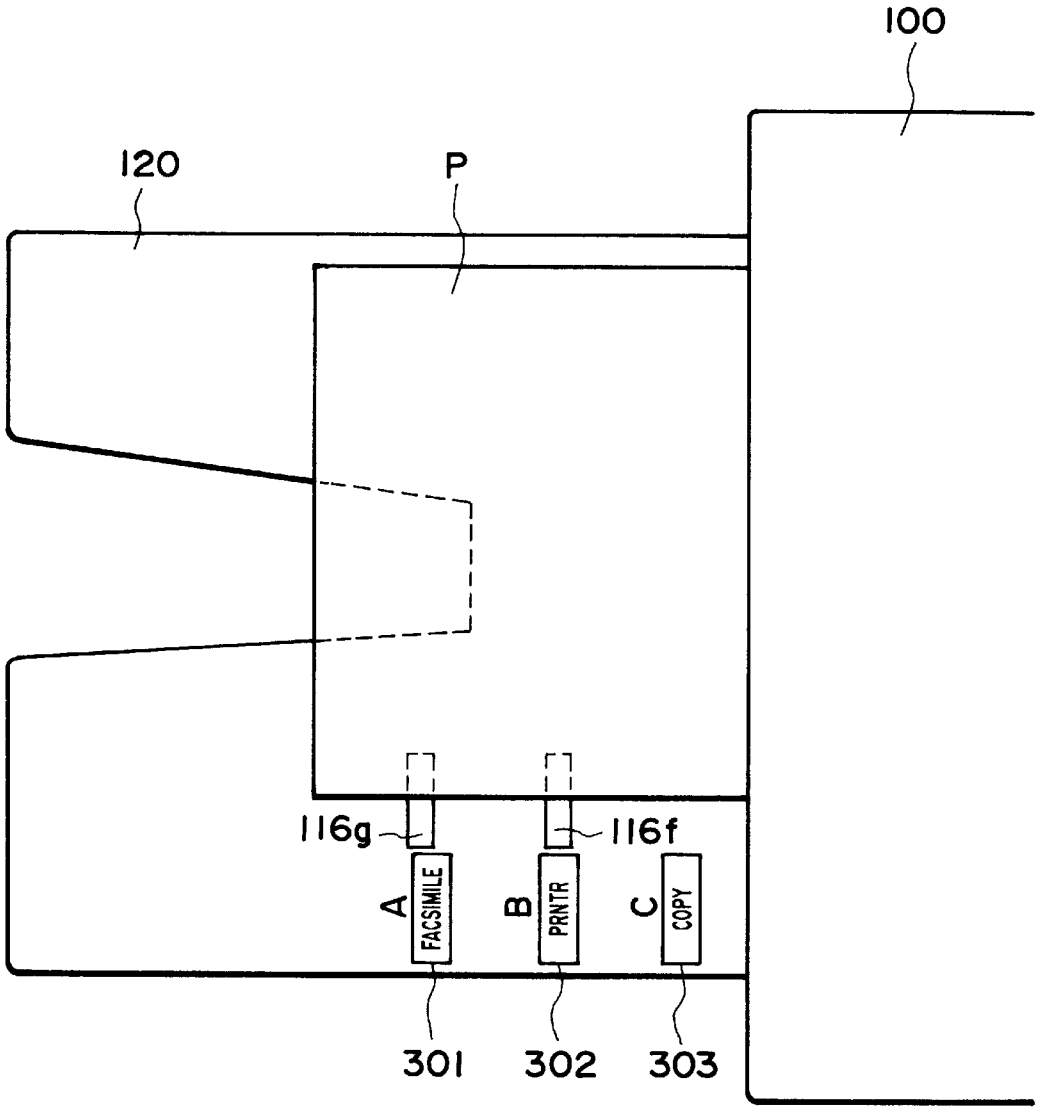
FIG. 78 is a plan view of the sheet delivery tray illustrated in FIG. 77, and the first sheets having been discharged into the tray.
Figure 79:
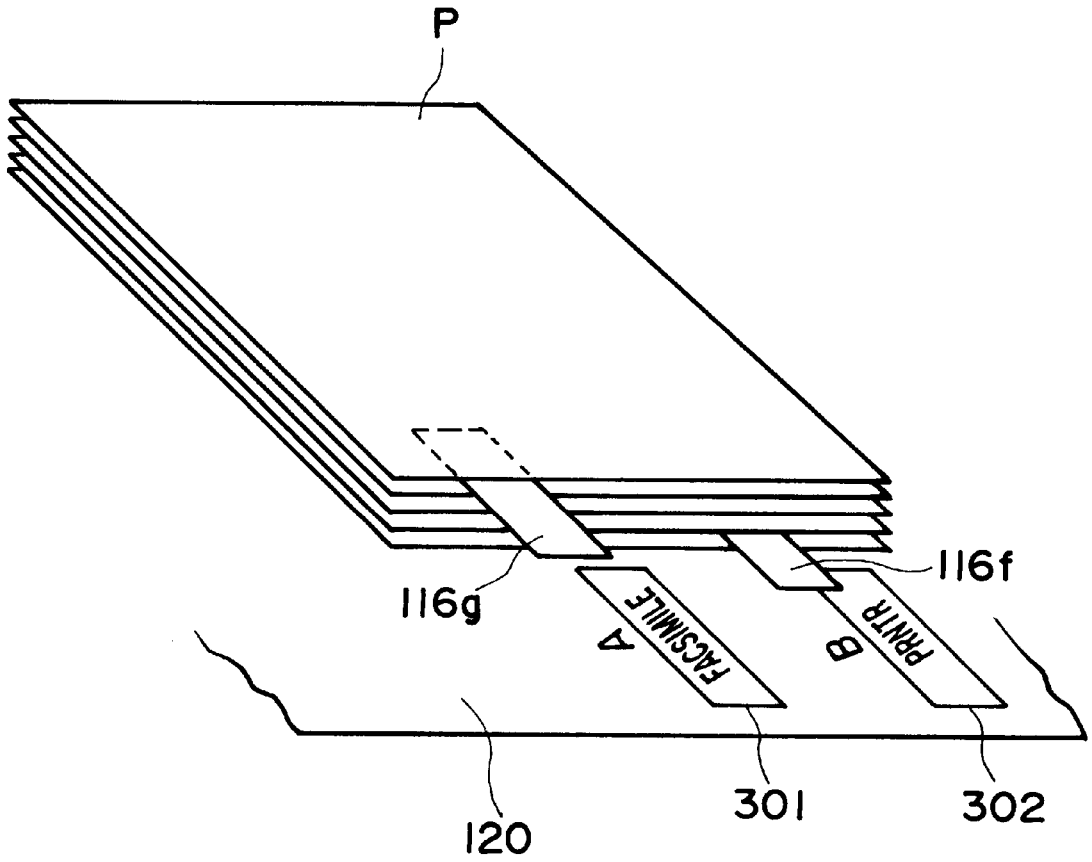
FIG. 79 is a perspective view of the sheet delivery tray and the first sheets having been discharged into the tray, illustrated in FIG. 77.

FIG. 77 is a view of a sheet delivery tray 120 as seen from above. The top surface of the tray 120 has alphabetical markings, "A," "B" and "C," as illustrated in the drawing. Adjacent to the markings, seals (means for displaying job content) 301, 302 and 303 which spell "Fax," "Printer," "Copy," or the like are pasted.

These seals 301, 302, and 303, indicate the image forming apparatus to which each output sheet or output sheet set P belongs; the seal with which the second sheet 116 is aligned indicates the image forming apparatus to which the output sheet or output sheet set P belongs.

The job contents denoted on the seals 301, 302, and 303 pasted adjacent to the corresponding marking "A," "B," and "C" are inputted by the user through control panel (unillustrated) of the image forming apparatus 300.

Next, the general operation in each mode will be described with reference to flow charts.

As for the basic operational flow, first, each operational portion is initialized (FIG. 9A) before beginning a second sheet feeding operation.

In this embodiment, three operational portions are initialized; a pivotal guide portion, a vertically movable tray portion, and a second sheet feeding portion (FIGS. 9B and 9C).

The pivotal guide portion comprises pivotal guides 104 and 105 which are pivotable between their home positions (hereinafter, HP) and the opposite positions. The pivotal guide portion is initialized by controlling the rotation of a pivotal guide motor M1 according to the signals from sensors S2 and S3 which detect the positions of the pivotal guides 104 and 105 (FIG. 9B).

As for the initialization of the second sheet feeding portion, the second sheet position is controlled by rotating a motor M4 forward or backward, and engaging or disengaging a clutch $C1_1$, according to the signals from sensors S6 and S7, in order to register the continuous second sheet for printing and cutting (FIG. 9C).

In a guide pivoting mode in which information is printed on the continuous second sheet, a label pasting mode is executed, and at the same time, whether the guide pivoting operation is to be ended or not is determined according to the determination as to whether the output sheet to which a second sheet is being pasted is the last output sheet of the current job or not (FIG. 10C).

In the label pasting mode, a motor M7 is stopped after the leading end of an output sheet P is conveyed a predetermined distance, which is determined according to the mode, past a sensor S4. On the other hand, the pivotal guides 104 and 105 are pivoted by turning on a guide pivoting motor M1, and at the same time, the continuous second sheet is conveyed or stopped in response to the signal from a sensor S5 and printing information. Then, the continuous second sheet is cut by turning on and off a cutter motor. Thereafter, the output sheet conveyer motor M7 and the second sheet conveyer motor M4 are turned on at the same time, whereby the cut second sheet and the output sheet P are pinched by a roller 106, causing the cut second sheet to be pasted to the back side of the output sheet P.

In the above operation, the position at which the cut second sheet is attached on the output sheet P is varied by varying the distance the leading end of the output sheet P is advanced from the position of the sensor S4; it is varied according to each operation (job assignment). The second sheet conveying motor is turned off according to the signal from the sensor S5. Next, the guide pivoting motor is turned on in response to the signal from the sensor S1 to return the pivotal guides to their home positions, and is controlled in response to the signal from the sensor S2.

The above operational steps are repeated to paste a cut second sheet 116 to the output sheet P of each output sheet set, at the position which corresponds to the job assignment (for example, image formation job for a facsimile machine, a printer, or a copying machine), so that not only the boundaries among the output sheets or output sheet sets can be easily recognized, but also it becomes possible to clearly identify the job to which each output sheet or output sheet set belongs.

Figure 80:
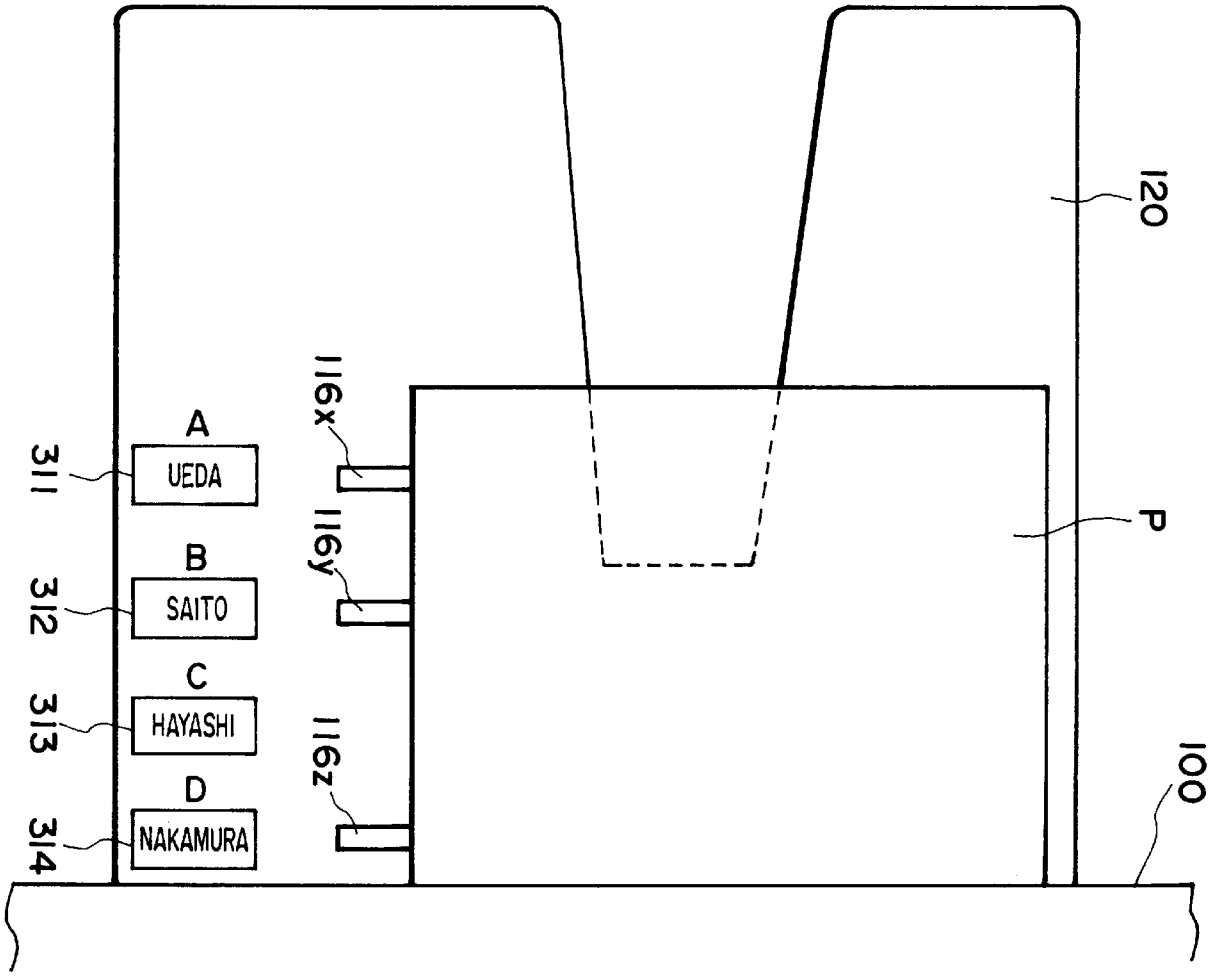
FIG. 80 is a plan view of a sheet delivery tray with address seals, and the first sheets having been discharged into the tray.
Figure 81:
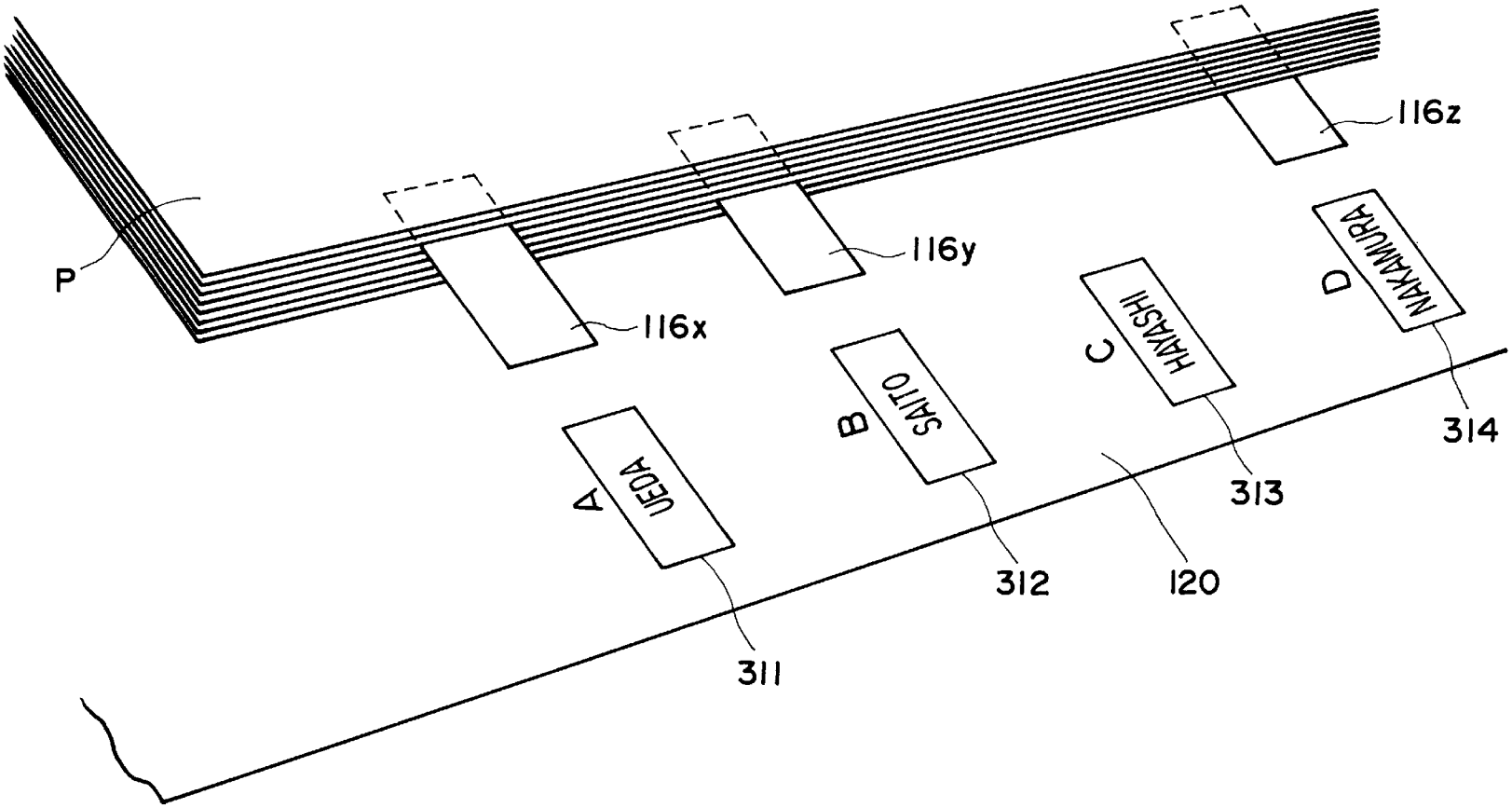
FIG. 81 is a perspective view of the sheet delivery tray and the first sheets having been discharged into the tray, illustrated in FIG. 80.
Figure 82:
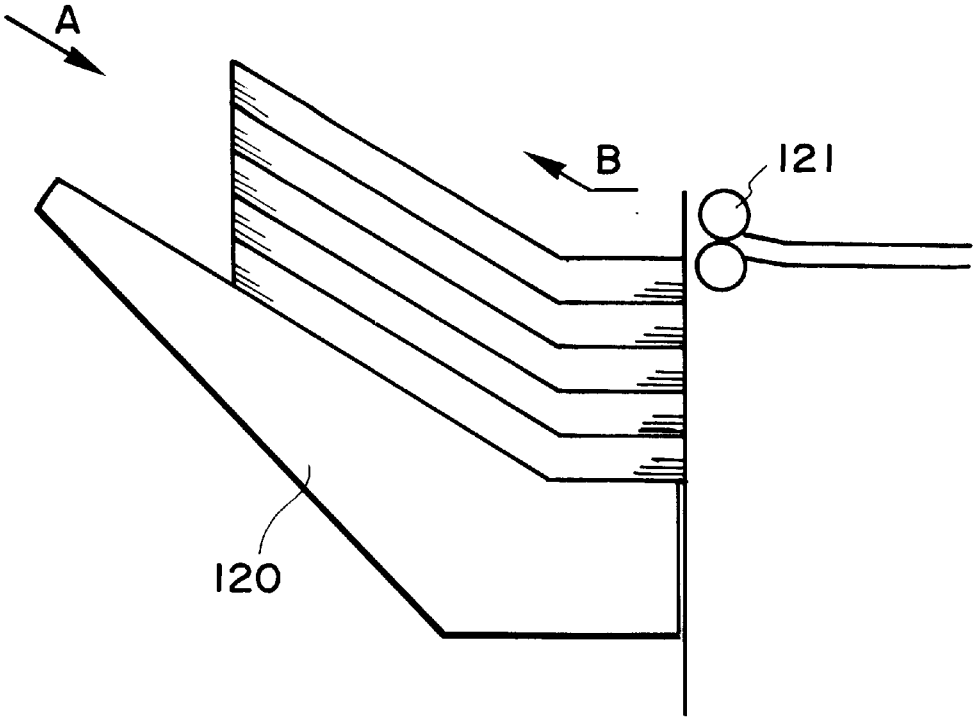
FIG. 82 is a side view of the tray portion of a conventional sheet processing apparatus, which is holding five sheet sets.
Figure 83:
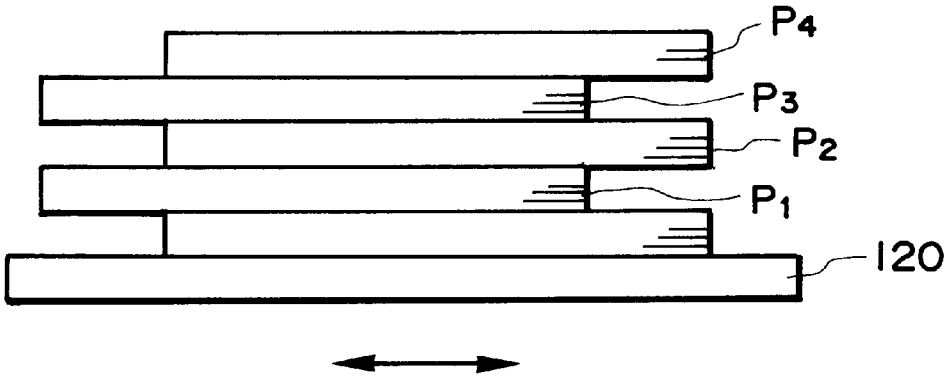
FIG. 83 is a side view of the five sheet sets accumulated staggered in the tray portion illustrated in FIG. 82.
Figure 84:
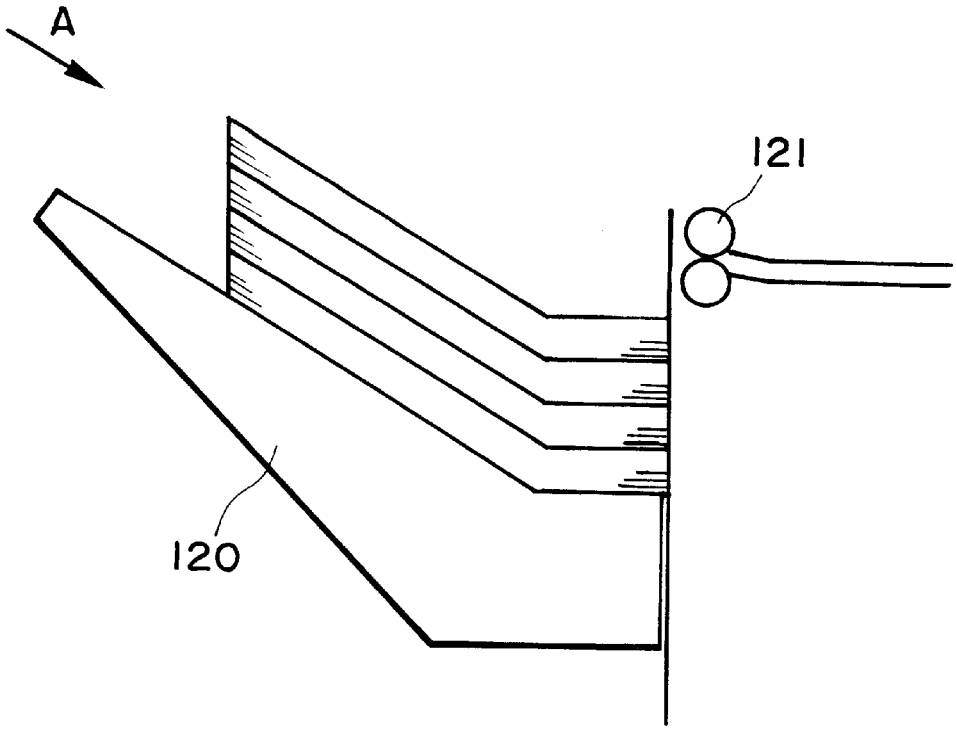
FIG. 84 is a side view of the tray portion of the conventional sheet processing apparatus illustrated in FIG. 82, after one of the five sheet sets has been pulled out.
Figure 85:
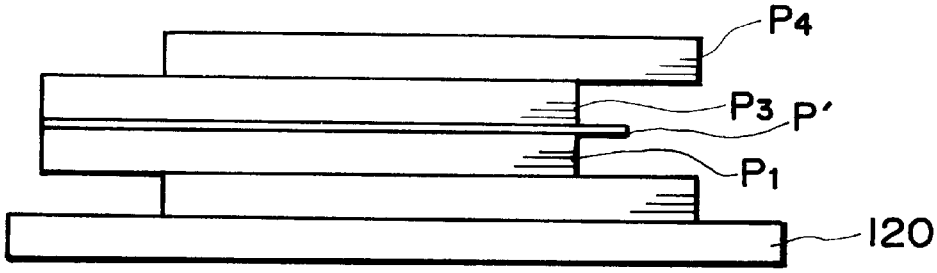
FIG. 85 is a side view of the remaining four sheet sets accumulated staggered in the tray portion illustrated in FIG. 82, after one of the five sheet sets has been pulled out.

Referring to FIGS. 80 and 81, seals which shows user names (addresses to which output sheets or sheet sets P are to be delivered) are pasted to the sheet delivery tray 120, and the cut second sheet 116 is pasted in alignment with one of the name seals.

For example, when the sheet processing apparatus in accordance with the present invention is used with a printing machine connected to a plurality of personal computers, name seals (address displaying means) 311, 312, 313 and 314 for individual personal computer owners are pasted to the sheet delivery tray 120, next to the alphabetical markings, "A," "B," "C," and "D," one for each marking.

The instruction regarding with which marking the second sheet is to be aligned, "A," "B," "C," or "D," is transmitted to the sheet processing apparatus from the output terminal of each personal computer.

The sheet processing apparatus controls the timing for stopping the conveyer motor according to the information regarding the origin of printing signals, so that a cut second sheet 116 is pasted to the position correspondent to the printing signal origin. What is shown on the aforementioned name seals 311, 312, 313 and 314 does not need to be limited to personal names; for example, it may be the names of the groups (department, section, or subsection).

The above described sheet processing apparatus may be connected to a facsimile machine having a plurality of fax numbers. In this case, the seals showing the names to which each fax number belongs are pasted to the sheet delivery tray 120, and the correlation among the positions of marking "A," "B," "C" and "D" and the fax numbers is registered in the main assembly of the facsimile machine.

The sheet processing apparatus controls the timing for stopping the conveyer motor according to the information (fax number) transmitted to the sheet processing apparatus from the main assembly of the facsimile machine regarding the printing signal origin (fax number), so that a second sheet is pasted to an output sheet, at the position correspondent to the printing signal origin.

While the invention has been described with reference to the structures disclosed herein, it is not confined to the details set forth, and this application is intended to cover such modifications or changes as may come within the purposes of the improvements or the scope of the following claims.

What is claimed is:

1. A sheet processing apparatus comprising:

a first sheet feeding means for feeding a first sheet;

a second sheet feeding means for feeding a second sheet for discrimination;

a sheet sticking means for sticking the second sheet fed from said second sheet feeding means on the first sheet in said first sheet feeding means such that a part of said second sheet is partly extended out of said first sheet.

2. An apparatus according to claim 1, further comprising a sheet stacking tray disposed downstream of said first sheet feeding means.

3. An apparatus according to claim 2, wherein the second sheet is effective to group the first sheets on the tray.

4. An apparatus according to claim 2, wherein the second sheet is provided by cutting a predetermined length out of a roll.

5. An apparatus according to claim 4, wherein the second sheet can be supplied into said second sheet feeding means.

6. An apparatus according to claim 2, wherein the second sheet is stuck on a bottom side of the first sheet stacked on said tray.

7. An apparatus according to claim 1, further comprising printing means, in said second sheet feeding means, for printing discrimination on the second sheet in the second sheet feeding means.

8. An apparatus according to claim 1, wherein said second sheet feeding means includes an accommodating portion for accommodating a continuous material for the second sheet, a cutter for cutting the continuous material fed out of said accommodating means into the second sheet, and cut sheet feeding portion for feeding the cut sheet, wherein an image forming station is disposed between said accommodating portion and said cutter.

9. An apparatus according to claim 8, further comprising control means for controlling a cutting position of the second sheet by said cutter.

10. An apparatus according to claim 9, wherein said control means is responsive to a size of the first sheet.

11. An apparatus according to claim 9, wherein said control means is responsive to image formation area of the image forming station for the second sheet.

12. An apparatus according to claim 9, further comprising means for detecting a remaining amount of the continuous material, wherein said control means is responsive to an output of the detecting means.

13. An apparatus according to claim 1, wherein said second sheet feeding means includes a cut sheet accommodating portion for accommodating the second sheet in the form of a cut sheet, and feeding portion for feeding the second sheet fed out of said cut sheet accommodating portion, wherein an image forming station is disposed between said cut sheet accommodating portion and the feeding portion.

14. An apparatus according to claim 7, 8 or 13, wherein a printed side of the second sheet stuck on the first sheet is faced up.

15. An apparatus according to claim 1, wherein when the second sheet is stuck on the first sheet, the first sheet is at rest, and a sticking position of the second sheet on the first sheet is changed by changing the rest position of the first sheet.

16. An image forming apparatus, comprising an apparatus according to claim 1, and image forming means for forming an image on the first sheet and feeding means for feeding the first sheet having the image formed by said image forming means.

17. A sheet processing apparatus comprising:

a first sheet feeding means for feeding a first sheet;

a second sheet feeding means for feeding a second sheet for discrimination;

a sheet sticking means for sticking the second sheet fed from said second sheet feeding means on the first sheet;

a discharging means for discharging the first sheet;

stacking means for stacking the first sheet discharged by said discharging means;

wherein the second sheet is stuck on a bottom side surface of the first sheet in said stacking means.

18. A sheet processing apparatus comprising:

a first sheet feeding means for feeding a first sheet;

a second sheet feeding means for feeding a second sheet for discrimination;

a sheet sticking means for sticking the second sheet fed from said second sheet feeding means on the first sheet;

a discharging means for discharging the first sheet;

stacking means for stacking the first sheet discharged by said discharging means;

wherein a position where the second sheet is stuck on the first sheet in said stacking means, is upstream of an abutment position of a leading edge of a next sheet with respect to a direction of discharge by said discharging means.

19. A sheet processing apparatus comprising:

a first sheet feeding means for feeding a first sheet;

a second sheet feeding means for feeding a second sheet for discrimination;

a sheet sticking means for sticking the second sheet fed from said second sheet feeding means on the first sheet;

a discharging means for discharging the first sheet;

stacking means for stacking the first sheet discharged by said discharging means;

wherein when the first sheet is stacked on said stacking means, a leading edge of a next sheet is abutted to a sheet already on said stacking means, and thereafter, the next sheet is moved back and stacked;

wherein a position where the second sheet is stuck on the first sheet in said stacking means, is upstream of an abutment position of a leading edge of a next sheet and is downstream of an abutment position of a trailing edge of the next sheet, with respect to a direction of discharge by said discharging means.

20. A sheet processing apparatus comprising:

a first sheet feeding means for feeding a first sheet;

a second sheet feeding means for feeding a second sheet for discrimination;

a sheet sticking means for sticking the second sheet fed from said second sheet feeding on the first sheet;

a discharging means for discharging the first sheet;

stacking means for stacking the first sheet discharged by said discharging means;

wherein when the first sheet is stacked on said stacking means, a trailing edge of a next sheet is abutted to a sheet already on said stacking means, and thereafter, the next sheet is moved back and stacked;

wherein a position where the second sheet is stuck on the first sheet in said stacking means, is upstream of a position where the sheet starts to move back abutment of the trailing edge of the next sheet already said stacking means, with respect to a direction of backward movement of the sheet.

21. An apparatus according to claim 17, 18, 19 or 20, further comprising printing means for effecting printing on the second sheet.

22. An image forming apparatus, comprising an apparatus according to any one of claims 17 to 20, and image forming means for forming an image on the first sheet and feeding means for feeding the first sheet having the image formed by said image forming means.

23. A sheet processing apparatus comprising:

a first sheet feeding means for feeding a first sheet;

a second sheet feeding means for feeding a second sheet for discrimination;

a sheet sticking means for sticking the second sheet fed from said second sheet feeding means on the first sheet;

wherein said second sheet feeding means is capable of being loaded with the second sheet.

24. An apparatus according to claim 23, wherein the second sheet is provided by cutting a predetermined length out of a roll, and said second sheet feeding means has a cutter for cutting the roll into the sheet.

25. An apparatus according to claim 23, wherein the second sheets are contained in a cartridge, which is detachably mountable relative to said second sheet feeding means.

26. An apparatus according to claim 25, wherein the second sheet is provided by cutting a roll.

27. An apparatus according to claim 25, wherein the second sheet is a cut sheet.

28. An apparatus according to any one of claims 23 to 27, further comprising detecting means for detecting presence or absence of the second sheet in said second sheet feeding means, wherein when said detecting means detects absence of the second sheet, operation of said sheet processing apparatus is stopped.

29. An apparatus according to any one of claims 23 to 27, wherein after loading of the second sheets into said second sheet feeding means, leading edges of second sheets are automatically fed to a predetermined position.

30. An apparatus according to claim 25, wherein said cartridge includes a sheet cutter.

31. An image forming apparatus, comprising an apparatus according to any one of claims 23 to 27, and image forming means for forming an image on the first sheet and feeding means for feeding the first sheet having the image formed by said image forming means.

32. A sheet processing apparatus comprising:

a first sheet feeding means for feeding a first sheet;

a second sheet feeding means for feeding a second sheet for discrimination;

a sheet sticking means for sticking the second sheet fed from said second sheet feeding means on the first sheet;

discharging means for discharging the first sheet;

stacking means for stacking the first sheet discharged by said discharging means;

a plurality of job display means, provided on said stacking means, for displaying job content for the first sheet;

control means for causing the second sheet to be stuck on the first sheet at a position corresponding to the job content.

33. A sheet processing apparatus comprising:

a first sheet feeding means for feeding a first sheet;

a second sheet feeding means for feeding a second sheet for discrimination;

a sheet sticking means for sticking the second sheet fed from said second sheet feeding means on the first sheet;

discharging means for discharging the first sheet;

stacking means for stacking the first sheet discharged by said discharging means;

a plurality of destination display means, provided on said stacking means, for displaying destination to which the second sheet is to be distributed;

control means for causing the second sheet to be stuck on the first sheet at a position corresponding to said display means.

34. An apparatus according to claim 33, wherein images are formed on the first sheets on the basis of a plurality of facsimile telephone numbers, and said destination display means displays the facsimile telephone numbers or the destinations on the basis of the facsimile telephone numbers.

35. An image forming apparatus, comprising an apparatus according to claim 33 or 34, and image forming means for forming an image on the first sheet and feeding means for feeding the first sheet having the image formed by said image forming means.

36. A sheet processing apparatus comprising:

a sheet sticking means for sticking a second sheet on a first sheet;

stacking means for stacking the first sheet;

a plurality of job display means, provided on said stacking means, for displaying job content for the first sheet;

control means for causing the second sheet to be stuck on the first sheet at a position corresponding to the job content.

37. A sheet processing apparatus comprising:

a sheet sticking means for sticking a second sheet on a first sheet;

stacking means for stacking the first sheet;

a plurality of destination display means, provided on said stacking means, for displaying destination to which the second sheet is to be distributed; and control means for causing the second sheet to be stuck on the first sheet at a position corresponding to said display means.

38. An apparatus according to claim 37, wherein images are formed on the first sheets on the basis of a plurality of facsimile telephone numbers, and said destination display means displays the facsimile telephone numbers or the destinations on the basis of the facsimile telephone numbers.

39. An image forming apparatus, comprising an apparatus according to claim 37 or 38, and image forming means for forming an image on the first sheet and feeding means for feeding the first sheet having the image formed by said image forming means.

* * * * *

UNITED STATES PATENT AND TRADEMARK OFFICE

CERTIFICATE OF CORRECTION

PATENT NO. : 5,897,250

DATED : April 27, 1999

INVENTOR(S) : KATSUAKI HIRAI, ET AL.

It is certified that error appears in the above-identified patent and that said Letters Patent is hereby corrected as shown below:

COLUMN 2,
Line 7, "comprise" should read --comprises--; and ";" should read --:--.

COLUMN 3,
Line 3, "means, In" should read --means, in--.

COLUMN 4,
Line 57, "flaw" should read --flow--.

COLUMN 5,
Line 13, "a" should be deleted.

COLUMN 6,
Line 12, "FIG. 39(a)" should read --FIG. 39A--; and
Line 13, "FIG. 39(b)" should read --FIG. 39B--.

COLUMN 9,
Line 7, "disposed On" should read --disposed. On--; and
Line 23, "interfere" should read --interfere with--.

COLUMN 12,
Line 3, "be" (1st occurrence) should be deleted;
Line 12, "20" should be deleted; and
Line 16, "(S46-S57)" should read --(S46-S51)--.

UNITED STATES PATENT AND TRADEMARK OFFICE

CERTIFICATE OF CORRECTION

PATENT NO. : 5,897,250

DATED : April 27, 1999

INVENTOR(S) : KATSUAKI HIRAI, ET AL.

It is certified that error appears in the above-identified patent and that said Letters Patent is hereby corrected as shown below:

COLUMN 15,
Line 66, "sate" should read --state--.

COLUMN 17,
Line 34, "40E)" should read --40E--.

COLUMN 18,
Line 28, "ban" should read --back--.

COLUMN 19,
Line 55, "56," should read --S6,--.

COLUMN 21,
Line 37, "shows" should read --show--.

COLUMN 23,
Line 66, "feeding on" should read --feeding means on--.

UNITED STATES PATENT AND TRADEMARK OFFICE

CERTIFICATE OF CORRECTION

PATENT NO. : 5,897,250

DATED : April 27, 1999

INVENTOR(S) : KATSUAKI HIRAI, ET AL.

It is certified that error appears in the above-identified patent and that said Letters Patent is hereby corrected as shown below:

COLUMN 24,
Line 11, "back abutment" should read --back after abutment--; and
Line 12, "already said" should read --already on said--.

Signed and Sealed this

Twenty-first Day of December, 1999

*Attest:*

Q. TODD DICKINSON

*Attesting Officer*

*Acting Commissioner of Patents and Trademarks*